US011311925B2

(12) United States Patent
Shirakami et al.

(10) Patent No.: US 11,311,925 B2
(45) Date of Patent: Apr. 26, 2022

(54) SADDLE-SHAPED PRESS-MOLDED ARTICLE MANUFACTURING METHOD, PRESSING APPARATUS, AND MANUFACTURING METHOD TO MANUFACTURE SADDLE-SHAPED PRESS-MOLDED ARTICLE

(71) Applicant: NIPPON STEEL CORPORATION, Tokyo (JP)

(72) Inventors: Satoshi Shirakami, Tokyo (JP); Yoshiaki Nakazawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/053,948

(22) PCT Filed: May 7, 2019

(86) PCT No.: PCT/JP2019/018279
§ 371 (c)(1),
(2) Date: Nov. 9, 2020

(87) PCT Pub. No.: WO2019/216317
PCT Pub. Date: Nov. 14, 2019

(65) Prior Publication Data

US 2021/0220896 A1 Jul. 22, 2021

(30) Foreign Application Priority Data

May 11, 2018 (JP) ..... JP2018-091844

(51) Int. Cl.
*B21D 22/06* (2006.01)
*B21D 22/21* (2006.01)
*B21D 53/88* (2006.01)

(52) U.S. Cl.
CPC ..... *B21D 22/06* (2013.01); *B21D 22/21* (2013.01); *B21D 53/88* (2013.01)

(58) Field of Classification Search
CPC ..... B21D 22/02; B21D 22/06; B21D 22/21; B21D 19/08; B21D 19/084; B21D 5/01; B21D 53/88
See application file for complete search history.

(56) References Cited

U.S. PATENT DOCUMENTS 10,022,764 B2 7/2018 Nishimura et al.
2011/0120204 A1* 5/2011 Maeda ..... B21D 22/02 72/309

(Continued)

FOREIGN PATENT DOCUMENTS

EP 2796221 A1 10/2014
JP 2002-224753 A 8/2002

(Continued)

*Primary Examiner* — Debra M Sullivan
(74) *Attorney, Agent, or Firm* — SOLARIS Intellectual Property Group, PLLC

(57) ABSTRACT

According to the present disclosure, a manufacturing method for a saddle-shaped press-molded article includes curling a blank at a top plate configuration location of the blank that will form a top plate portion, applying the curl with a first force acting from an inner face side toward an outer face side of the blank at the top plate configuration location, applying the curl with a net force configured by second forces acting in mutually facing directions and a third force acting in the opposing direction to the first force at the outer face side of respective vertical wall configuration locations of the blank that will be molded into vertical wall portions, and in a state in which the top plate configuration location is curled, restraining end portion inverted ridge configuration location that will be molded into end portion inverted ridge portion, the top plate configuration location, the vertical wall configuration locations, and end (Continued)

portion flange configuration location that will be molded into end portion flange.

7 Claims, 50 Drawing Sheets

(56) References Cited

U.S. PATENT DOCUMENTS

| | | | | |
|---|---|---|---|---|
| 2014/0000336 | A1* | 1/2014 | Alm | B21D 5/01 72/379.2 |
| 2014/0356643 | A1 | 12/2014 | Nakata et al. | |
| 2015/0174634 | A1 | 6/2015 | Nishimura et al. | |
| 2015/0367392 | A1 | 12/2015 | Nishimura et al. | |

FOREIGN PATENT DOCUMENTS

| | | | |
|---|---|---|---|
| JP | 2002-321013 | A | 11/2002 |
| JP | 2005-254279 | A | 9/2005 |
| JP | 5569661 | B2 | 8/2014 |
| JP | 5958644 | B2 | 8/2016 |
| WO | WO 2013/094705 | A1 | 6/2013 |
| WO | WO 2014/148618 | A1 | 9/2014 |

* cited by examiner

SADDLE-SHAPED PRESS-MOLDED ARTICLE MANUFACTURING METHOD, PRESSING APPARATUS, AND MANUFACTURING METHOD TO MANUFACTURE SADDLE-SHAPED PRESS-MOLDED ARTICLE

TECHNICAL FIELD

The present disclosure relates to a saddle-shaped press-molded article manufacturing method, a pressing apparatus, and a manufacturing method to manufacture a saddle-shaped press-molded article.

BACKGROUND ART

Torsional force and bending force act on a vehicle body floor of an automobile during travel. Moreover, impact load is input to the vehicle body floor in a collision. In order to withstand such forces, members such as cross members side members with a hat-shaped cross-section profile are used to increase the rigidity of the vehicle body floor.

Cross members transmit impact load during a side-on collision. A high strength is thereby required of such cross members. However, the weight of the vehicle body floor greatly affects the weight of the vehicle.

The vehicle body floor therefore needs to have high rigidity while being lightweight. In order to make vehicles more lightweight while also improving collision safety, high tensile strength sheet steel that is thin, high strength, and has a tensile strength of 390 MPa or above is employed as the vehicle body floor material. Examples of such high tensile strength sheet steel include high strength sheet steel or high tensile strength steel.

For example, cross members are described in the specifications of Japanese Patent Nos. 5958644 (Patent Document 1) and 5569661. Each of these cross members is joined to another floor configuration member. In consideration of join strength with respect to the other floor configuration member, torsional rigidity, and the ability to transmit impact load, the cross members are preferably formed with a saddle-shaped profile provided with outward-facing flanges formed at end portions thereof.

SUMMARY OF INVENTION

Technical Problem

However, high tensile strength sheet steel is difficult to mold, and offers a low degree of freedom in terms of design.

Thus, in cases in which a saddle-shaped press-molded article is molded by cold pressing, the extension length of flanges at end portions thereof is inherently limited. This limitation to the flange extension length becomes more pronounced the higher the strength of the steel material being utilized.

In consideration of the above circumstances, an object of the present disclosure is to provide a saddle-shaped press-molded article manufacturing method, a pressing apparatus, and a manufacturing method to manufacture a saddle-shaped press-molded article that enable the extension length of a flange formed at an end portion to be increased.

Solution to Problem

The present disclosure discloses a method to manufacture a saddle-shaped press-molded article by manufacturing from a blank made of sheet metal, the saddle-shaped press-molded article including a top plate portion, protruding ridge portions respectively adjoining two side portions of the top plate portion, vertical wall portions respectively adjoining the protruding ridge portions so as to face each other, an end portion inverted ridge portion adjoining an end portion of the top plate portion, end portion of the protruding ridge portions, and end portion of the vertical wall portions, and an end portion flange adjoining the end portion inverted ridge portion. The saddle-shaped press-molded article manufacturing method includes curling the blank at a top plate configuration location of the blank that will form the top plate portion, applying the curl with a first force acting from an inner face side toward an outer face side of the blank at the top plate configuration location, applying the curl with a net force configured by second forces acting in mutually facing directions and a third force acting in an opposing direction to the first force at the outer face side of respective vertical wall configuration locations of the blank that will be molded into the vertical wall portions, and in a state in which the top plate configuration location is curled, restraining end portion inverted ridge configuration locations that will be molded into the end portion inverted ridge portion, the top plate configuration location, the vertical wall configuration locations, and an end portion flange configuration location that will be molded into the end portion flange.

Namely, when pressing the blank, the first force acting from the inner face side toward the outer face side is applied to the top plate configuration location of the blank that will be molded into the top plate portion of the saddle-shaped press-molded article. The net force configured by the second forces acting in mutually facing directions and the third force acting in an opposing direction to the first force are applied to the outer face of the respective vertical wall configuration locations of the blank that will be molded into the vertical wall portions. When this is performed, the blank flexes and curls such that the top plate configuration location projects outward.

In this curled state of the top plate configuration location, the saddle-shaped press-molded article is molded while restraining the end portion inverted ridge configuration locations that will be molded into the end portion inverted ridge portion, the top plate configuration location, the vertical wall configuration locations, and the end portion flange configuration location that will be molded into the end portion flange.

During this press molding, the pressed blank curls such that the top plate configuration location projects outward, and the third force does not act on the vertical wall configuration locations until the vertical wall configuration locations are restrained by the second forces. Thus, the third force acting in an opposing direction to the first force does not pull the vertical wall configuration locations in the opposing direction to the first force, enabling the state in which the top plate configuration location is curled so as to project outward to be maintained.

When the top plate configuration location is then pressed by the first force, the portion of the top plate configuration location curling outward is flattened, resulting in surplus material. This surplus material is channeled into the end portion flange configuration locations that will become the end portion flange through the end portion inverted ridge configuration locations that will be molded into the end portion inverted ridge portion.

Note that the end portion flange stands out from the top plate portion and the vertical wall portions, and corner portions of the end portion flange positioned at end portion of the protruding ridge portions adjoining the two side portions of the top plate portion undergo the most stretching and are thus susceptible to thinning.

In the present disclosure, the surplus material that has been channeled into the end portion flange configuration locations is channeled into the corner portions of the end portion flange, thereby enabling the material that might otherwise suffer a reduction in thickness during stretching to be supplemented and any such reduction in thickness to be suppressed.

This enables the occurrence of cracking and the like to be suppressed even if the end portion flange have a large extension length.

Advantageous Effects of the Invention

The present disclosure enables the extension length of a flange formed at an end portion to be increased.

DESCRIPTION OF EMBODIMENTS

First Exemplary Embodiment

Explanation follows regarding a first exemplary embodiment, with reference to FIG. 1 to FIG. 19.

Figure 1:
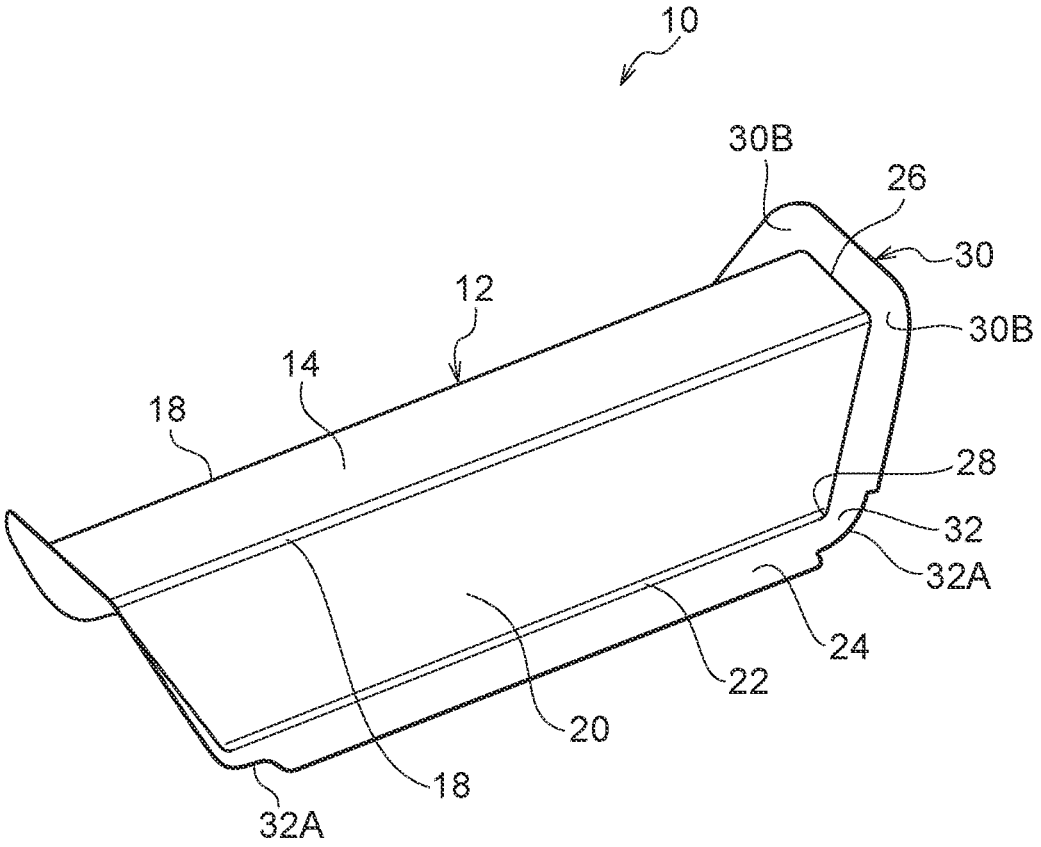
FIG. 1 is a perspective view illustrating a saddle-shaped press-molded article according to a first exemplary embodiment.
Figure 2:
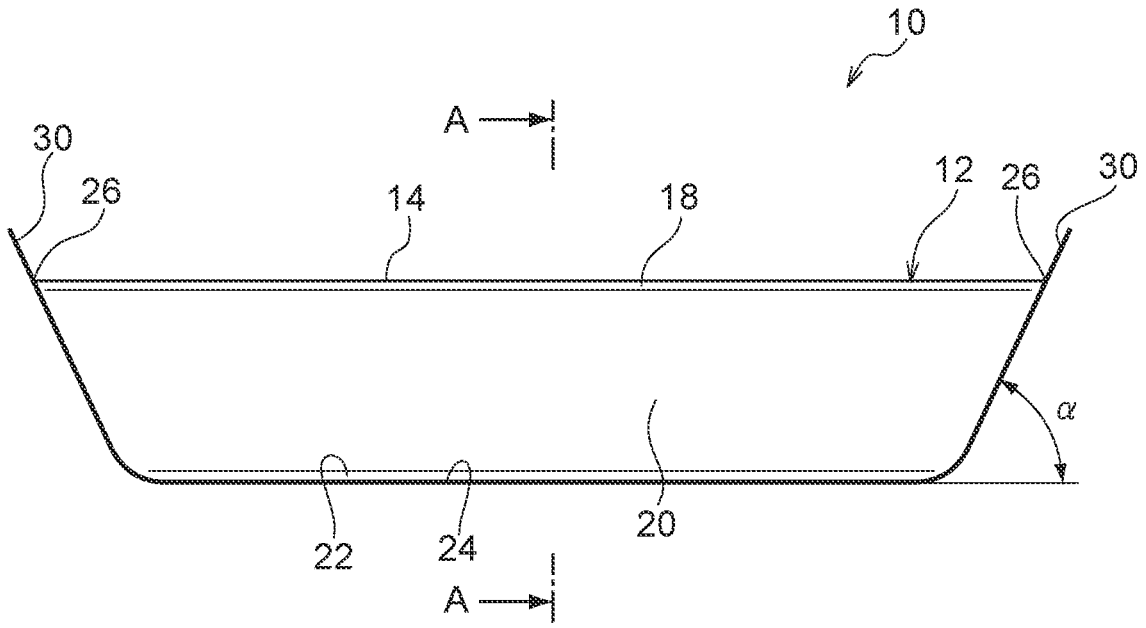
FIG. 2 is a side view illustrating a saddle-shaped press-molded article according to the first exemplary embodiment.
Figure 3:
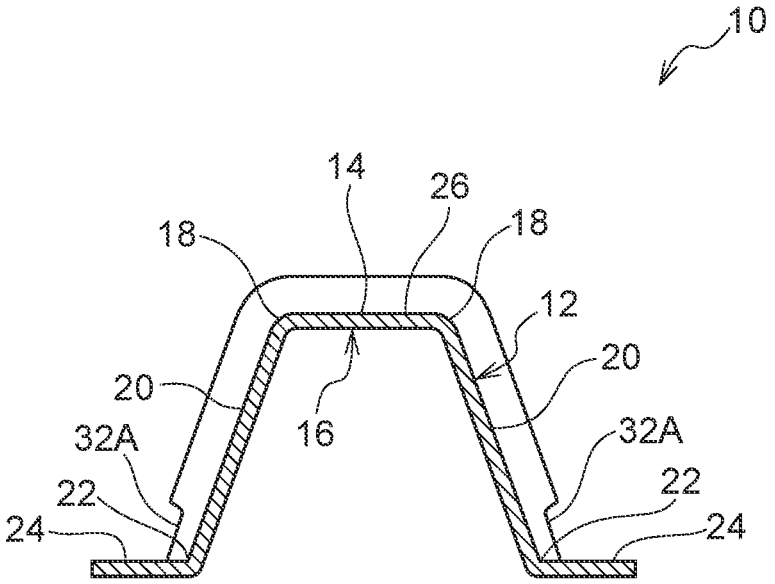
FIG. 3 is a cross-section sectioned along line A-A in FIG. 2.

FIG. 1 to FIG. 3 are diagrams illustrating a saddle-shaped press-molded article 10 molded by a saddle-shaped press-molded article manufacturing method according to the present exemplary embodiment. As an example, the saddle-shaped press-molded article 10 configures a vehicle body component in an automobile.

Examples of such vehicle body components include cross members that extend along a vehicle width direction, such as floor cross members or seat cross members. Other examples of such vehicle body components include members such as side sills or side members that extend along a vehicle body front-rear direction.

For example, in a case in which the saddle-shaped press-molded article 10 configures a floor cross member, width direction side portions of the saddle-shaped press-molded article 10 are joined to a front floor panel of a floor section, and length direction end portions of the saddle-shaped press-molded article 10 are joined to a side sill and a tunnel section of the front floor panel.

Saddle-Shaped Press-Molded Article

The saddle-shaped press-molded article 10 is molded by cold pressing a sheet metal blank. As illustrated in FIG. 1 and FIG. 2, the saddle-shaped press-molded article 10 is formed in an elongated shape. As illustrated in FIG. 3, a molded article body 12 of the saddle-shaped press-molded article 10 is formed with a hat-shaped cross-section profile.

As illustrated in FIG. 1 to FIG. 3, the molded article body 12 of the saddle-shaped press-molded article 10 includes a rectangular top plate portion 14. Protruding ridge portions 18 that curve toward the side of an inner face 16 (see FIG. 3) of the saddle-shaped press-molded article 10 are formed to respective side portions of the top plate portion 14 as positioned in the width direction of the saddle-shaped press-molded article 10. Namely, the protruding ridge portions 18 provided to the saddle-shaped press-molded article 10 adjoin the two side portions of the top plate portion 14.

Vertical wall portions 20 extend from the respective protruding ridge portions 18 in directions away from the top plate portion 14. Namely, the vertical wall portions 20 provided to the saddle-shaped press-molded article 10 adjoin the respective protruding ridge portions 18 and face each other.

Leading end portions of the vertical wall portions 20 are curled toward the sides so as to form lower inverted ridge portions 22. Namely, the lower inverted ridge portions 22 provided to the saddle-shaped press-molded article 10 adjoin the respective vertical wall portions 20.

Lower flanges 24 extend from the respective lower inverted ridge portions 22 in directions away from the corresponding vertical wall portions 20. Namely, the lower flanges 24 provided to the saddle-shaped press-molded article 10 adjoin the respective lower inverted ridge portions 22. Note that leading ends of the lower flanges 24 extend in directions away from each other.

End portion inverted ridge portions 26 curled so as to extend outward are formed to respective end portions of the top plate portion 14, respective end portions of the protruding ridge portions 18, and respective end portions of the vertical wall portions 20 as positioned with respect to the saddle-shaped press-molded article 10 length direction. Each of the end portion inverted ridge portions 26 is formed over the entirety of a range spanning from one of the vertical wall portions 20, across one of the protruding ridge portions 18, the top plate portion 14, and the other of the protruding ridge portions 18, to the other of the vertical wall portions 20. Namely, the molded article body 12 includes the end portion inverted ridge portions 26 adjoining and continuous to the respective end portions of the top plate portion 14, the respective end portions of the protruding ridge portions 18, and the respective end portions of the vertical wall portions 20.

The end portion inverted ridge portions 26 are connected to the corresponding lower inverted ridge portions 22 through curved ridge portions 28. The end portion inverted ridge portions 26 and lower inverted ridge portions 22 are thus formed so as to run continuously to each other around the entire periphery of a peripheral edge of the molded article body 12 configured including one of the vertical wall portions 20, one of the protruding ridge portions 18, the top plate portion 14, another of the protruding ridge portions 18, and another of the vertical wall portions 20.

Respective end portion flanges 30 extend outward from the saddle-shaped press-molded article 10 from the end portion inverted ridge portions 26. Namely, the end portion flanges 30 are integrally formed in U-shapes at the respective end portions of the molded article body 12. Namely, the end portion flanges 30 provided to the saddle-shaped press-molded article 10 adjoin the respective end portion inverted ridge portions 26.

Curved portions 32 that curve toward the lower flanges 24 are formed at respective end portions of the U-shaped end portion flanges 30. An indentation 32A set back toward the inner side is formed in each of the curved portions 32. The curved portions 32 are connected to the corresponding lower flanges 24.

Namely, the two end portion flanges 30 and two lower flanges 24 are formed so as to run continuously to each other around the entire periphery of an outer peripheral portion of the molded article body 12. As illustrated in FIG. 2, an angle formed between an extension line of the lower flange 24 and the end portion flange 30 is expressed by a rising angle $\alpha$.

Blank

Figure 4:
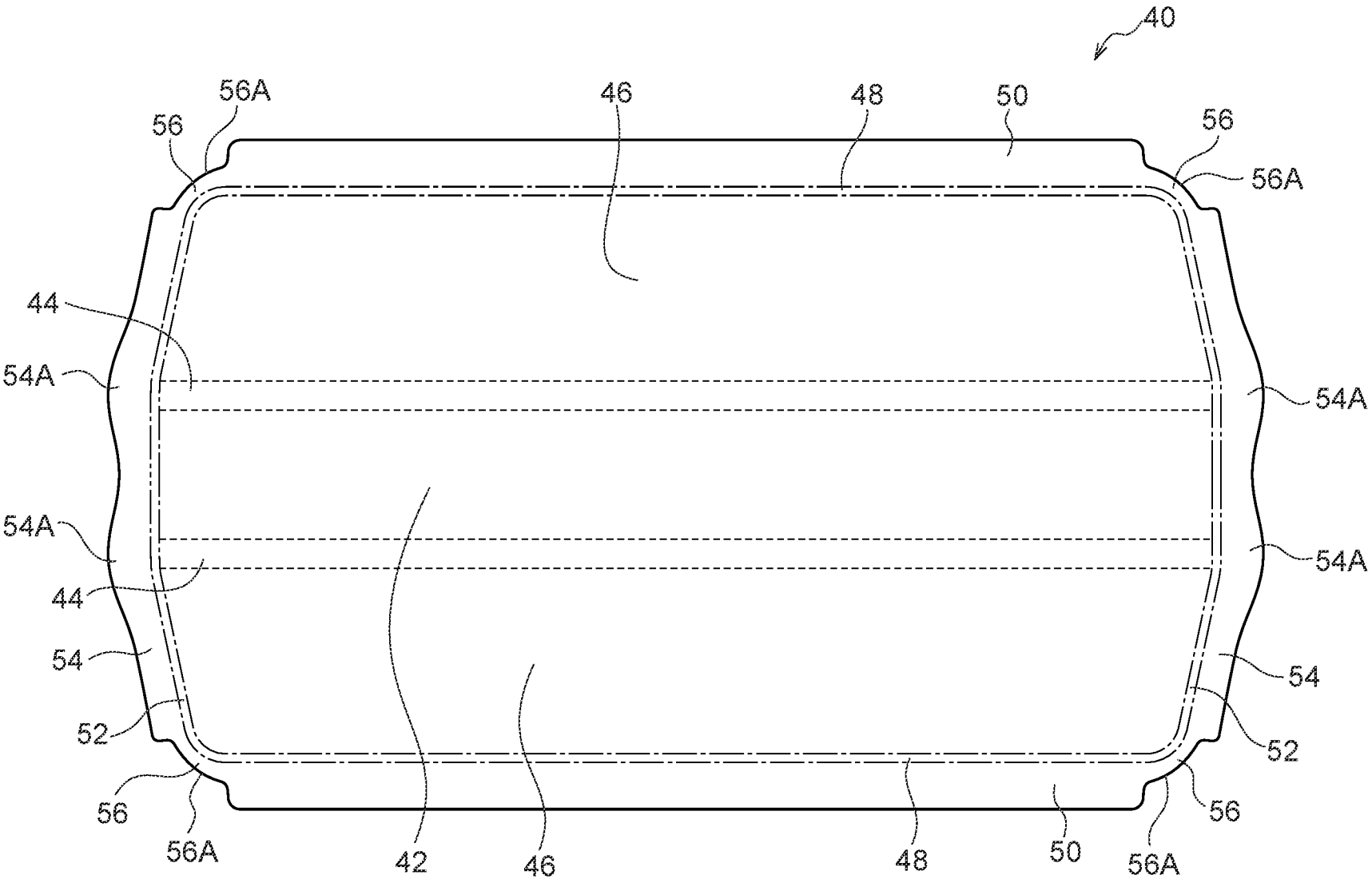
FIG. 4 is a plan view illustrating a blank according to the first exemplary embodiment.

FIG. 4 is a plan view illustrating a blank 40 for molding the saddle-shaped press-molded article 10. The blank 40 is a high tensile strength sheet steel with a tensile strength of 390 MPa or above. Specifically, the blank 40 is configured from high strength sheet steel or high tensile strength steel. The tensile strength of the blank 40 is preferably 590 MPa or above, and more preferably 980 MPa or above.

The blank 40 is formed in a rectangular shape. A top plate configuration location 42 that will be molded into the top plate portion 14 of the saddle-shaped press-molded article 10 extends along the length direction at a width direction central portion of the blank 40. Protruding ridge configuration locations 44 that will form the protruding ridge portions 18 of the saddle-shaped press-molded article 10 extend along the length direction on both sides of the top plate configuration location 42. Vertical wall configuration locations 46 that will form the vertical wall portions 20 of the saddle-shaped press-molded article 10 extend along the length direction adjoining the respective protruding ridge configuration locations 44.

Lower inverted ridge configuration locations 48 that will form the lower inverted ridge portions 22 of the saddle-shaped press-molded article 10 extend along the length direction adjoining the respective vertical wall configuration locations 46. Lower flange configuration locations 50 that will form the lower flanges 24 of the saddle-shaped press-molded article 10 extend along the length direction adjoining the respective lower inverted ridge configuration locations 48. Namely, the top plate configuration location 42, the protruding ridge configuration locations 44, the vertical wall configuration locations 46, the lower inverted ridge configuration locations 48, and the lower flange configuration locations 50 are present in this sequence on progression from the width direction central portion toward width direction end portions of the blank 40.

End portion inverted ridge configuration locations 52 that will be molded into the end portion inverted ridge portions 26 of the saddle-shaped press-molded article 10 are formed at respective ends of the top plate configuration location 42, the protruding ridge configuration locations 44, and the vertical wall configuration locations 46 in the length direction of the blank 40.

End portion flange configuration locations 54 that will be molded into the end portion flanges 30 of the saddle-shaped press-molded article 10 are formed at end portion sides of the respective end portion inverted ridge configuration locations 52 in the length direction of the blank 40. Edges of the end portion flange configuration locations 54 that are positioned on extension lines of the respective protruding ridge configuration locations 44 are formed with surplus portions 54A that project outward and that are drawn inward during molding.

Curve configuration locations 56 that will form the curved portions 32 of the saddle-shaped press-molded article 10 are formed between the end portion flange configuration locations 54 and the respective lower flange configuration locations 50. Indentation configuration locations 56A to form the indentations 32A in the saddle-shaped press-molded article 10 are formed set back toward the inside in edges of the curve configuration locations 56.

Pressing Apparatus

Figure 5:
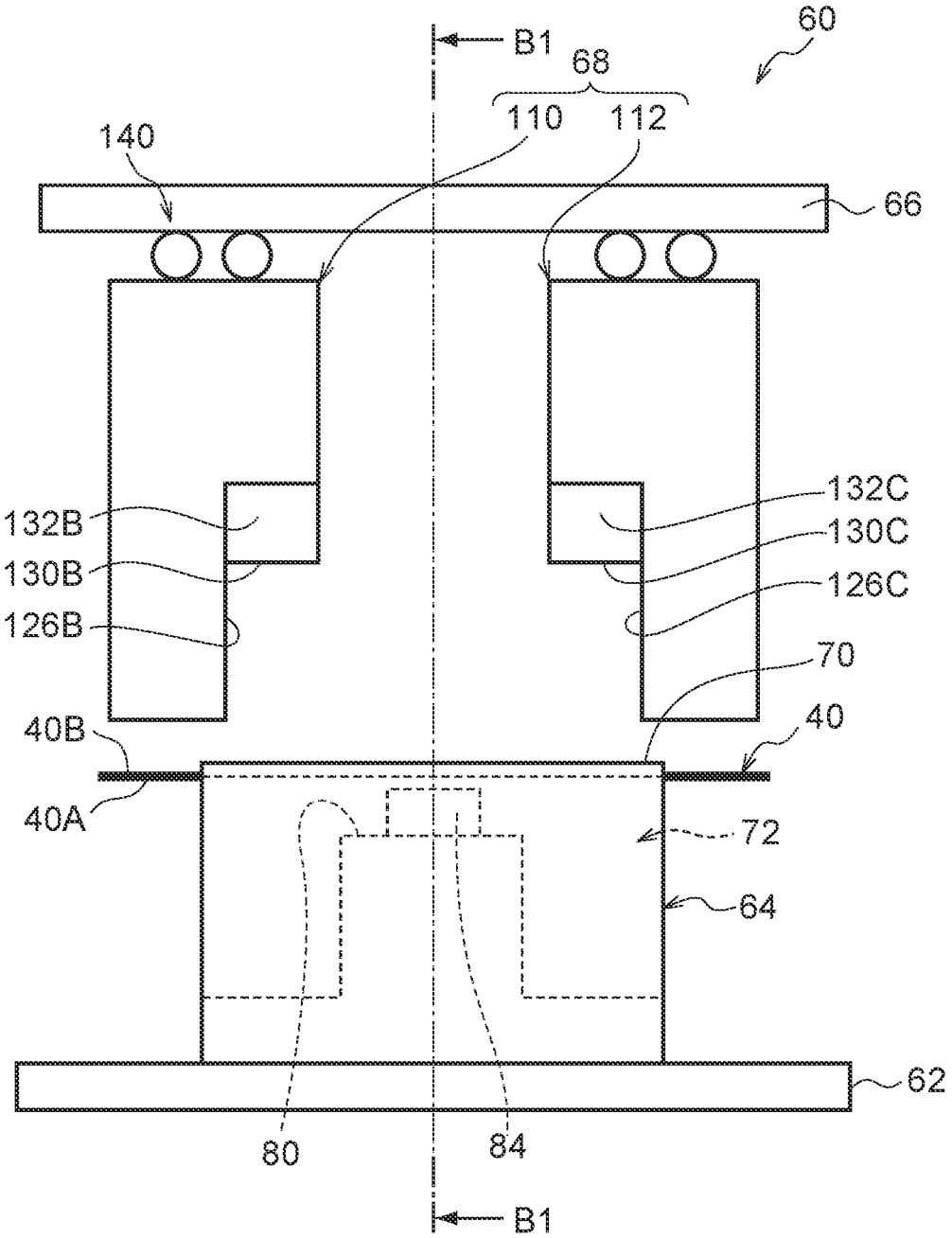
FIG. 5 is a front view illustrating a pressing apparatus according to the first exemplary embodiment.
Figure 6:
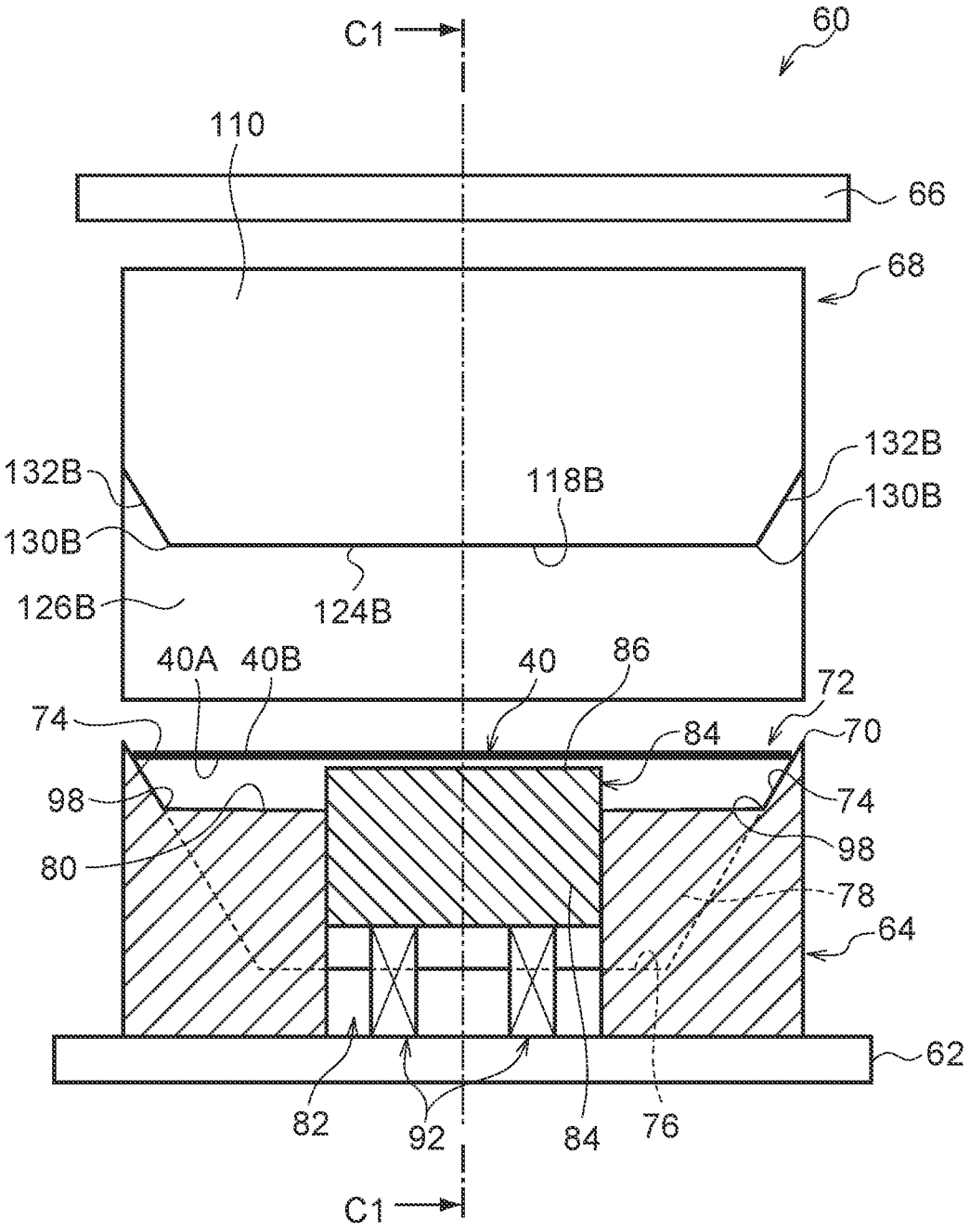
FIG. 6 is a cross-section sectioned along line B1-B1 in FIG. 5.
Figure 7:
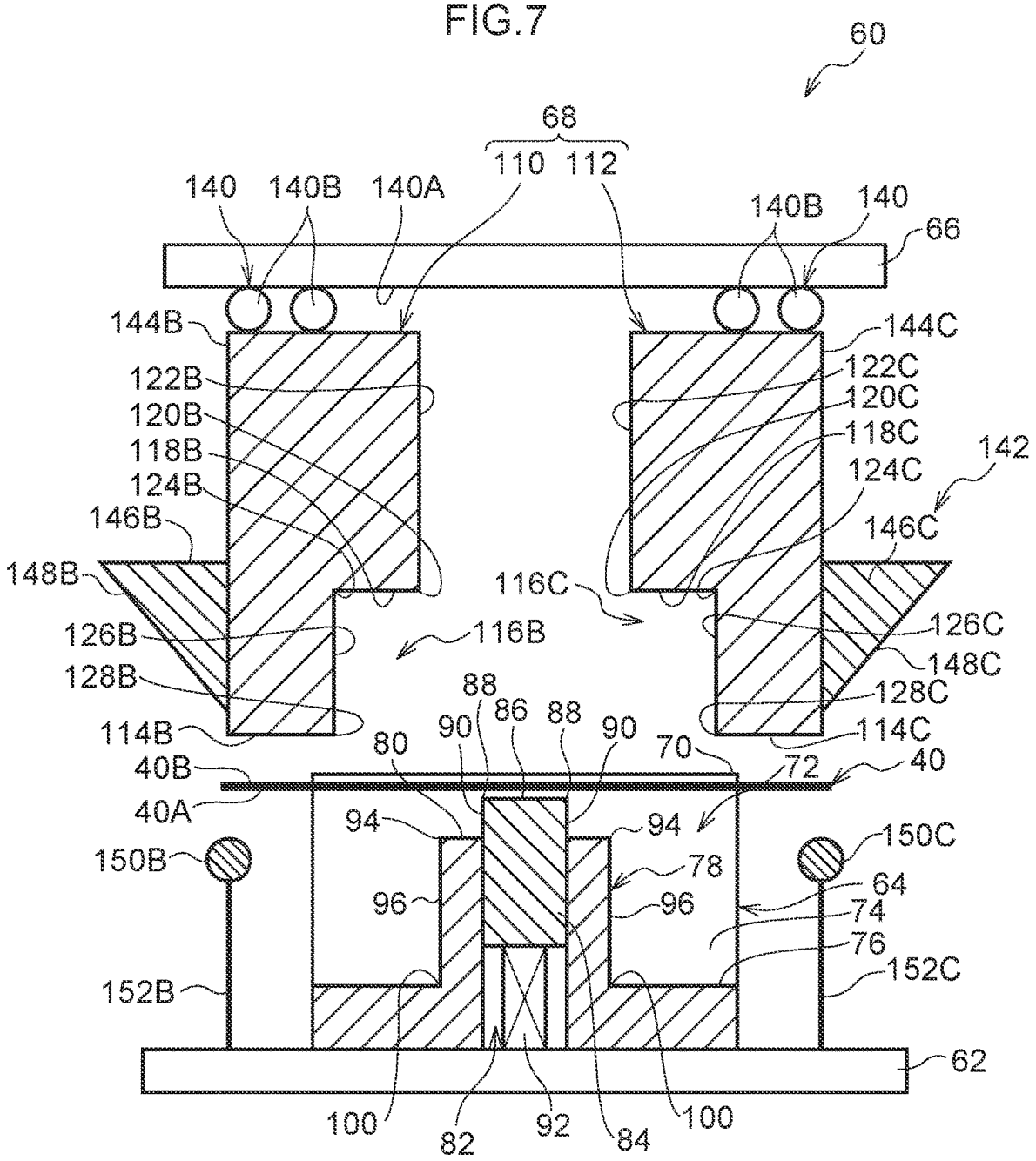
FIG. 7 is a cross-section sectioned along line C1-C1 in FIG. 6.

FIG. 5 to FIG. 7 are diagrams illustrating a pressing apparatus 60 according to the present exemplary embodiment.

The pressing apparatus 60 includes a punch 64 supported by a punch bed 62, and a die 68 supported by a die bed 66. As an example, the die 68 is disposed above the punch 64.

Punch

The punch 64 is formed in a laterally-extending rectangular block shape, and a punch-side recess 72 is formed in an upper face 70 of the punch 64. Wall faces of the punch-side recess 72 include punch rising faces 74 that slope toward the punch bed 62 side on progression from the two length direction end portions toward a central portion of the punch 64, and a punch bottom face 76 that is disposed between the two punch rising faces 74 so as to extend following the punch bed 62.

As illustrated in FIG. 6 and FIG. 7, a punch-side protrusion 78 that extends along the length direction is formed at a width direction central portion of the punch bottom face 76. As illustrated in FIG. 6, end portions of the punch-side protrusion 78 are connected to the punch rising faces 74.

A punch apex face 80 of the punch-side protrusion 78 is formed with a flat shape. As illustrated in FIG. 6 and FIG. 7, a punch-side pad housing portion 82 with a rectangular cross-section profile is formed at a width direction central portion and length direction central portion of the punch apex face 80.

A laterally-extending rectangular block shaped punch-side pad 84 is disposed inside the punch-side pad housing portion 82. A pad apex face 86 of the punch-side pad 84 faces outward from the punch 64 and is configured with a planar face. Pad protruding ridges 88 are formed at side edges of the pad apex face 86. Pad side-faces 90 extend from the pad protruding ridges 88 toward the punch bed 62.

A punch-side extension/retraction mechanism 92 is provided inside the punch-side pad housing portion 82. The punch-side extension/retraction mechanism 92 is disposed between the punch-side pad 84 and either the bottom of the punch-side pad housing portion 82 or the punch bed 62. The punch-side extension/retraction mechanism 92 may for example by configured by a coil spring or a damper.

Figure 17:
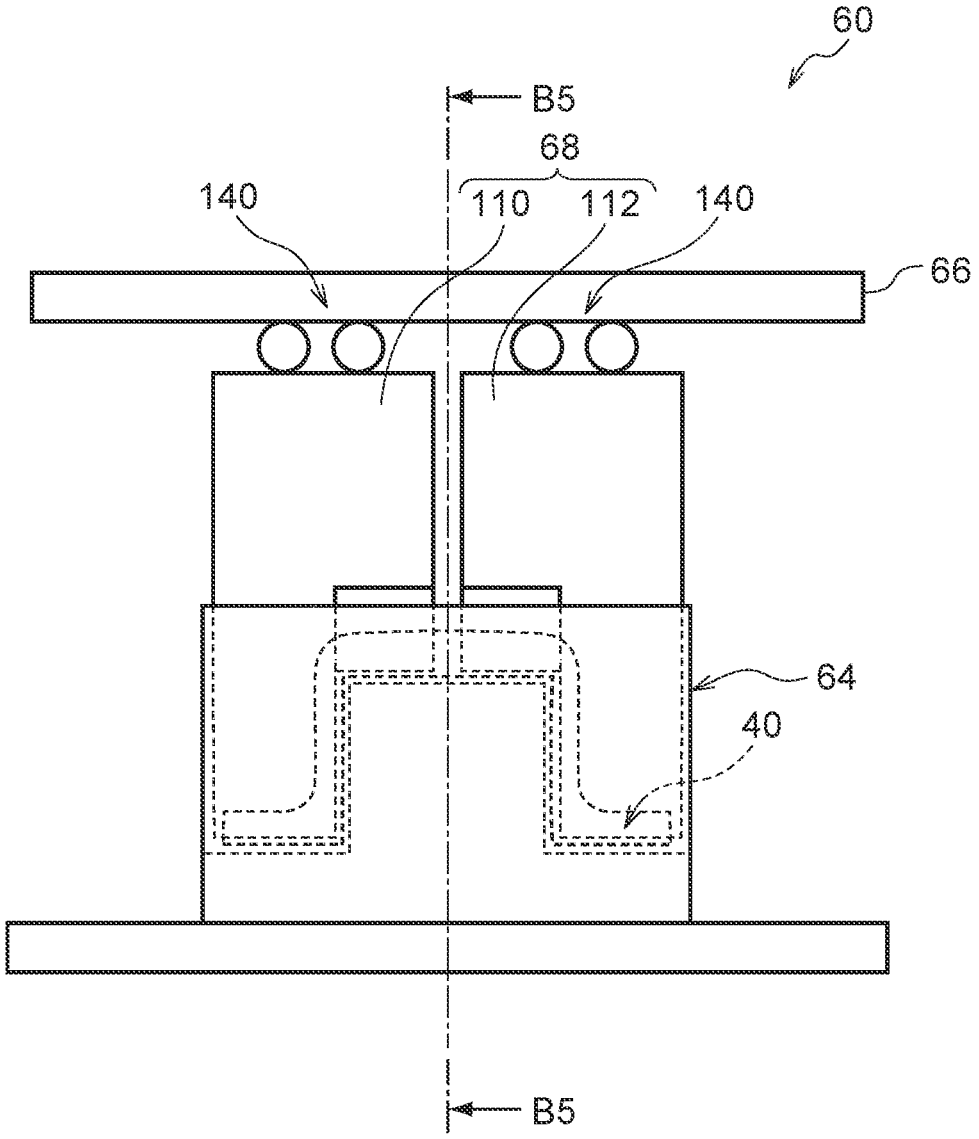
FIG. 17 is a front view of a pressing apparatus, illustrating a process following that illustrated in FIG. 14.
Figure 18:
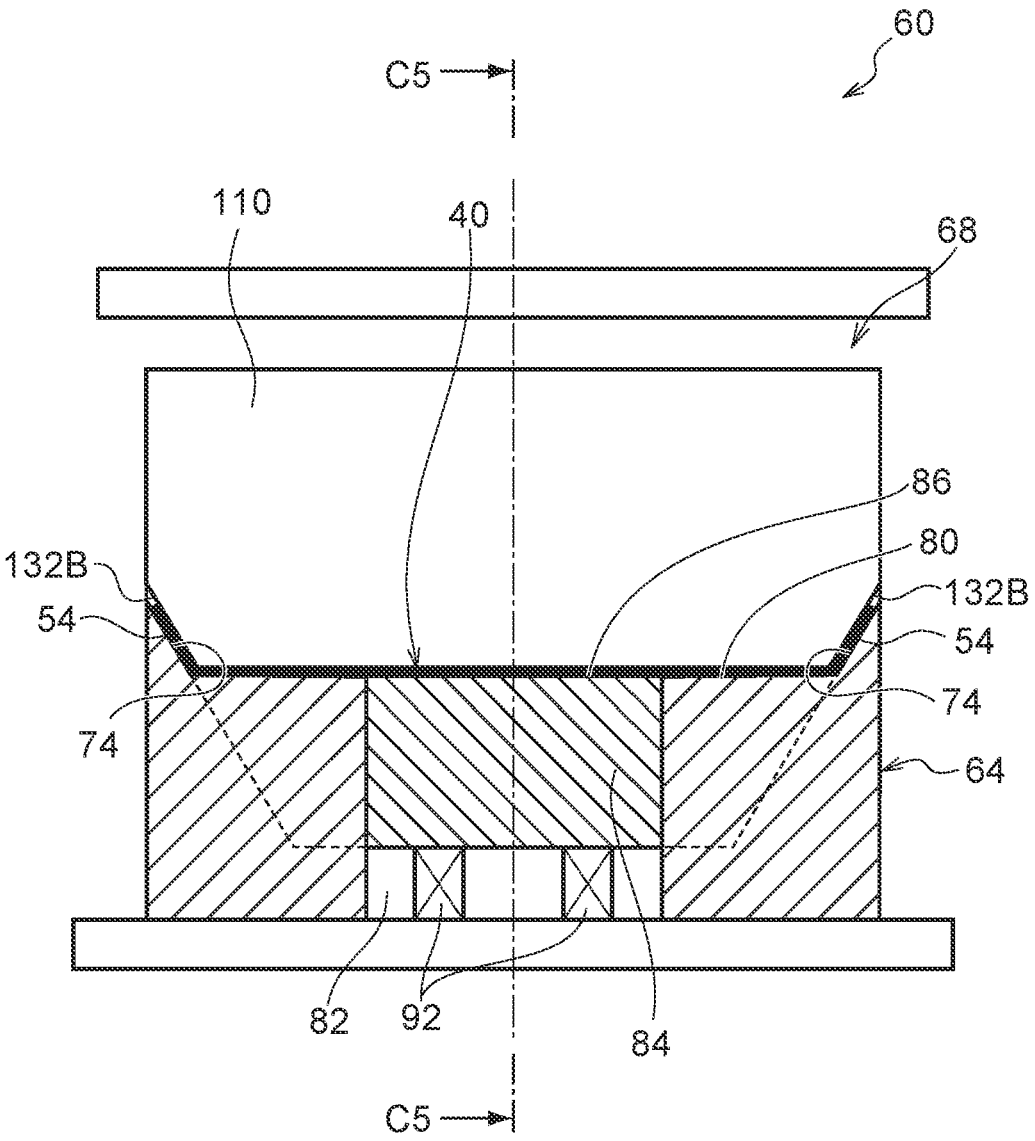
FIG. 18 is a cross-section sectioned along line B5-B5 in FIG. 17.
Figure 19:
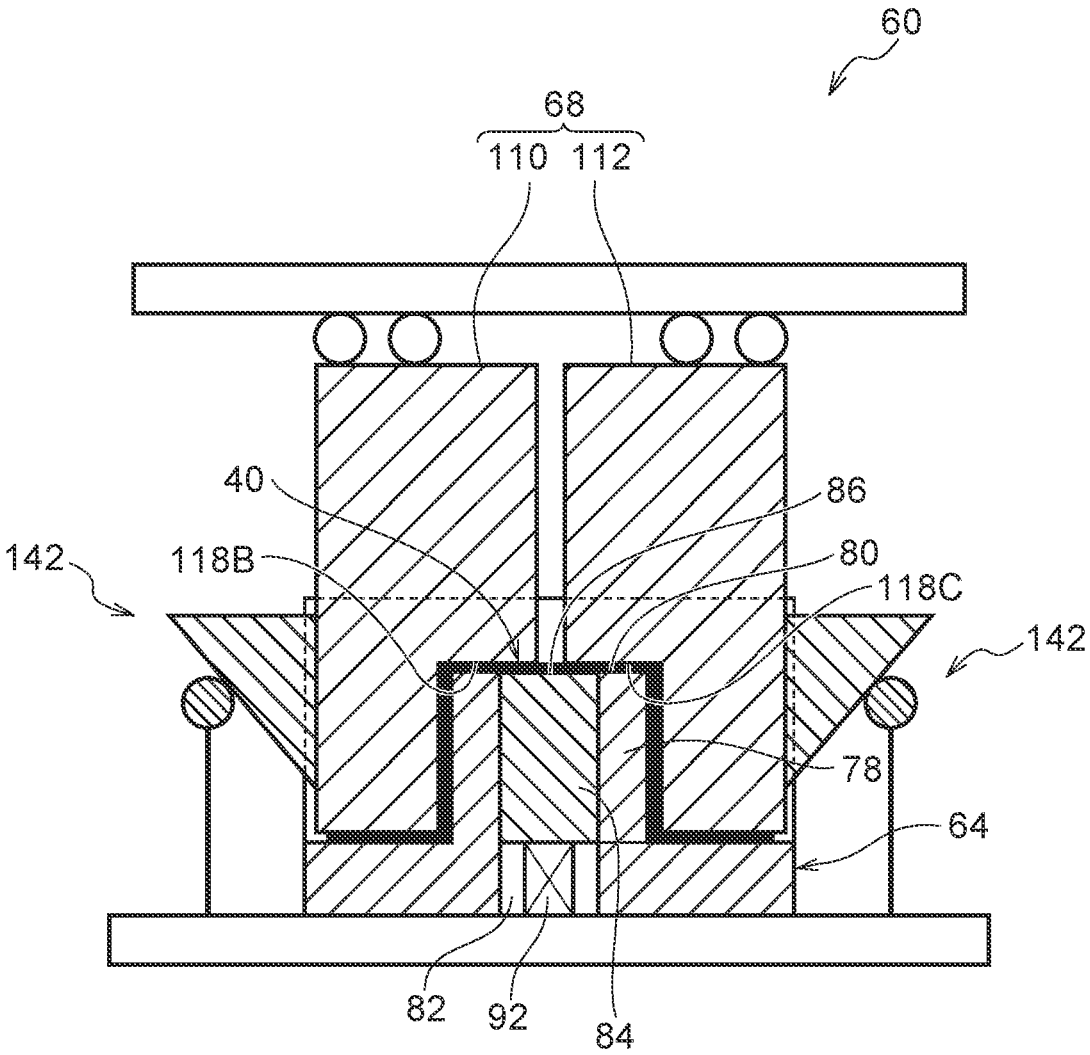
FIG. 19 is a cross-section sectioned along line C5-C5 in FIG. 18.

As illustrated in FIG. 6 and FIG. 7, the punch-side extension/retraction mechanism 92 biases the punch-side pad 84 toward the die 68 so as to create a state in which a leading end portion of the punch-side pad 84 projects out from the punch-side pad housing portion 82, and the pad apex face 86 projects further than the punch apex face 80 toward the die 68 side. As illustrated in FIG. 17 to FIG. 19, the punch-side extension/retraction mechanism 92 also creates a state in which the punch-side pad 84 is housed inside the punch-side pad housing portion 82, and the pad apex face 86 has retreated so as to lie in the same plane as the punch apex face 80 (see FIG. 18 and FIG. 19).

As illustrated in FIG. 5 to FIG. 7, although the present exemplary embodiment describes a case in which in which one of each of the punch-side pad housing portion 82 and the punch-side pad 84 are formed at the length direction central portion of the punch 64, there is no limitation thereto. For example, the punch-side pad housing portion 82 and the punch-side pad 84 may be provided at a length direction end portion of the punch 64, or may be split into plural components in the length direction of the punch 64.

As illustrated in FIG. 7, punch shoulders 94 are formed on both side portions of the punch apex face 80 of the punch-side protrusion 78. Namely, the punch shoulders 94 provided to the punch 64 adjoin the two side portions of the punch apex face 80. The punch shoulders 94 are configured by curved faces that curve gently away from the punch apex face 80 toward the punch bed 62.

Punch side-faces 96 extend from the respective punch shoulders 94 toward the punch bed 62. Namely, the punch side-faces 96 provided to the punch 64 adjoin the respective punch shoulders 94. The punch side-faces 96 are each formed with a flat profile. The two punch side-faces 96 slope away from each other on progression toward the punch bed 62, such that a draft angle is applied to the punch-side protrusion 78.

As illustrated in FIG. 6, punch end portion inverted ridges 98 are formed to the connection portions between the punch rising faces 74 of the punch-side recess 72 and end portions of the punch apex face 80, end portions of the punch shoulders 94, and end portions of the punch side-faces 96. Namely, the punch end portion inverted ridges 98 provided to the punch 64 adjoin the end portions of the punch apex face 80, the end portions of the punch shoulders 94, and the end portions of the punch side-faces 96. The punch 64 also includes the punch rising faces 74 adjoin the punch end portion inverted ridges 98.

Punch inverted ridges 100 are formed between the punch side-faces 96 and the punch bottom face 76. Each of the punch inverted ridges 100 is connected to the corresponding punch rising face 74 at both ends.

Die

The die 68 that is supported by the die bed 66 includes a first die segment 110 and a second die segment 112 forming a pair segmented in the width direction.

The first die segment 110 and the second die segment 112 are shaped symmetrically to one another. Locations configuring equivalent portions are suffixed with the letter B in the case of the first die segment 110 and the letter C in the case of the second die segment 112, and individual explanation thereof is omitted.

As illustrated in FIG. 6, the die segments 110, 112 (see FIG. 5) are each formed in a rectangular block shape with substantially the same length as the punch 64.

As illustrated in FIG. 7, respective die leading end faces 114B, 114C of the die segments 110, 112 are each formed with a cutout corner at an inner edge side thereof. Namely, cutouts 116B, 116C are formed at leading end portions of the respective die segments 110, 112. In other words, the die segments 110, 112 are each formed with an L-shaped lateral cross-section. Thus, as illustrated in FIG. 19, in a state in which inner faces of the two die segments 110, 112 have been brought close to each other, the punch-side protrusion 78 of the punch 64 can be disposed inside the cutouts 116B, 116C (see FIG. 7) of the two die segments 110, 112.

As illustrated in FIG. 5 to FIG. 7, die bottom faces 118B, 118C that form the die bed 66 sides of the cutouts 116B, 116C of the two die segments 110, 112 oppose the punch apex face 80. The die segments 110, 112 thereby include the die bottom faces 118B, 118C that oppose the punch apex face 80.

Inner side edges of the die bottom faces 118B, 118C form die inner shoulders 120B, 120C. Die base portion inner faces 122B, 122C are formed from the respective die inner shoulders 120B, 120C toward the die bed 66.

Die inverted ridges 124B, 124C with shapes corresponding to the punch shoulders 94 are formed at internal corners of the cutouts 116B, 116C of the die segments 110, 112, such that the die inverted ridges 124B, 124C provided to the die segments 110, 112 adjoin the die bottom faces 118B, 118C and oppose the respective punch shoulders 94.

Die inner faces 126B, 126C extend from the die inverted ridges 124B, 124C toward the punch 64, such that the die inner faces 126B, 126C provided to the die segments 110, 112 adjoin the die inverted ridges 124B, 124C and oppose the respective punch side-faces 96.

Die shoulders 128B, 128C that correspond to the punch inverted ridges 100 are formed at end portions of the respective die inner faces 126B, 126C, such that the die shoulders 128B, 128C provided to the die segments 110, 112 adjoin the die inner faces 126B, 126C.

As illustrated in FIG. 6, die end portion protruding ridges 130B, 130C (only one side is illustrated in FIG. 6) that correspond to the punch end portion inverted ridges 98 are formed at respective length direction end portions of the die bottom faces 118B, 118C. The die end portion protruding ridges 130B, 130C provided to the die segments 110, 112 thus adjoin the die bottom faces 118B, 118C, the die inverted ridges 124B, 124C, and the die inner faces 126B, 126C, and oppose the punch end portion inverted ridges 98.

Die rising faces 132B, 132C that correspond to the punch rising faces 74 extend from the respective die end portion protruding ridges 130B, 130C. The die rising faces 132B, 132C slope from the die end portion protruding ridges 130B, 130C and toward the die bed 66 on progression toward the end portion sides. The die rising faces 132B, 132C provided to the die segments 110, 112 thus adjoin the die end portion protruding ridges 130B, 130C and oppose the punch rising faces 74.

Press Mechanism

The die bed 66 that supports the die 68 is connected to a press mechanism, not illustrated in the drawings. As illustrated in FIG. 17 to FIG. 19, the press mechanism moves the die 68 toward the punch 64 so as to move the die 68 closer to the punch 64 until reaching bottom dead center. As illustrated in FIG. 5 to FIG. 7, the press mechanism also moves the die 68 with respect to the punch 64 so as to move the die 68 away from the punch 64 until reaching reach top dead center.

Although an example is given in which the press mechanism moves the die 68 with respect to the punch 64 in the present exemplary embodiment, there is no limitation thereto. It is sufficient that the die 68 and the punch 64 are capable of relative movement in directions toward and away from each other, and so for example a press mechanism that moves the punch 64 with respect to the die 68, or a press mechanism that moves both the die 68 and the punch 64, may be applied.

Slide Mechanism

The first die segment 110 and the second die segment 112 are supported by the die bed 66 through a slide mechanism 140. The slide mechanism 140 is capable of sliding along the die bed 66 in a direction in which the first die segment 110 and the second die segment 112 mutually approach each other, and in a direction in which the first die segment 110 and the second die segment 112 move away from each other.

As an example, the slide mechanism 140 may be configured by a slide rail 140A formed to the die bed 66, and rollers 140B that are provided to the first die segment 110 and the second die segment 112 and that roll along the slide rail 140A.

Drive Source

The pressing apparatus 60 includes a drive source 142 that slides the first die segment 110 and the second die segment 112 in directions mutually approaching or away from each other. The drive source 142 is configured by a cam mechanism.

Specifically, triangular column shaped cams 146B, 146C are provided at outer side-faces 144B, 144C of the die segments 110, 112, and slanted faces positioned on the punch 64 side of the respective cams 146B, 146C configure cam faces 148B, 148C. Circular column shaped cam followers 150B, 150C are provided to the punch bed 62 through support portions 152B, 152C at locations corresponding to the respective cams 146B, 146C.

Figure 13:
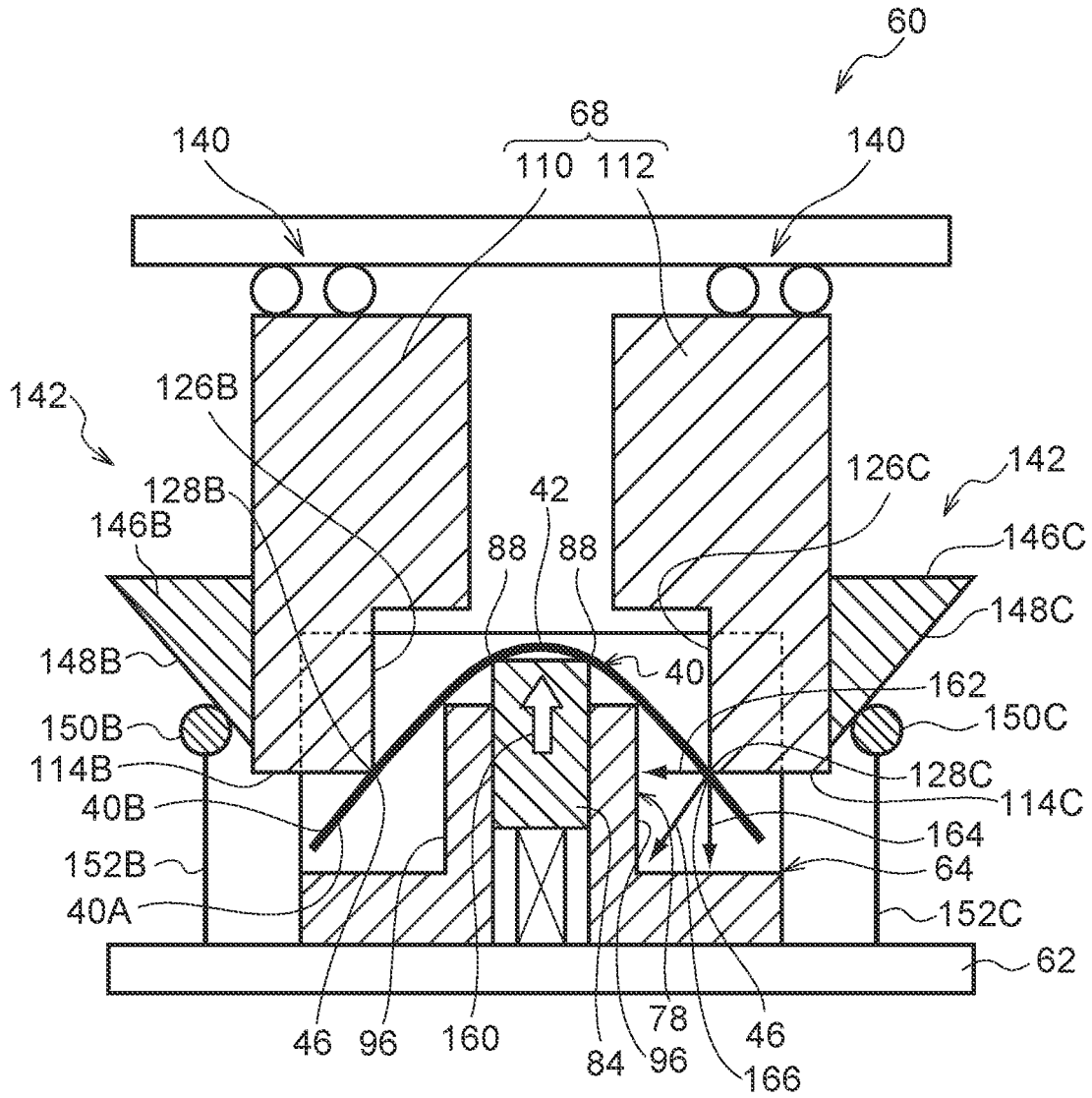
FIG. 13 is a cross-section sectioned along line C3-C3 in FIG. 12.

The height of the cam followers 150B, 150C is set such that die 68 side locations of peripheral faces of the cam followers 150B, 150C are disposed so as to be aligned with the height position of the punch apex face 80 of the punch-side protrusion 78. Thus, as illustrated in FIG. 13, as the die 68 is moved toward the punch 64, the first die segment 110 and the second die segment 112 are moved in mutually approaching directions from the point in time at which the cam faces 148B, 148C contact the peripheral faces of the cam followers 150B, 150C.

Setting is made such that a state in which the die leading end faces 114B, 114C moving toward the punch bed 62 have passed the punch apex face 80 is achieved by the start timing of this mutually approaching movement. In the present exemplary embodiment, the mutually approaching movement of the two die segments 110, 112 starts when the die leading end faces 114B, 114C have reached height positions corresponding to half the height of the punch-side protrusion 78.

Manufacturing Method

Explanation follows regarding a manufacturing method to manufacture the saddle-shaped press-molded article 10.

Supporting Process

As illustrated in FIG. 5 to FIG. 7, in manufacture of the saddle-shaped press-molded article 10, the length direction of the blank 40 is aligned with the length direction of the punch 64 in a state in which the punch-side pad 84 of the punch 64 projects out beyond the punch apex face 80. An inner face 40A of the blank 40 is supported by at least one out of the pad apex face 86 or the punch rising faces 74 (supporting process).

Note that a state in which the end portions of the blank 40 are supported by the punch rising faces 74 is illustrated as an example in the present exemplary embodiment.

First Pressing Process

Figure 8:
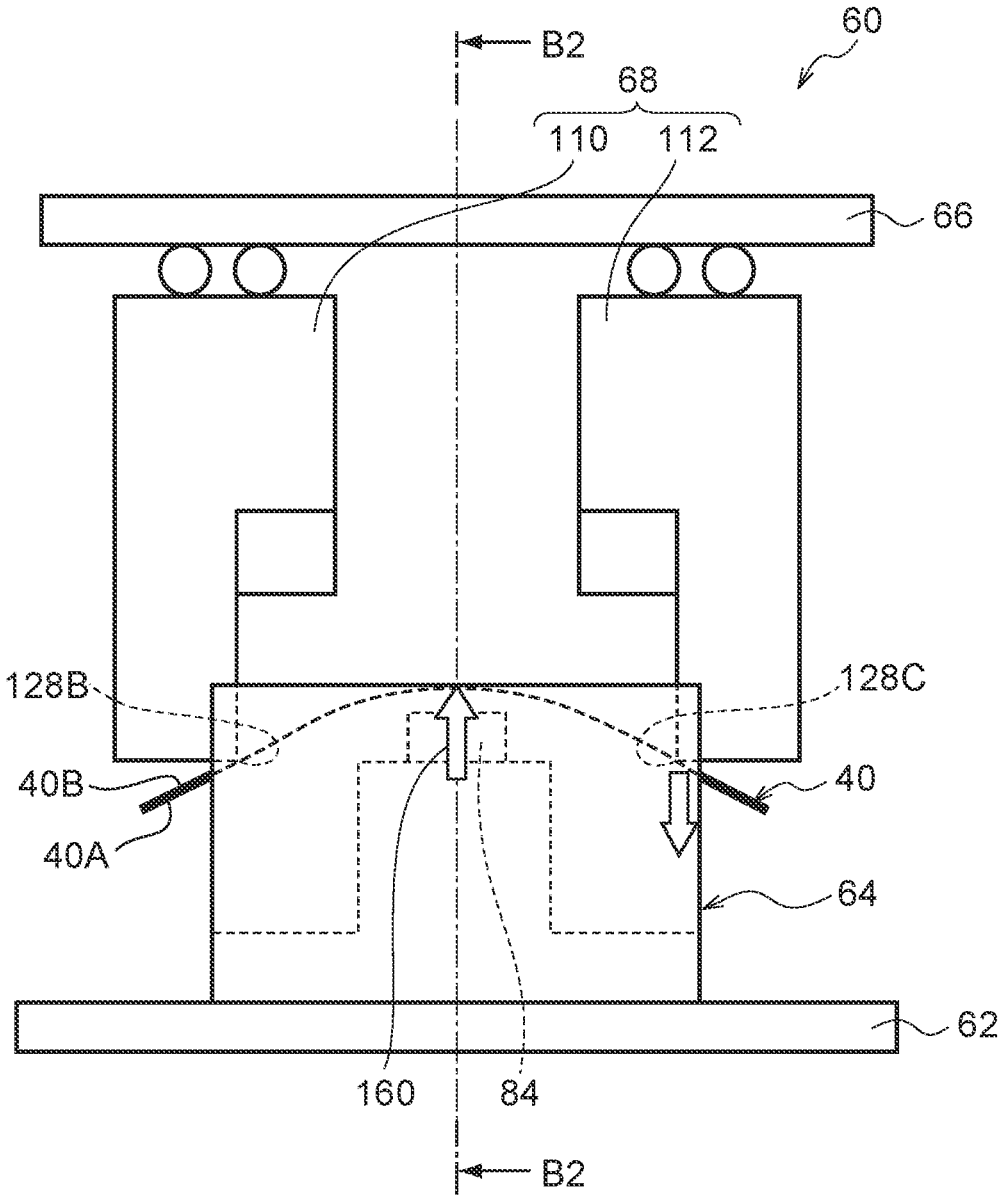
FIG. 8 is a front view of a pressing apparatus, illustrating a process following that illustrated in FIG. 5.
Figure 9:
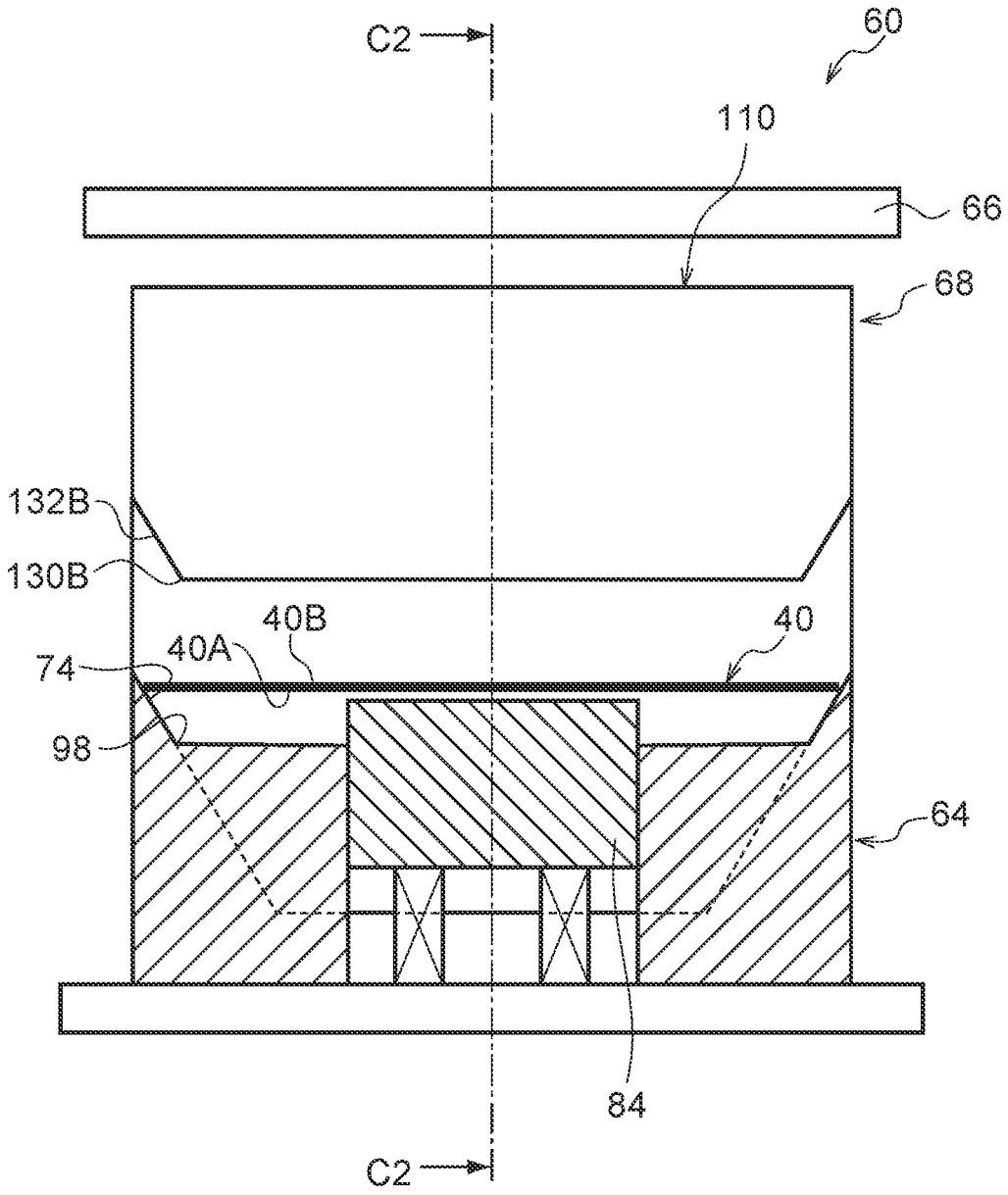
FIG. 9 is a cross-section sectioned along line B2-B2 in FIG. 8.
Figure 10:
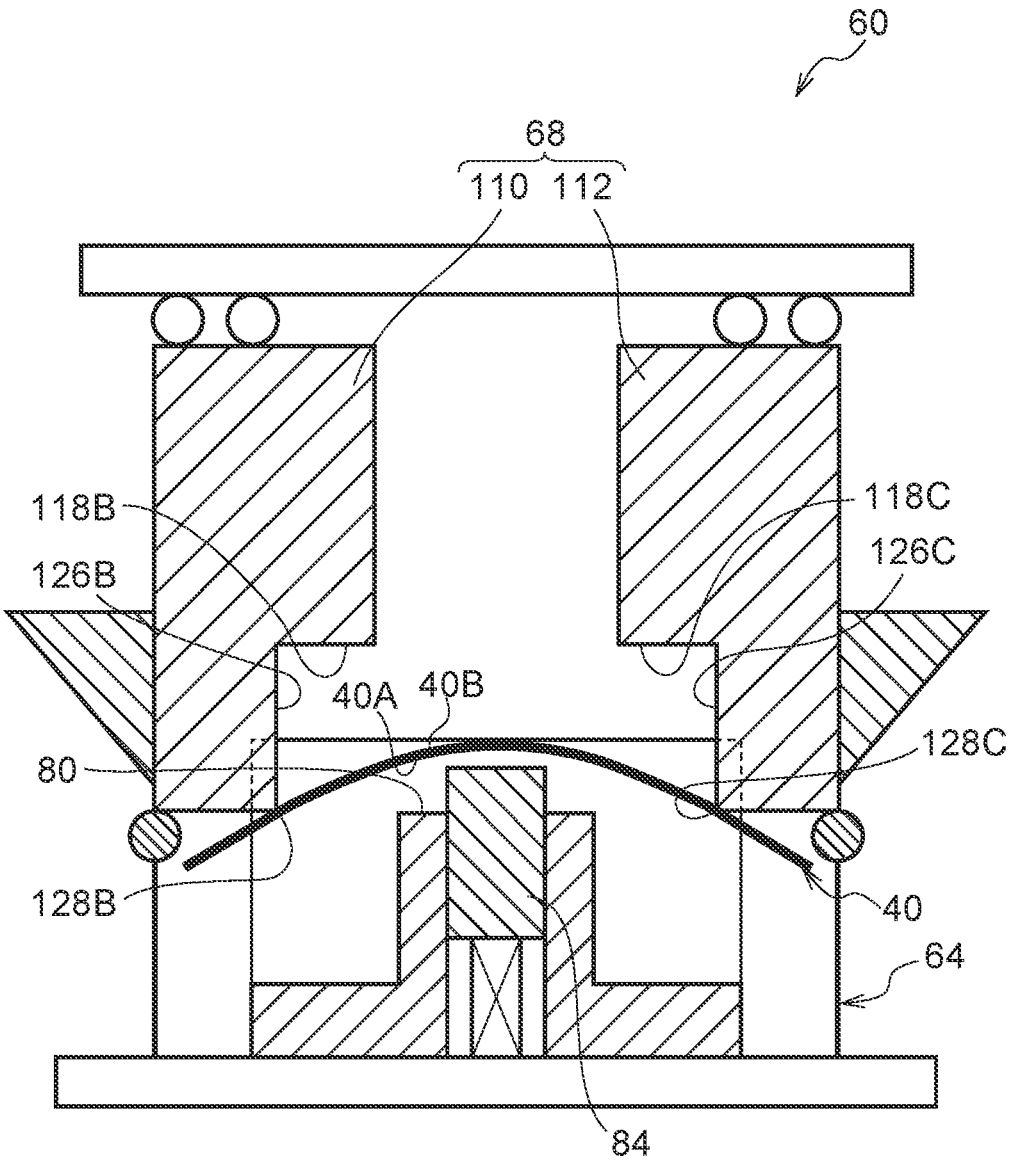
FIG. 10 is a cross-section sectioned along line C2-C2 in FIG. 9.

As illustrated in FIG. 8 to FIG. 10, the die 68 supported by the die bed 66 is then moved toward the punch 64 by the non-illustrated press mechanism. Locations of the blank 40 beyond the two outer sides of the punch apex face 80 are thereby pushed toward the punch 64 by the die shoulders 128B, 128C.

In this manner, the pad apex face 86 or the punch rising faces 74 apply a first force 160 acting from the inner face 40A side toward an outer face 40B side of the blank 40 to the top plate configuration location 42 of the blank 40 that will be molded into the top plate portion 14, such that the blank 40 curls. This application of the first force 160 continues even after the blank 40 has curled.

As an example, in the present exemplary embodiment a case is described in which the first force 160 is applied from the punch rising faces 74.

When the die shoulders 128B, 128C hit the blank 40, the die shoulders 128B, 128C apply force (a third force, described later) to the blank 40 in the same force application direction as a direction normal to the top plate configuration location 42, such that the first force 160 applied to the blank 40 from the punch rising faces 74 and the force (third force) applied to the blank 40 by the two die shoulders 128B, 128C act in opposing directions to each other. Unintended misalignment of the blank 40 when the die shoulders 128B, 128C contact the blank 40 is thus suppressed compared to cases in which the first force 160 applied from the punch rising faces 74 and the force (third force) applied from the two die shoulders 128B, 128C act in mutually intersecting directions.

Second Pressing Process

Figure 11:
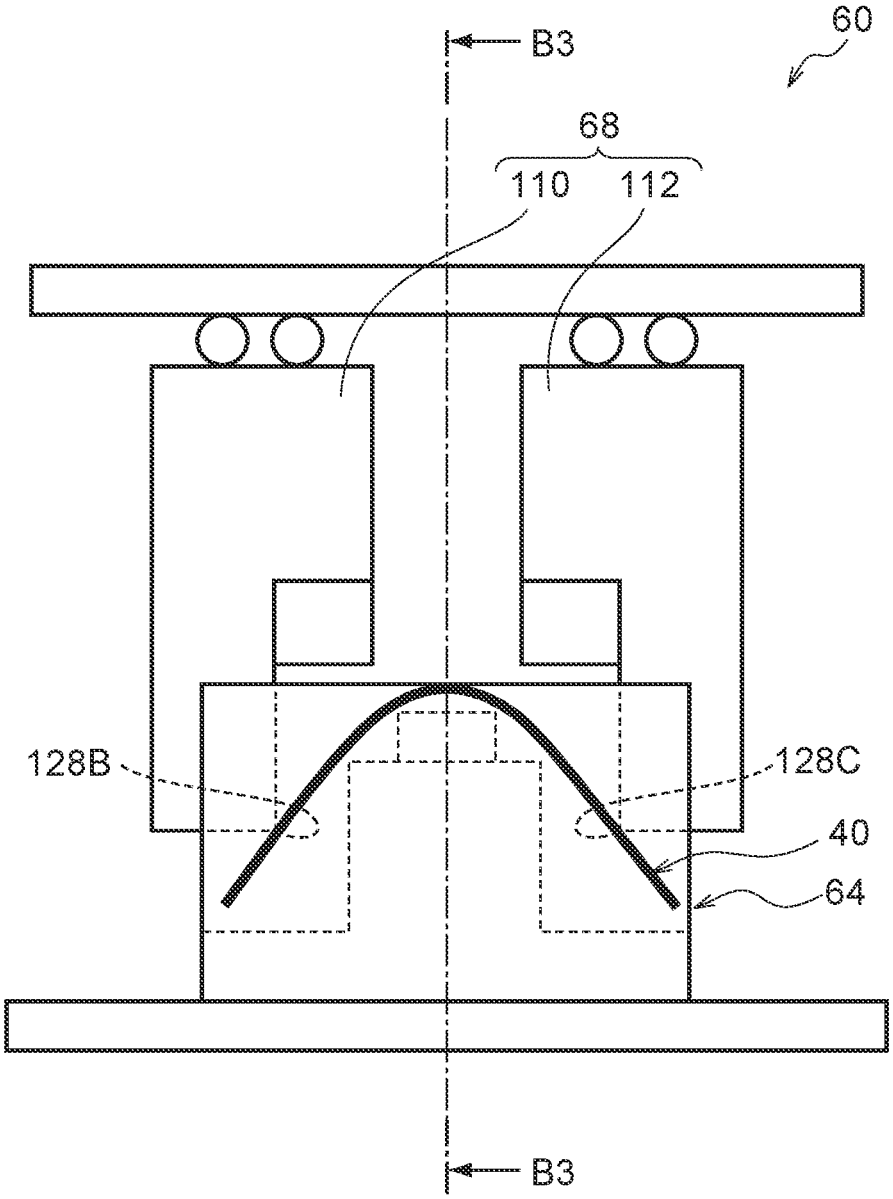
FIG. 11 is a front view of a pressing apparatus, illustrating a process following that illustrated in FIG. 8.
Figure 12:
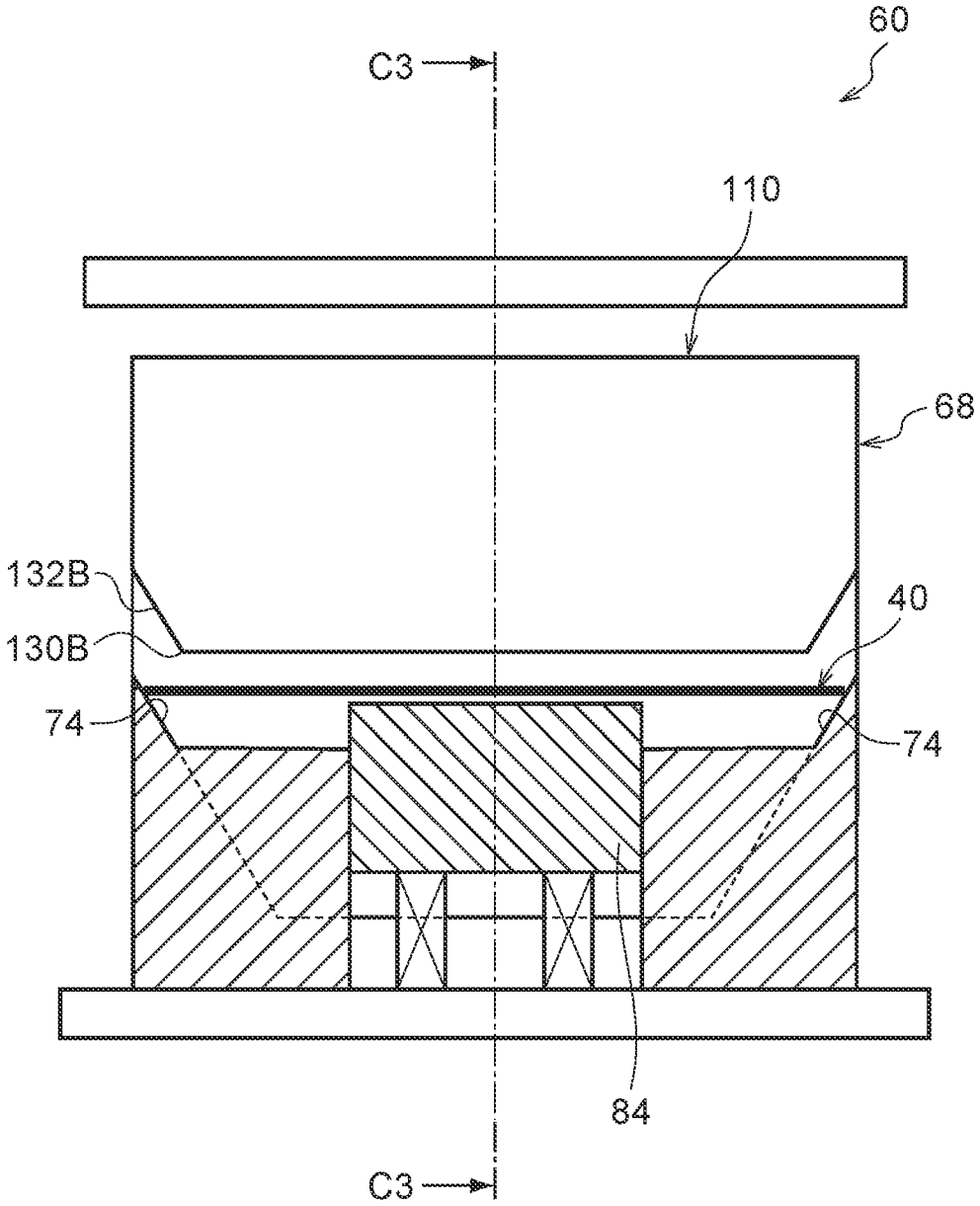
FIG. 12 is a cross-section sectioned along line B3-B3 in FIG. 11.

Next, as illustrated in FIG. 11 to FIG. 13, the die 68 is moved further toward the punch 64 by the non-illustrated press mechanism. The cam faces 148B, 148C of the cams 146B, 146C provided to the first die segment 110 and the second die segment 112 hit the cam followers 150B, 150C as a result, causing the first die segment 110 and the second die segment 112 to move in mutually approaching directions as well as to move toward the punch 64 (thereby configuring a pushing process including the first pressing process and the second pressing process).

As illustrated in FIG. 13, when this occurs, the first force 160 acting from the inner face 40A side toward the outer face 40B side is continually applied from the punch rising faces 74 to the two end portions of the top plate configuration location 42 of the blank 40. The first force 160 acting from the inner face 40A side toward the outer face 40B side is also applied from the pad protruding ridges 88 of the punch-side pad 84 to a length direction central portion of the blank 40 that is abutted by the pad protruding ridges 88 of the punch-side pad 84.

Second forces 162 acting in mutually facing directions are applied to the two vertical wall configuration locations 46 of the blank 40 that will be molded into the vertical wall portions 20 by the die shoulders 128B, 128C of the first die segment 110 and the second die segment 112 as they are moved in mutually approaching directions by the drive source 124. Moreover, a third force 164 acting in an opposing direction to the first force 160 is applied to the outer face 40B side of the two vertical wall configuration locations 46 of the blank 40 that will be molded into the vertical wall portions 20 by the die shoulders 128B, 128C of the first die segment 110 and the second die segment 112 that are being moved toward the punch 64.

Thus, net force 166 resulting from the second force 162 and the third force 164 is applied from an oblique direction to each of the two vertical wall configuration locations 46 of the blank 40 contacted by the die shoulders 128B, 128C of the two die segments 110, 112. The top plate configuration location 42 at the central portion of the blank thereby curls so as to project toward the die 68. At least the length direction end portions of the blank 40 are placed in a non-contact state as a result.

When this occurs, although parts of the die inner faces 126B, 126C of the respective die segments 110, 112 oppose parts of the punch side-faces 96 of the punch 64, the die inner faces 126B, 126C of the respective die segments 110, 112 are sufficiently separated from the punch side-faces 96 of the punch 64.

Thus, the blank 40 that is contacted by the respective die segments 110, 112 is able to escape toward the punch side-faces 96. This enables dragging of the blank 40 toward the punch bed 62 by the die inner faces 126B, 126C of the respective die segments 110, 112 as they move toward the punch bed 62 to be suppressed. This enables the curled state of the central portion of the blank toward the die 68 to be maintained.

Housing Process

Figure 14:
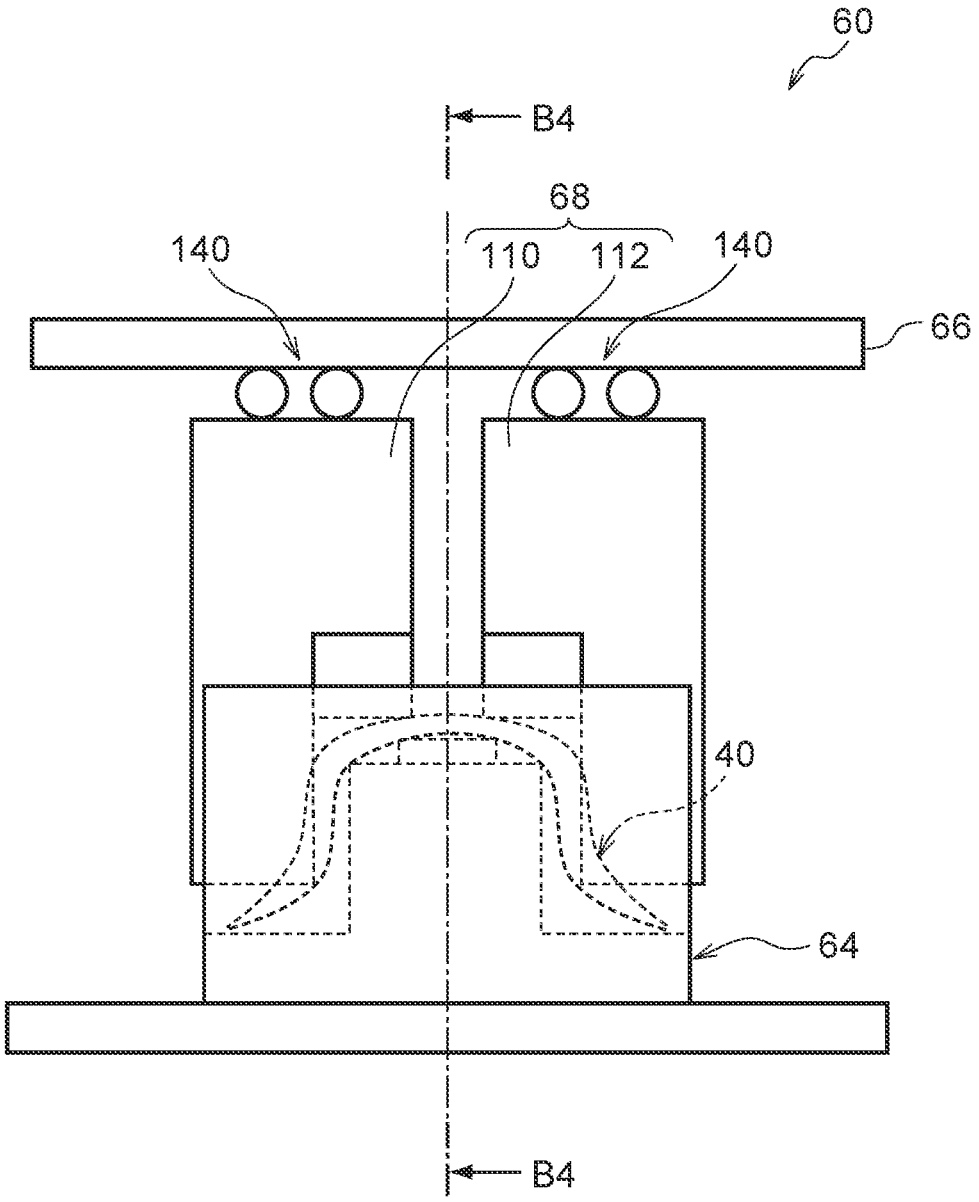
FIG. 14 is a front view of a pressing apparatus, illustrating a process following that illustrated in FIG. 11.
Figure 15:
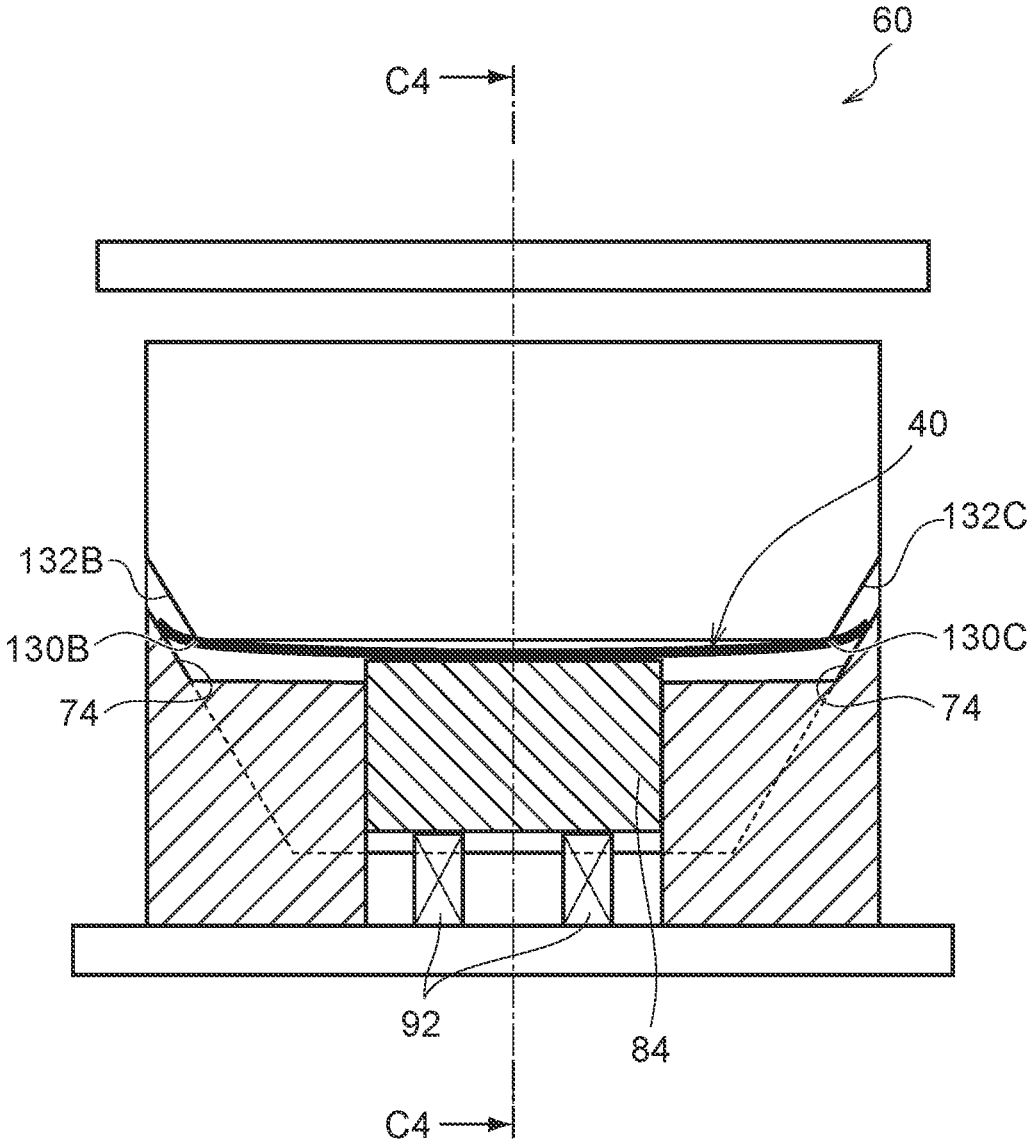
FIG. 15 is a cross-section sectioned along line B4-B4 in FIG. 14.
Figure 16:
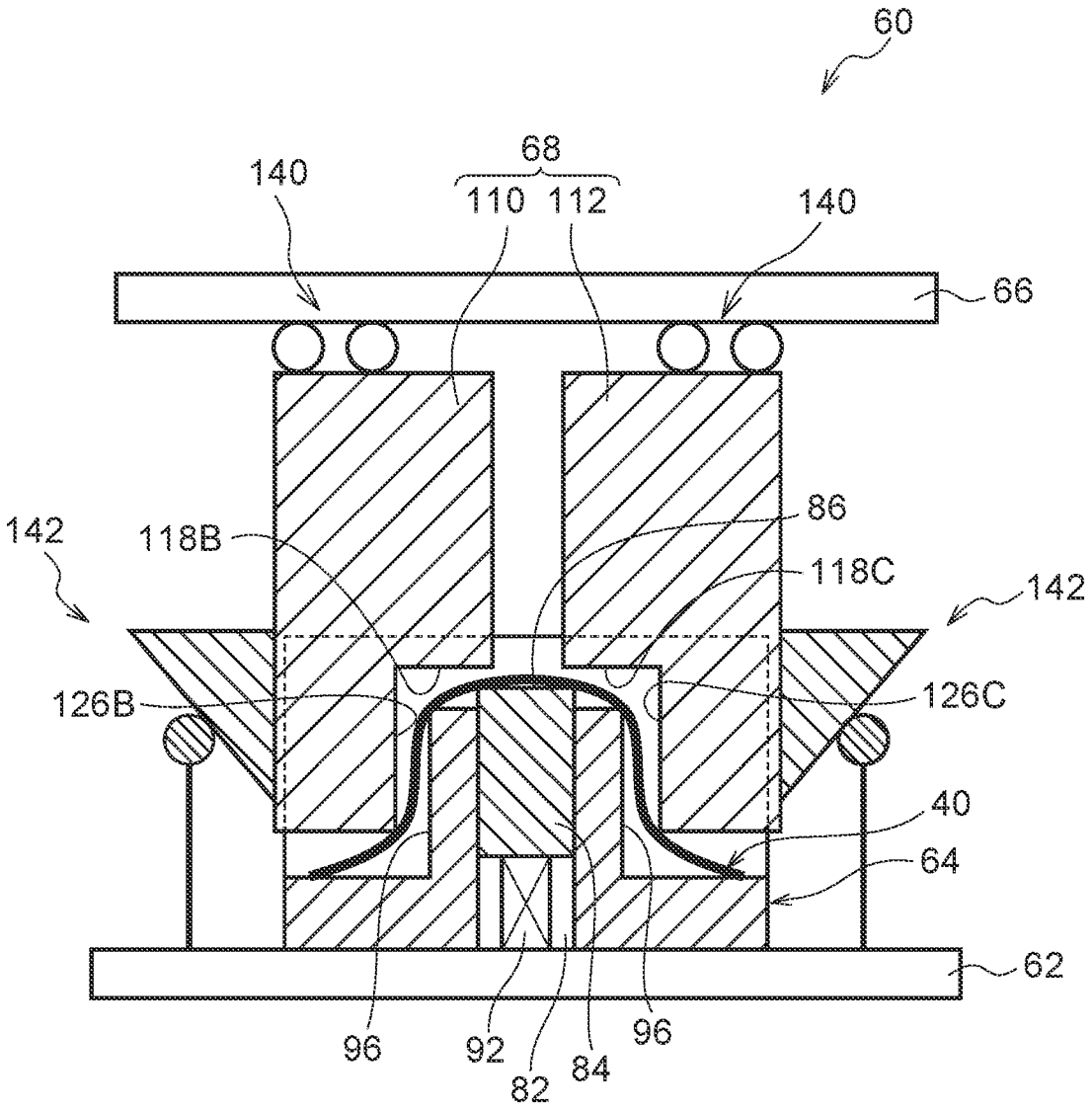
FIG. 16 is a cross-section sectioned along line C4-C4 in FIG. 15.

As illustrated in FIG. 14 to FIG. 16, the die 68 is then moved further toward the punch 64 by the non-illustrated press mechanism. When this is performed, the die bottom faces 118B, 118C of the first die segment 110 and the second die segment 112 are positioned above the punch-side pad 84, such that the die bottom faces 118B, 118C push the pad apex face 86 of the punch-side pad 84 toward the punch bed 62 through the blank 40. The punch-side pad 84 is thereby housed inside the punch-side pad housing portion 82 while the blank 40 is gripped between the punch-side pad 84 and the die bottom faces 118B, 118C (housing process).

At the same time, the end portion flange configuration locations 54 of the blank 40 are raised up along the punch rising faces 74.

As illustrated in FIG. 1, in the saddle-shaped press-molded article 10, the amount of deformation, in other words the amount of distortion at corner portions 30B of the end portion flanges 30 corresponding to the end portions of the protruding ridge portions 18 is dependent upon a curvature R of the protruding ridge portions 18 and an extension length of the end portion flanges 30.

The following process is required in order to suppress the amount of deformation and suppress the occurrence of cracking at the corner portions 30B. First, prior to starting to mold the corner portions 30B, the top plate configuration location 42 that will become the top plate portion 14 is flexed so as to have a greater line length than the top plate portion 14. Second, the flexed portion is then squashed during the course of molding, such that the line length of the flexed portion approaches the linear length of the top plate portion 14. Applying these processes during molding is an effective way to suppress the amount of deformation and suppress the occurrence of cracking at the corner portions 30B.

As illustrated in FIG. 14 to FIG. 16, in the housing process, the central portion of the blank 40 that has curled toward the die 68 is pushed until flat by the die bottom faces 118B, 118C of the first die segment 110 and the second die segment 112. The curled portion of the blank 40 therefore becomes surplus material, which is channeled into the end portion flange configuration locations 54 that will become the end portion flanges 30 through the end portion inverted ridge configuration locations 52 that will be molded into the end portion inverted ridge portions 26.

During this process, the corner portions 30B of the end portion flanges 30 corresponding to the end portions of the protruding ridge portions 18 are stretched in directions running along the top plate portion 14 and directions running along the vertical wall portions 20. The corner portions 30B thereby undergo a greater amount of stretching than other locations and are thus susceptible to thinning.

This issue is addressed by the surplus material that was channeled into the end portion flange configuration locations 54 being channeled into the corner portions 30B during the housing process, thereby enabling the material that might otherwise run short during stretching to be supplemented and any reduction in thickness to be suppressed.

In this state, the die inner faces 126B, 126C of the respective die segments 110, 112 and the punch side-faces 96 of the punch 64 are sufficiently separated from each other. This enables dragging of the blank 40 toward the punch bed 62 by the die inner faces 126B, 126C of the respective die segments 110, 112 to be suppressed.

This enables the above-described flexing to be maintained, while also enabling any impediment to the channeling of surplus material toward the end portion flange configuration locations 54 to be suppressed.

Clamping Process

As illustrated in FIG. 17 to FIG. 19, the die 68 is moved further toward the punch 64 by the non-illustrated press mechanism, moving the die 68 such that the die 68 moves closer to the punch 64 until reaching bottom dead center. The blank 40 is thereby clamped by a combination of the punch apex face 80 and the die bottom faces 118B, 118C, the punch side-faces 96 and the die inner faces 126B, 126C, and the punch rising faces 74 and the die rising faces 132B, 132C (clamping process).

The end portion inverted ridge configuration locations 52 that will become the end portion inverted ridge portions 26, the top plate configuration location 42 that will become the top plate portion 14, the vertical wall configuration locations 46 that will become the vertical wall portions 20, the end portion flange configuration locations 54 that will become the end portion flanges 30, and the lower flange configuration locations 50 that will become the lower flanges 24 are thereby restrained.

The lower inverted ridge configuration locations 48 for molding into the lower inverted ridge portions 22 complete molding into the lower inverted ridge portions 22 at the same time as the end portion inverted ridge portions 26 complete molding.

The blank 40 is transformed into the saddle-shaped press-molded article 10 in this manner.

Operation and Advantageous Effects

Next, explanation follows regarding operation and advantageous effects of the present exemplary embodiment.

When the blank 40 is being pressed, the first force 160 acting from the inner face 40A side toward the outer face 40B side is applied to the top plate configuration location 42 of the blank 40 that will be molded into the top plate portion 14 of the saddle-shaped press-molded article 10. At the same time, the net forces 166, configured of the second forces 162 acting in mutually facing directions and the third force 164 acting in an opposing direction to the first force 160, are applied to the outer face 40B of the blank 40 at the vertical wall configuration locations 46 that will be molded into the vertical wall portions 20. The blank 40 thereby flexes and curls such that the outer face 40B projects out at the top plate configuration location 42.

In this curled state of the top plate configuration location 42, the saddle-shaped press-molded article 10 is molded while restraining the end portion inverted ridge configuration locations 52 that will be molded into the end portion inverted ridge portions 26, the top plate configuration location 42, the vertical wall configuration locations 46, and the end portion flange configuration locations 54 that will be molded into the end portion flanges 30.

During this press molding, the pressed blank 40 curls such that the top plate configuration location 42 projects outward, and the third force 164 does not act on the vertical wall configuration locations 46 until the vertical wall configuration locations 46 are restrained by the second forces 162. Thus, the third force 164 acting in an opposing direction to the first force 160 does not pull the vertical wall configuration locations 46 in the opposing direction to the first force 160, and the state in which the top plate configuration location 42 curls so as to project outward is maintained.

When the top plate configuration location 42 is then pressed by the first force 160, the portion of the top plate configuration location 42 curling outward is flattened, resulting in surplus material. This surplus material is channeled into the end portion flange configuration locations 54 that will become the end portion flanges 30 through the end portion inverted ridge configuration locations 52 that will be molded into the end portion inverted ridge portions 26.

Note that the end portion flanges 30 stand out from the top plate portion 14 and the vertical wall portions 20, and that the corner portions 30B of the end portion flanges 30 positioned at the end portions of the protruding ridge portions 18 adjoining the two side portions of the top plate portion 14 undergo a large amount of stretching and are thus susceptible to thinning.

In the present exemplary embodiment, the surplus material that has been channeled into the end portion flange configuration locations 54 is channeled into the corner portions 30B of the end portion flanges 30, thereby enabling the material that might otherwise run short during stretching to be supplemented and any reduction in thickness to be suppressed. This enables the occurrence of cracking and the like to be suppressed, even in cases in which the end portion flanges 30 have a large extension length.

This enables the extension length of the end portion flanges 30 formed at the end portions to be increased.

Furthermore, the strength at the corner portions 30B can be increased compared to when a manufacturing method is applied in which the corner portions 30B of the end portion flange 30 are notched as far as the protruding ridge portions 18 in order to prevent cracking.

Moreover, molding of the lower inverted ridge portions 22 from the lower inverted ridge configuration locations 48 for molding into the lower inverted ridge portions 22 is completed at the same time as molding of the end portion inverted ridge portions 26.

This enables the lower flanges 24 and the end portion flanges 30 to be molded at the same time, in contrast to cases in which a timing at which the lower flanges 24 at the outer sides of the lower inverted ridge portions 22 are molded differs from a timing at which the end portion flanges 30 at the outer sides of the end portion inverted ridge portions 26 are molded. This enables give and take of material at connection portions between the end portion flange configuration locations 54 that will become the end portion flanges 30 and the lower flange configuration locations 50 that will become the lower flanges 24 to be suppressed during the molding process.

The application direction of the third force 164 is the same direction as a direction normal to the top plate configuration location 42.

Thus, the first force 160 applied to the blank 40 from the punch rising faces 74 and the third force 164 applied to the blank 40 by the two die shoulders 128B, 128C act in opposing directions to each other. This enables misalignment of the blank 40 when the die shoulders 128B, 128C contact the blank 40 to be suppressed compared to cases in which the first force 160 from the punch rising faces 74 and the third force 164 from the two die shoulders 128B, 128C are applied in mutually intersecting directions.

Employing the pressing apparatus 60 described above enables the manufacturing method according to the present exemplary embodiment to be implemented, and this manufacturing method enables the method to manufacture the saddle-shaped press-molded article 10 according to the present exemplary embodiment to be implemented.

Although the drive source 142 that slides the first die segment 110 and the second die segment 112 in mutually approaching directions is configured by a cam mechanism in the present exemplary embodiment, there is no limitation thereto.

For example, the drive source 142 may be configured by providing an actuator to move the punch 64 and the die 68 in mutually approaching directions, and an actuator to move the first die segment 110 and the second die segment 112 in mutually approaching directions. Such actuators may configured by hydraulic cylinders or the like.

Alternatively, the drive source 142 may be configured by a cam mechanism mold that moves the first die segment 110 and the second die segment 112 in oblique directions.

Alternatively, a method to lift up the top plate configuration location 42 from the inner side, or a method to draw the top plate configuration location 42 upward using an electromagnet, may be adopted as a method to cause the top plate configuration location 42 of the blank 40 to curl so as to project outward.

Furthermore, the above-described drive sources 142 and the above-described methods to curl the blank 40 may be combined to even greater effect.

Second Exemplary Embodiment

FIG. 20 to FIG. 34 are diagrams illustrating a second exemplary embodiment. Configurations similar or equivalent to those in the first exemplary embodiment are allocated the same reference numerals, and explanation thereof is omitted. The following explanation concerns only portions that differ.

Pressing Apparatus

In a pressing apparatus 170 according to the present exemplary embodiment, the structure of the die 68 differs from that of the first exemplary embodiment.

Die

Figure 20:
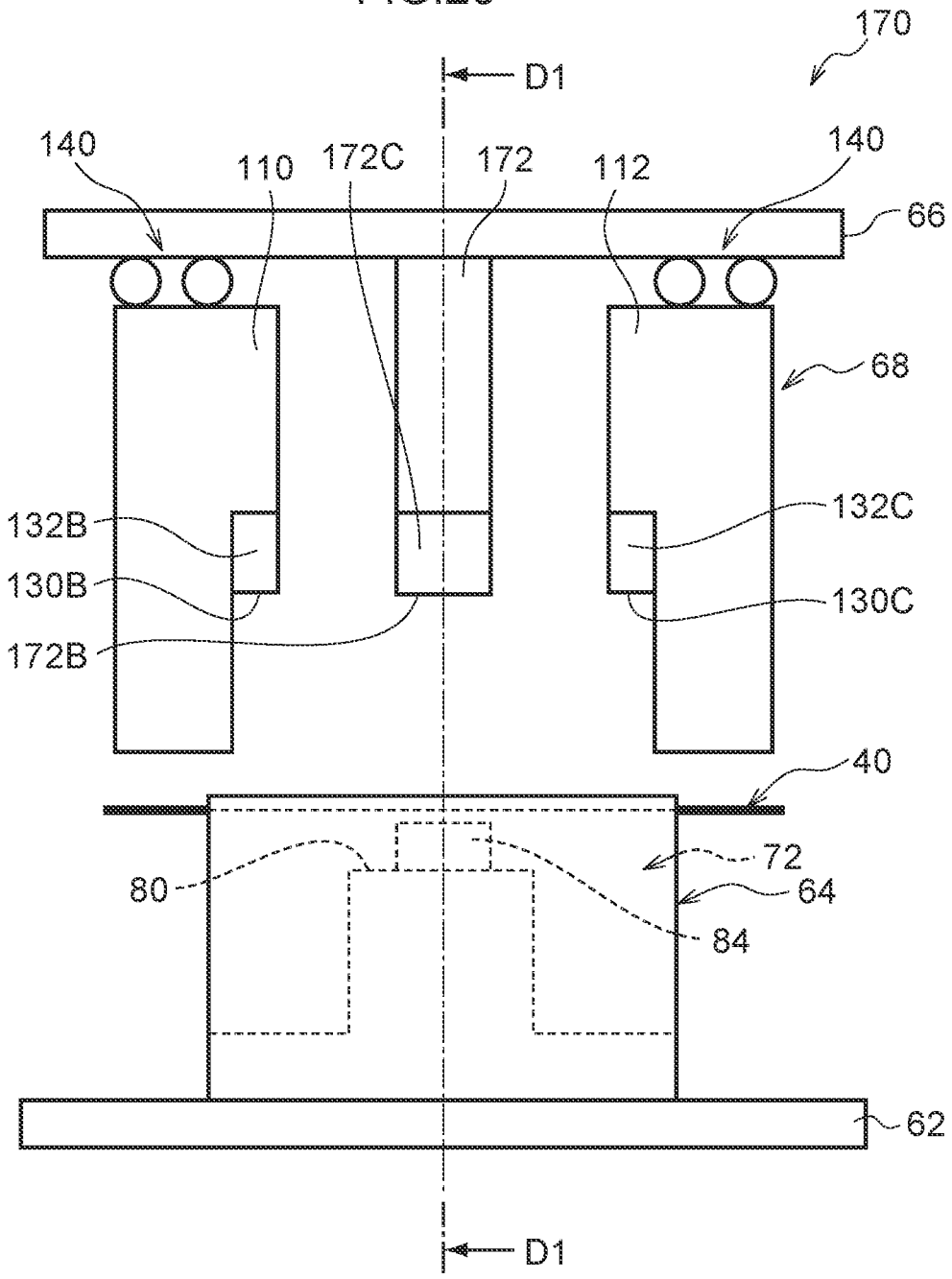
FIG. 20 is a front view illustrating a pressing apparatus according to a second exemplary embodiment.
Figure 21:
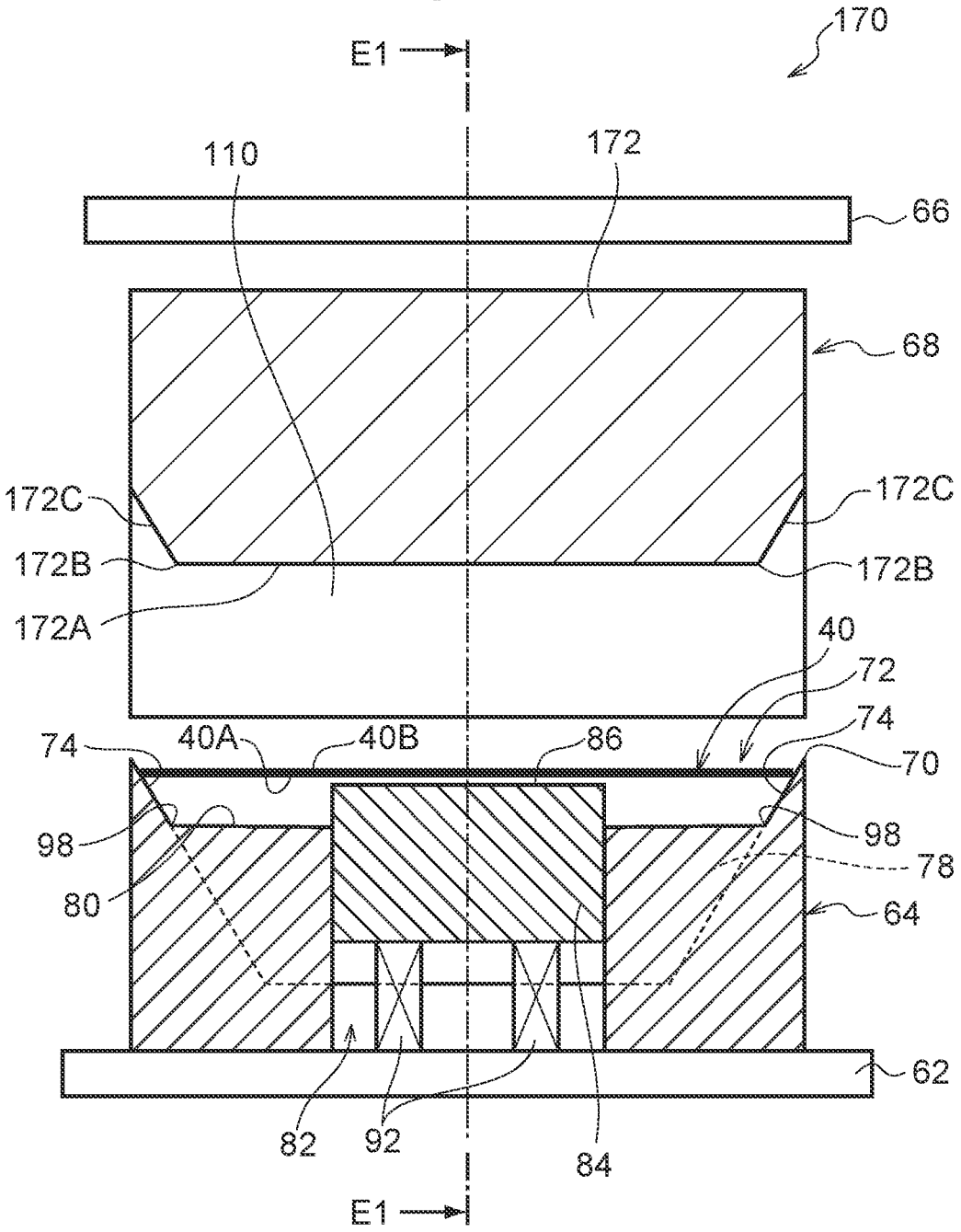
FIG. 21 is a cross-section sectioned along line D1-D1 in FIG. 20.
Figure 22:
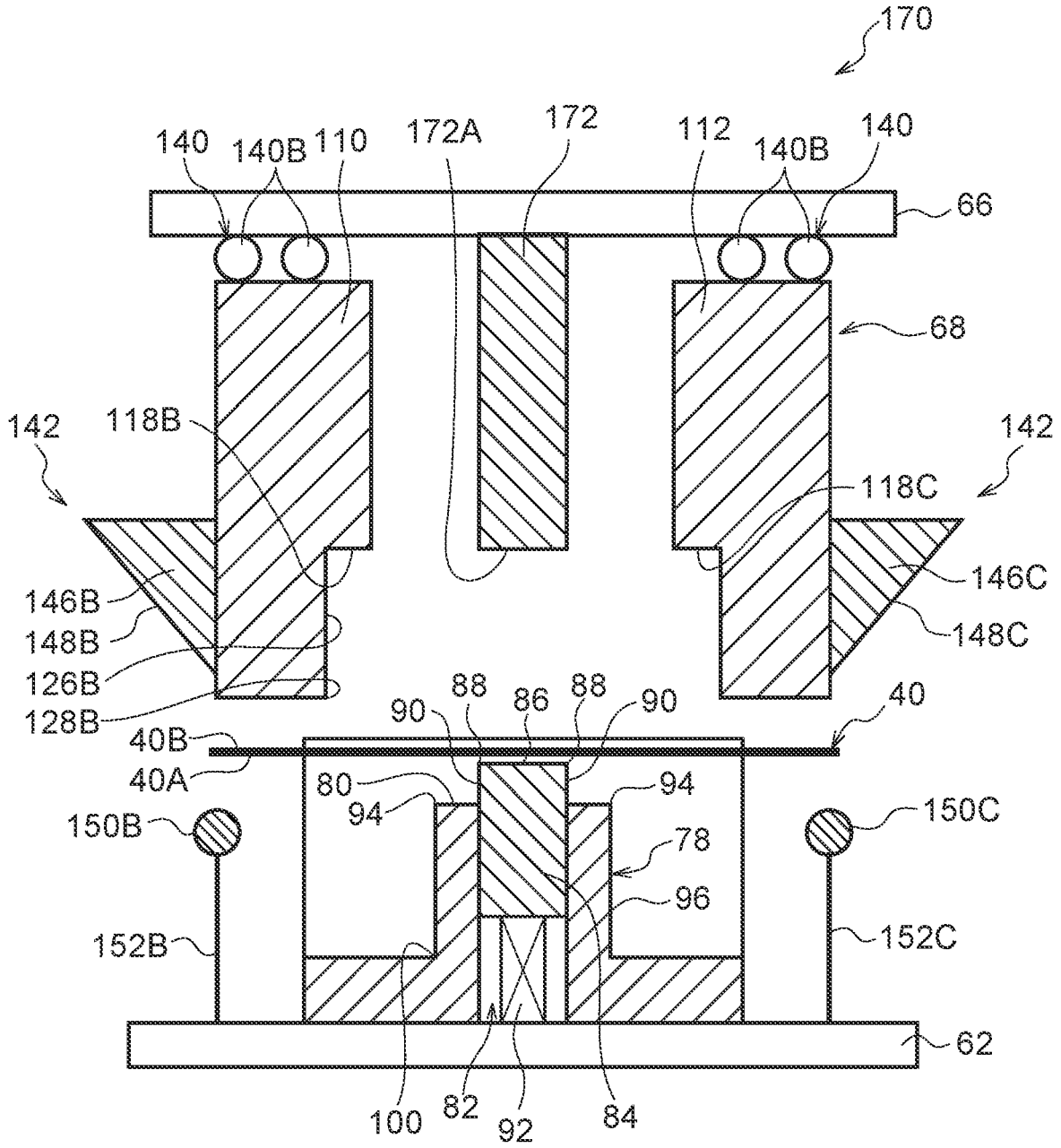
FIG. 22 is a cross-section sectioned along line E1-E1 in FIG. 21.

As illustrated in FIG. 20 to FIG. 22, the die 68 that is supported by the die bed 66 includes the first die segment 110 and the second die segment 112 forming a pair segmented in the width direction, and a die-side pad 172 disposed between the two die segments 110, 112.

The first die segment 110 and the second die segment 112 are shaped symmetrically to one another. The first die segment 110 and the second die segment 112 have narrower width dimensions than in the first exemplary embodiment.

The die-side pad 172 is fixed to the die bed 66 above the punch-side pad 84. A die bottom face 172A on the punch 64 side of the die-side pad 172 is positioned at the same height as the die bottom faces 118B, 118C (see FIG. 22) of the two die segments 110, 112.

Thus, at least part of the bottom face of the die 68 is configured by the die bottom face 172A of the die-side pad 172 that is disposed between the first die segment 110 and the second die segment 112 and that is provided to the die bed 66.

Figure 32:
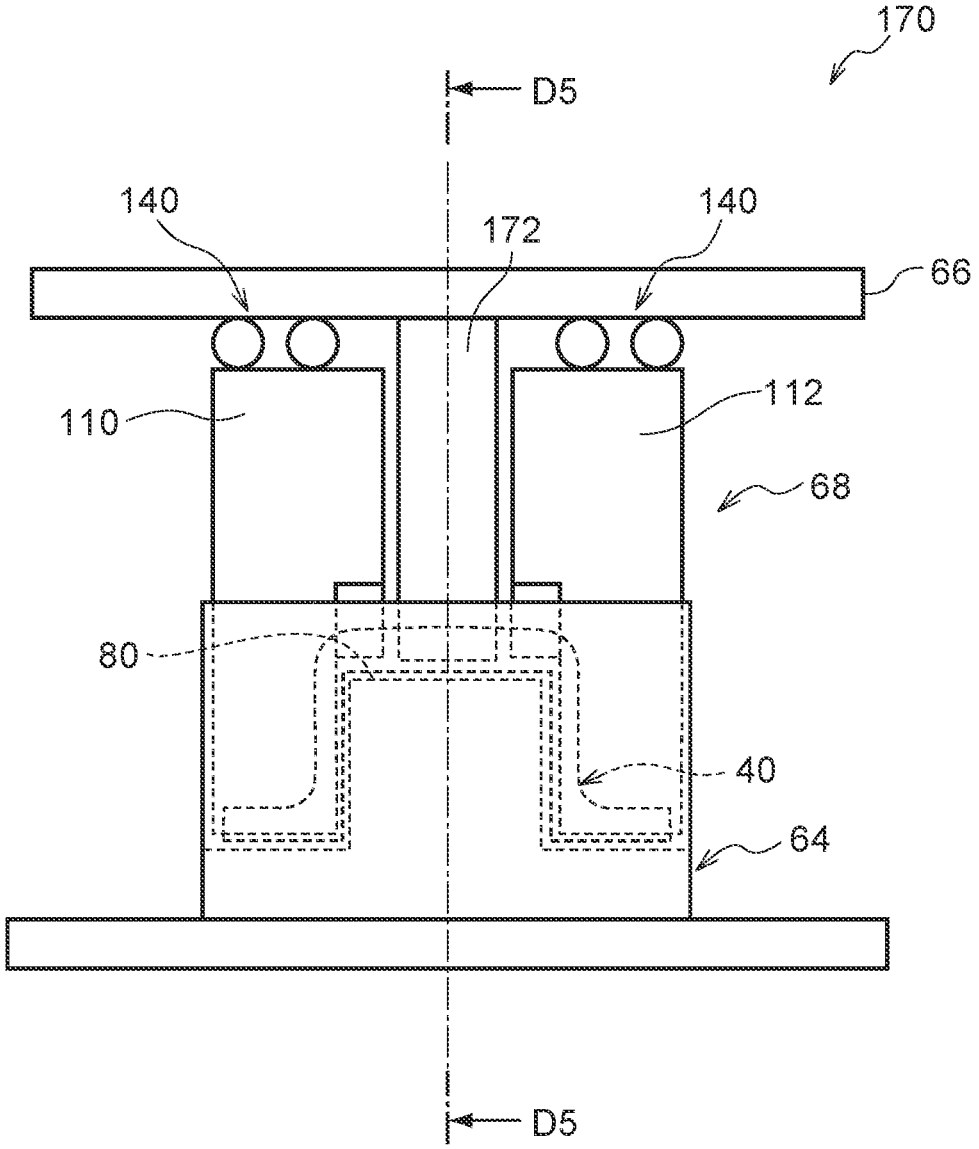
FIG. 32 is a front view of a pressing apparatus, illustrating a process following that illustrated in FIG. 29.
Figure 33:
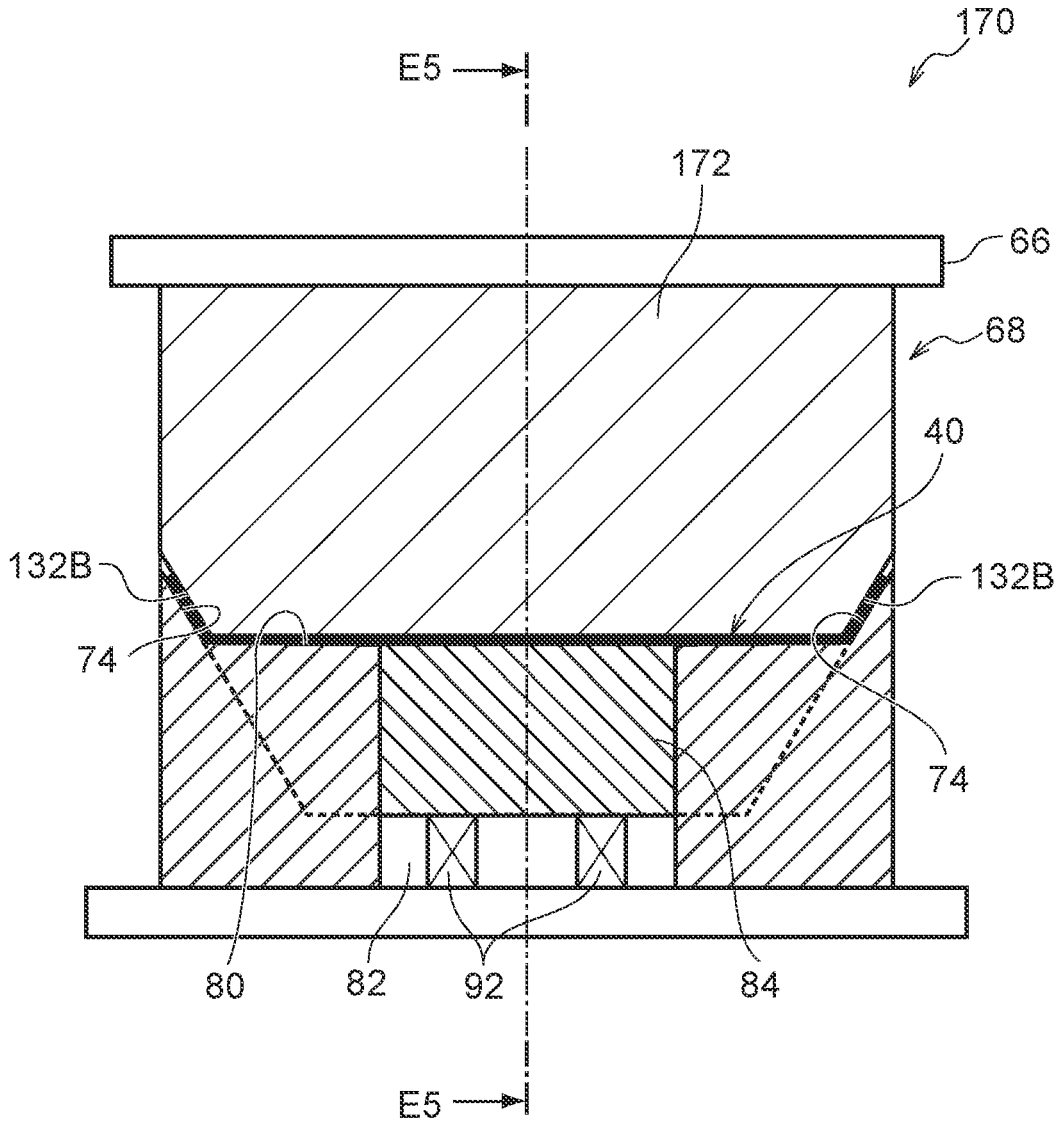
FIG. 33 is a cross-section sectioned along line D5-D5 in FIG. 32.
Figure 34:
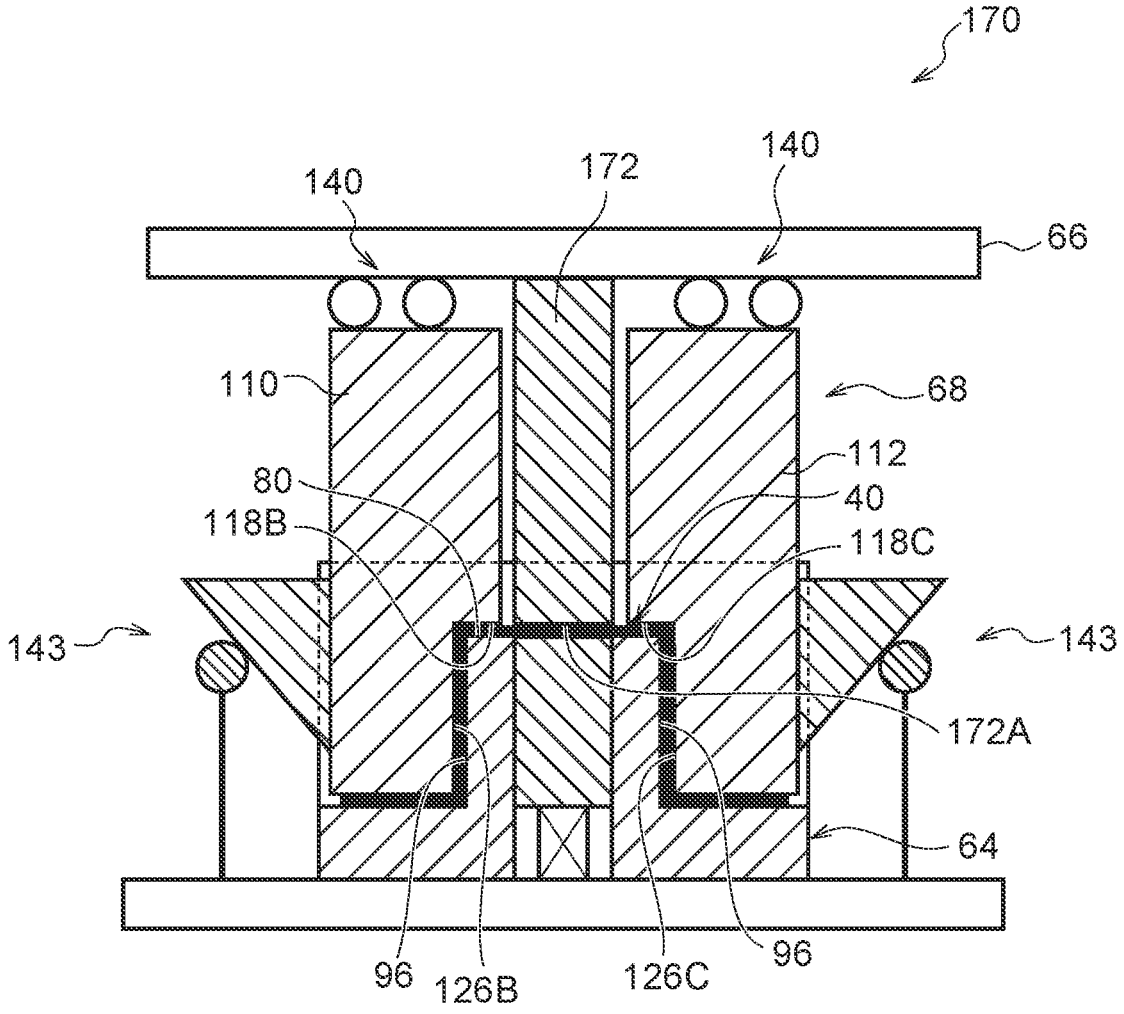
FIG. 34 is a cross-section sectioned along line E5-E5 in FIG. 33.

As illustrated in FIG. 32 to FIG. 34, in a state in which the two die segments 110, 112 have approached the die-side pad 172, the blank 40 can be pushed toward the punch apex face 80 by the respective die bottom faces 118B, 118C and the die bottom face 172A.

As illustrated in FIG. 20 to FIG. 22, die pad end portion protruding ridges 172B that correspond to the punch end portion inverted ridges 98 are formed on the punch 64 side of the respective end portions of the die bottom faces 118B, 118C and the die bottom face 172A. Die pad rising faces 172C that correspond to the punch rising faces 74 extend from the respective die pad end portion protruding ridges 172B. The die pad rising faces 172C slope toward the die bed 66 on progression from the die pad end portion protruding ridges 172B toward their respective end portions.

Manufacturing Method

Explanation follows regarding a manufacturing method to manufacture the saddle-shaped press-molded article 10 using the pressing apparatus 170.

Supporting Process

As illustrated in FIG. 20 to FIG. 23, in manufacture of the saddle-shaped press-molded article 10, the blank 40 is disposed on top of the punch 64 and the end portions of the blank 40 are supported by the punch rising faces 74 in a state in which the punch-side pad 84 of the punch 64 projects out beyond the punch apex face 80 (supporting process).

First Pressing Process

Figure 23:
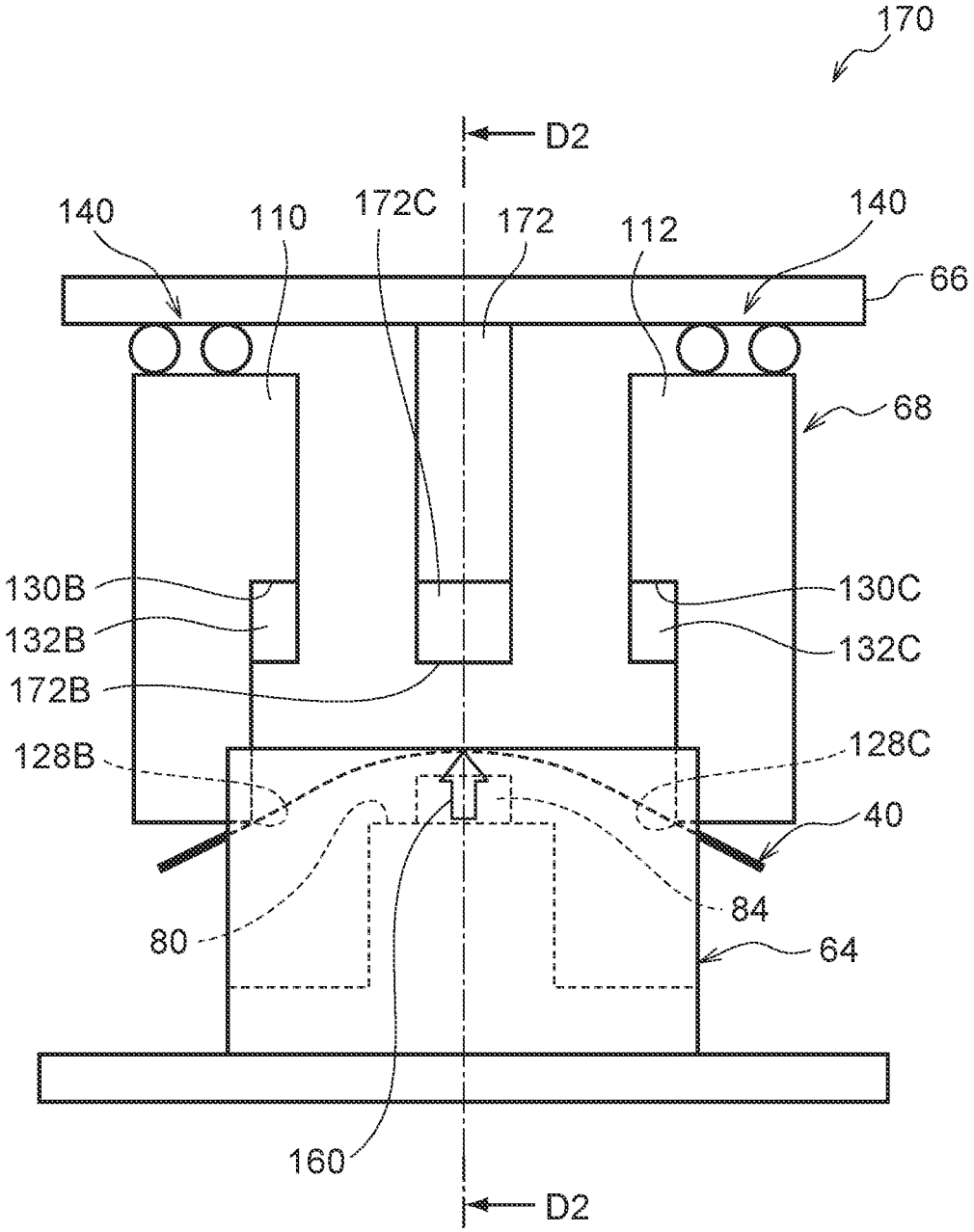
FIG. 23 is a front view of a pressing apparatus, illustrating a process following that illustrated in FIG. 20.
Figure 24:
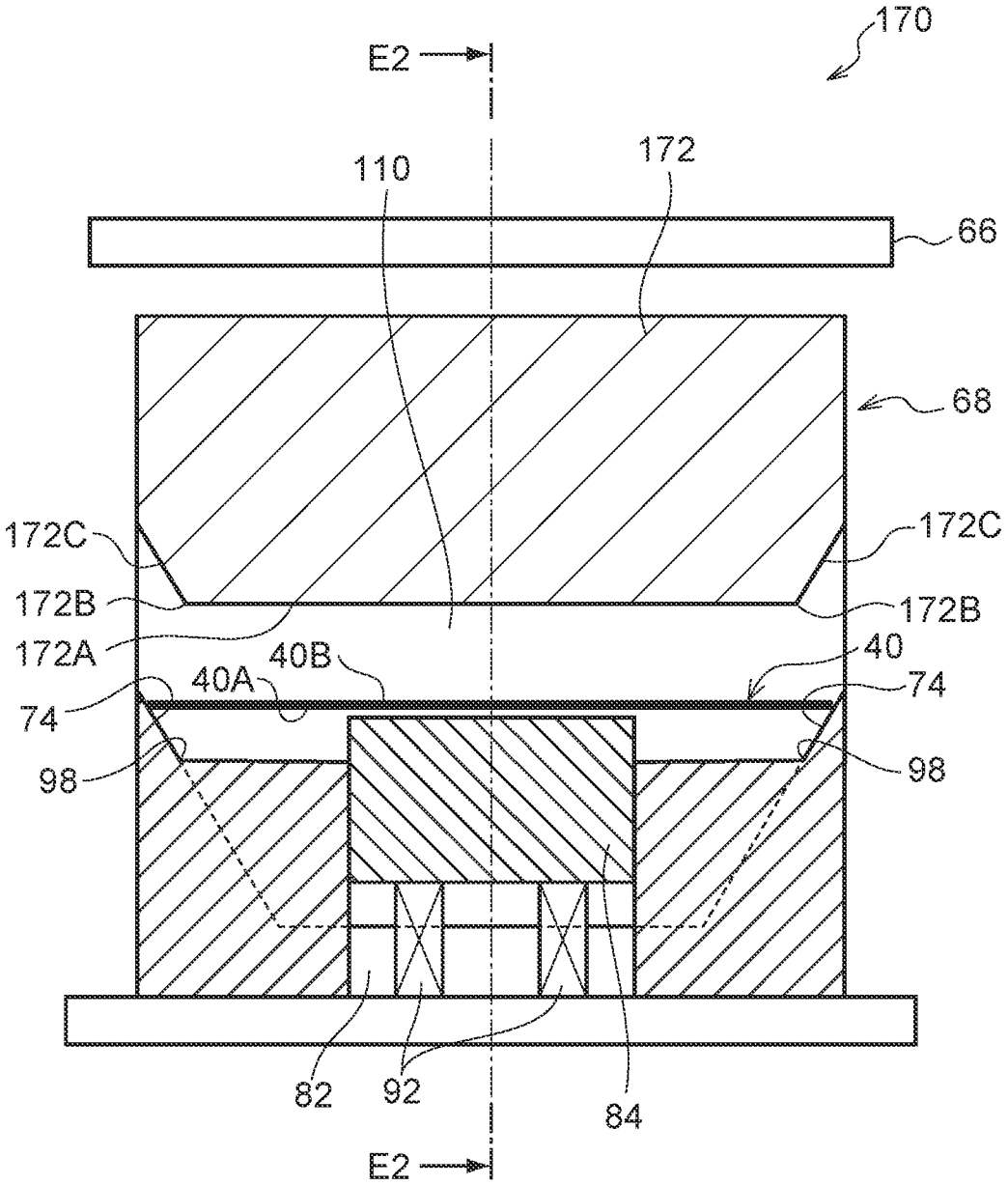
FIG. 24 is a cross-section sectioned along line D2-D2 in FIG. 23.
Figure 25:
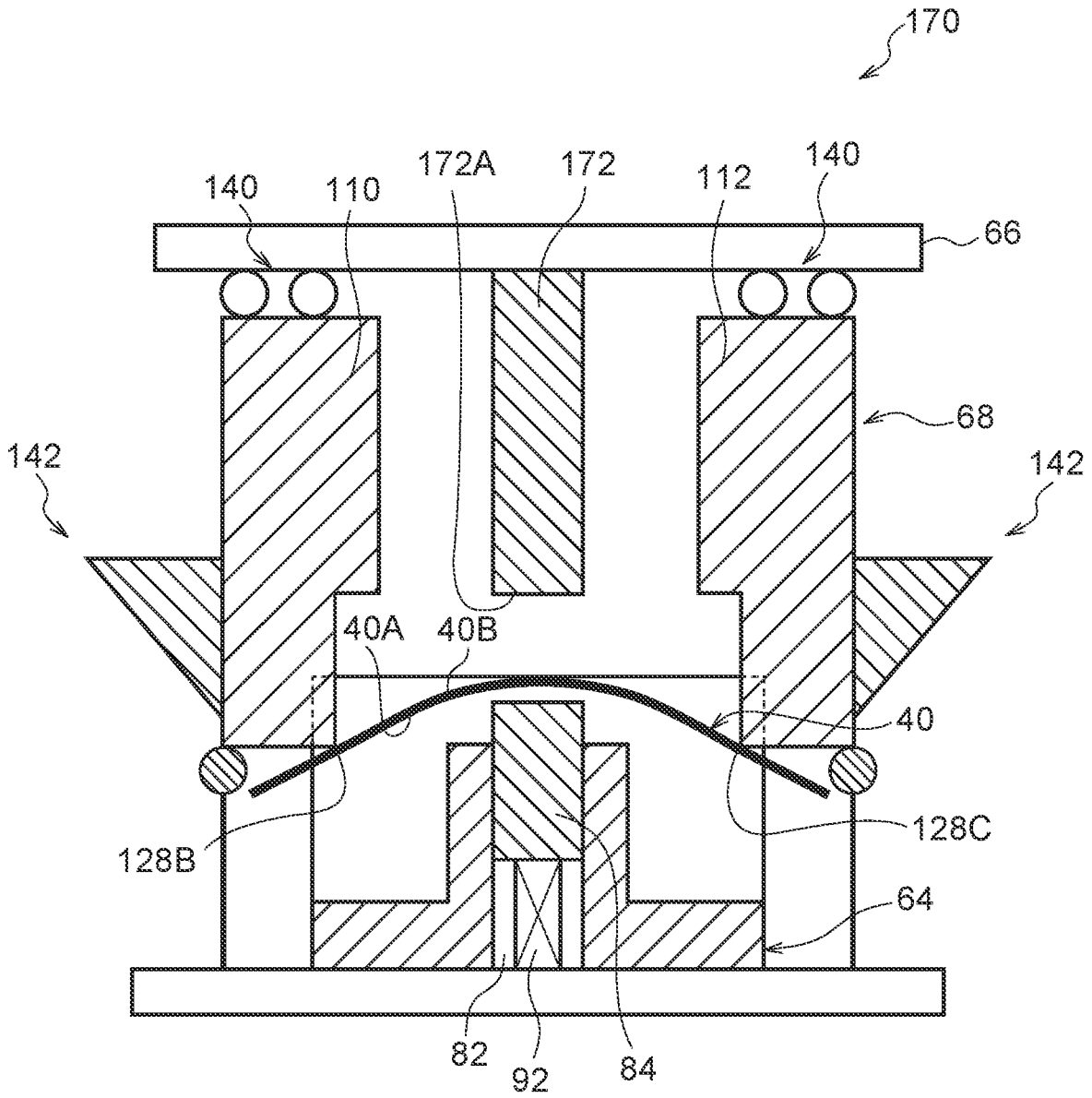
FIG. 25 is a cross-section sectioned along line E2-E2 in FIG. 25.

As illustrated in FIG. 23 to FIG. 25, the die 68 supported by the die bed 66 is then moved toward the punch 64 by the non-illustrated press mechanism. Locations of the blank 40 beyond the two outer sides of the punch apex face 80 are thereby pushed toward the punch 64 by the die shoulders 128B, 128C.

Second Pressing Process

Figure 26:
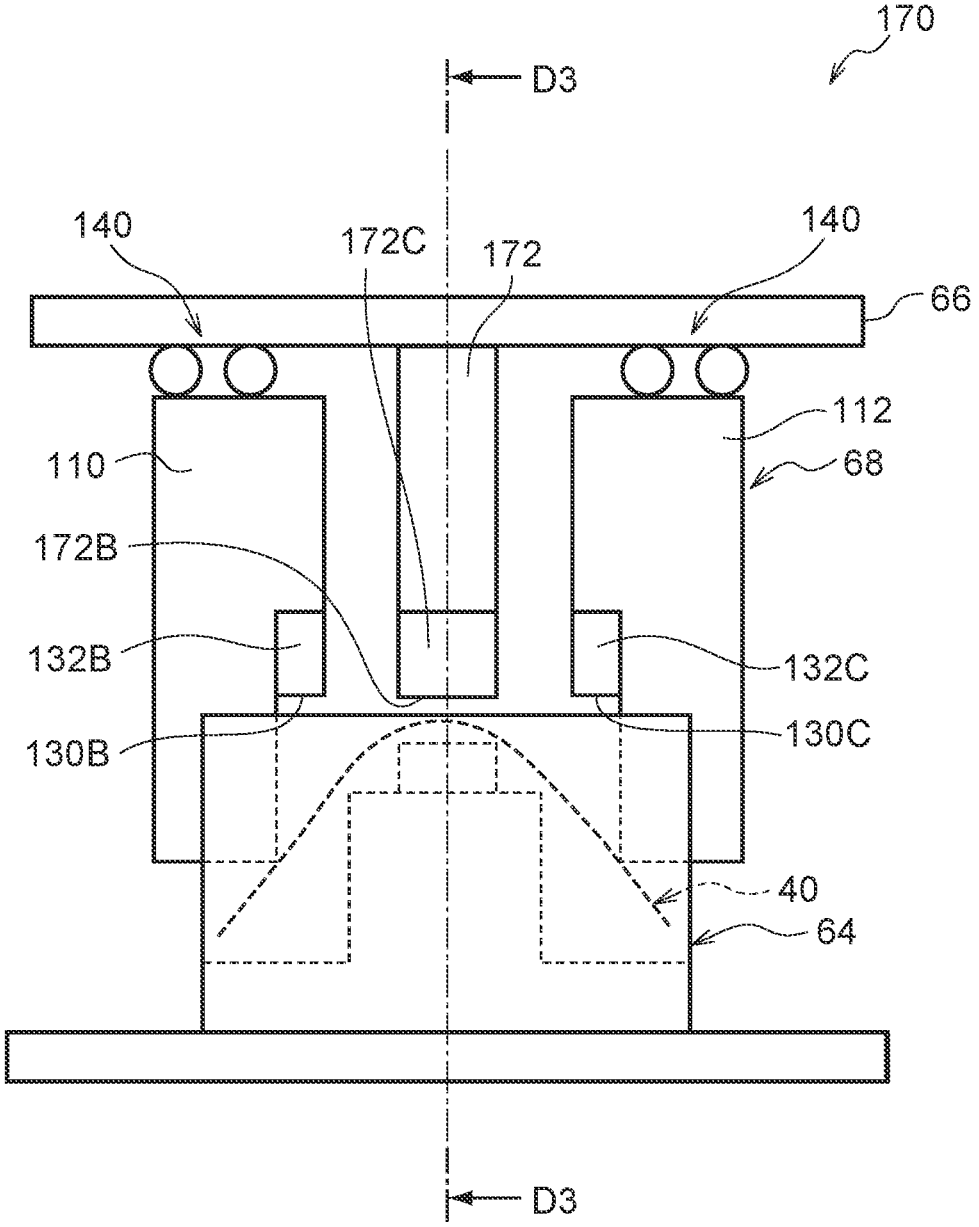
FIG. 26 is a front view of a pressing apparatus, illustrating a process following that illustrated in FIG. 23.
Figure 27:
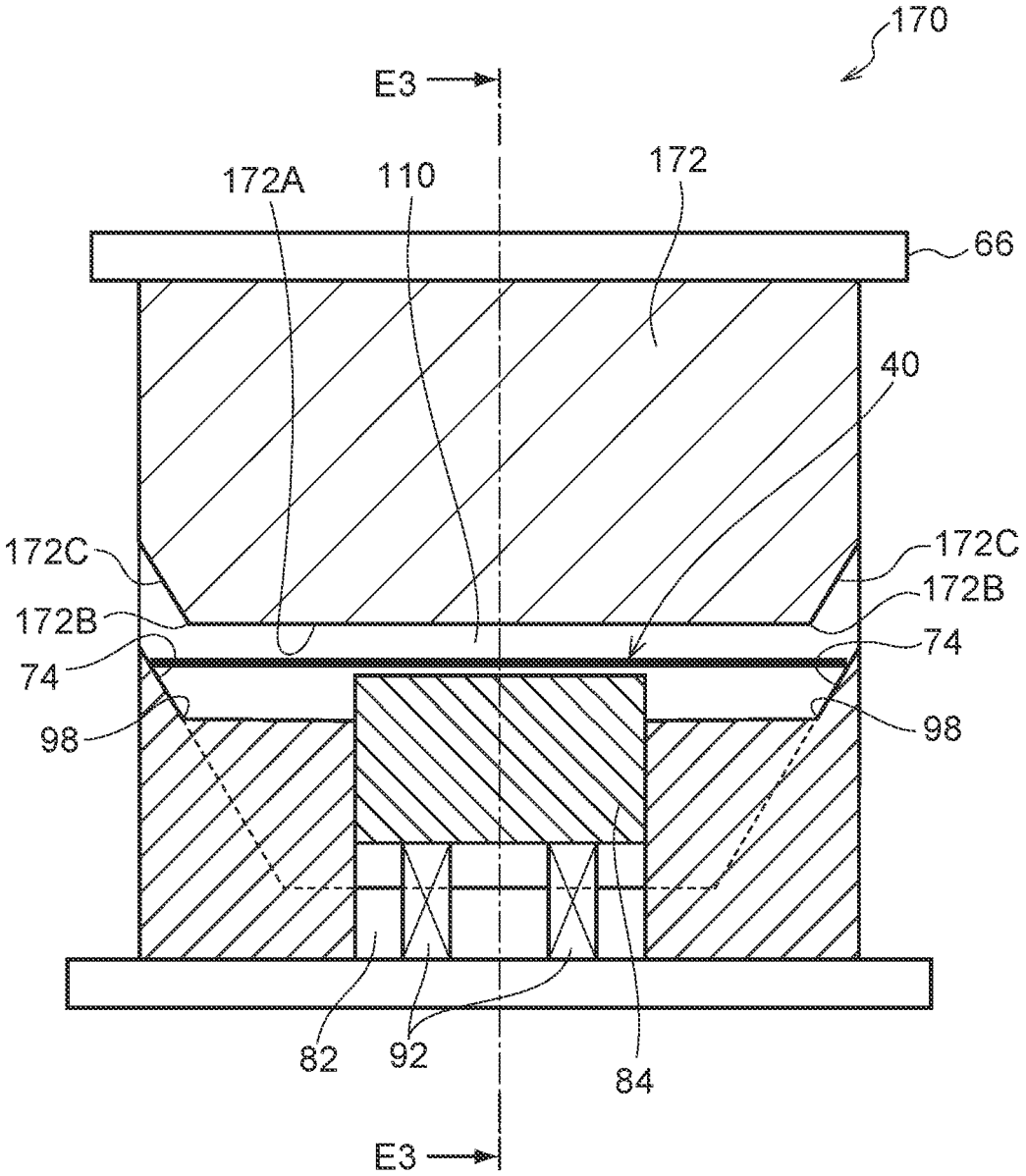
FIG. 27 is a cross-section sectioned along line D3-D3 in FIG. 26.
Figure 28:
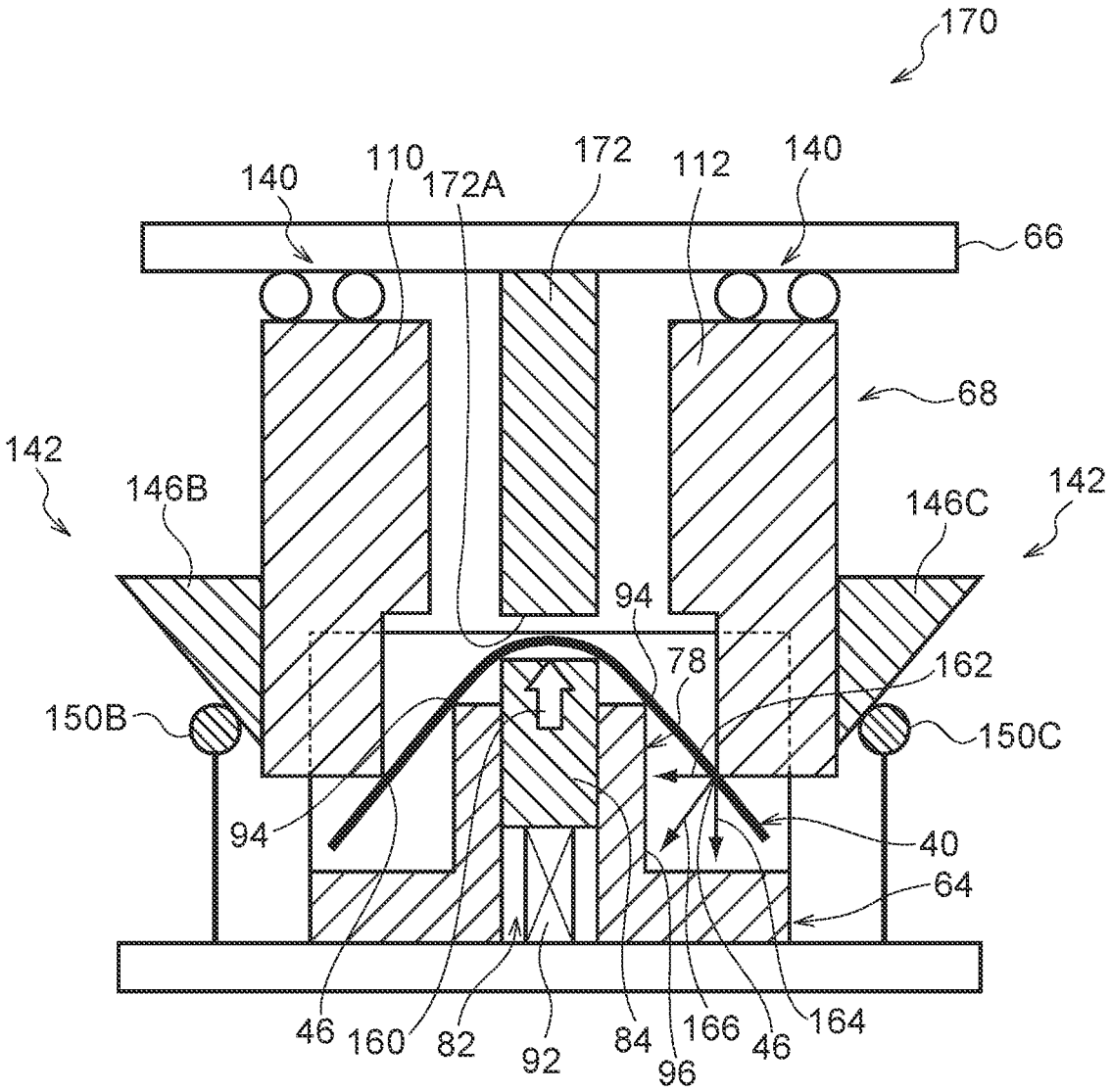
FIG. 28 is a cross-section sectioned along line E3-E3 in FIG. 27.

Next, as illustrated in FIG. 26 to FIG. 28, the die 68 is moved further toward the punch 64 by the non-illustrated press mechanism. The first die segment 110 and the second die segment 112 are thereby moved toward the punch 64, and also moved toward the die-side pad 172, by the drive source 142 (thereby configuring a pushing process including the first pressing process and the second pressing process).

Housing Process

Figure 29:
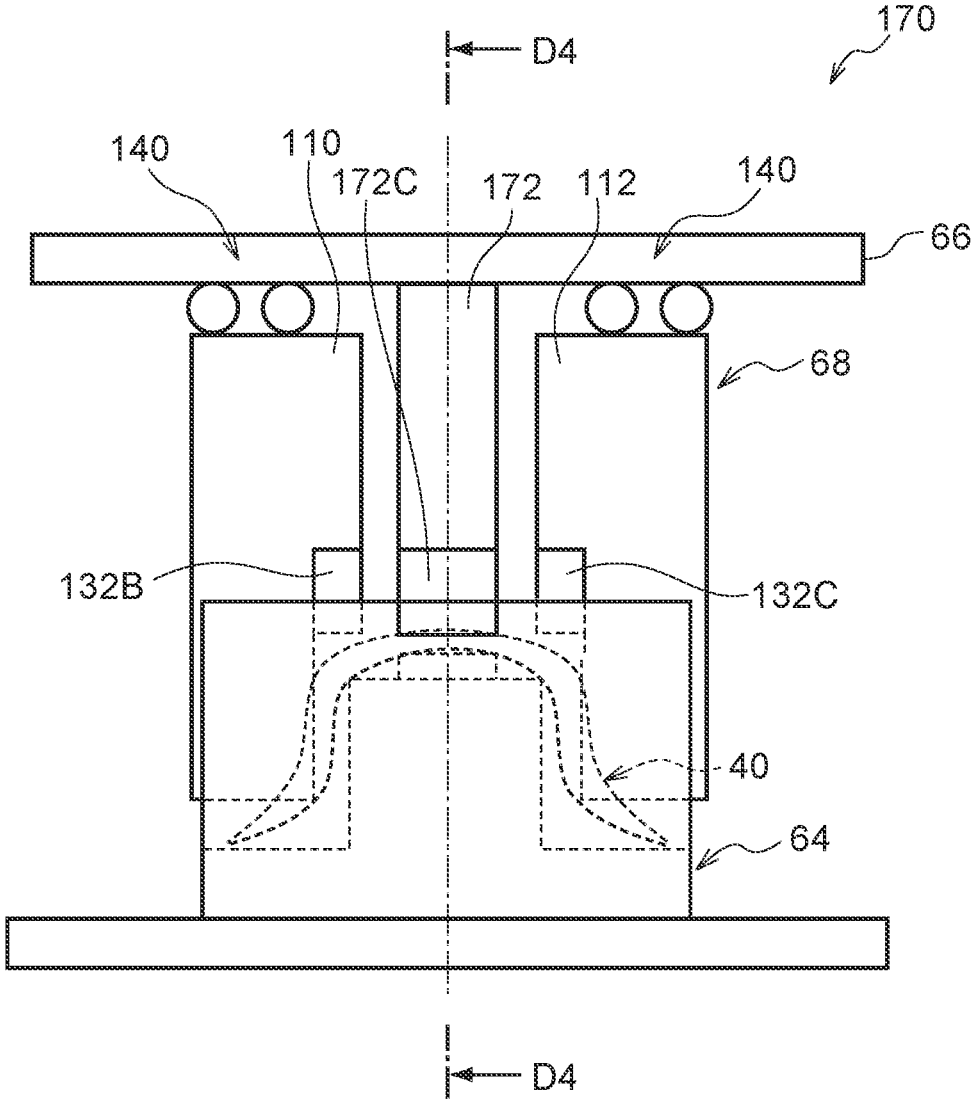
FIG. 29 is a front view of a pressing apparatus, illustrating a process following that illustrated in FIG. 26.
Figure 30:
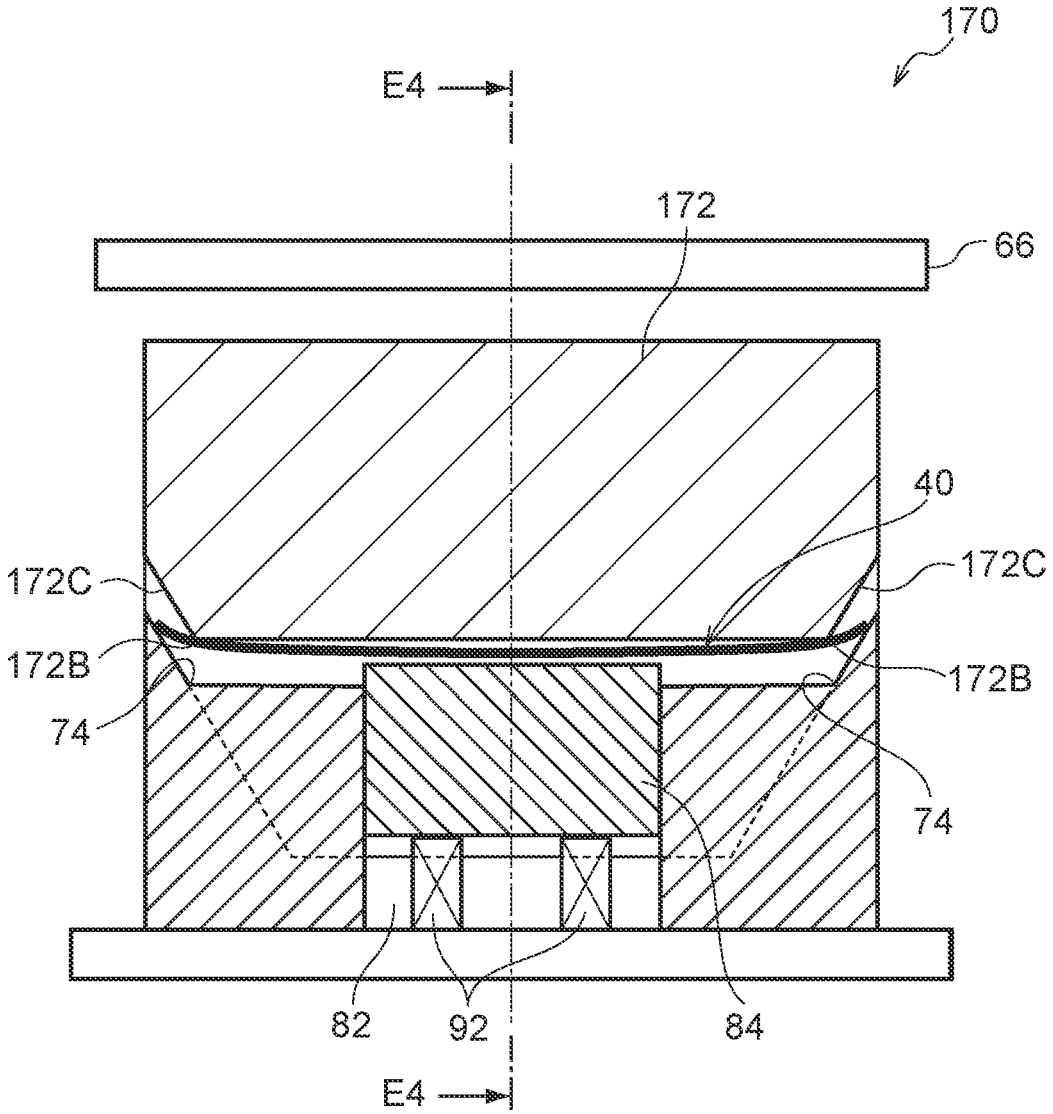
FIG. 30 is a cross-section sectioned along line D4-D4 in FIG. 29.
Figure 31:
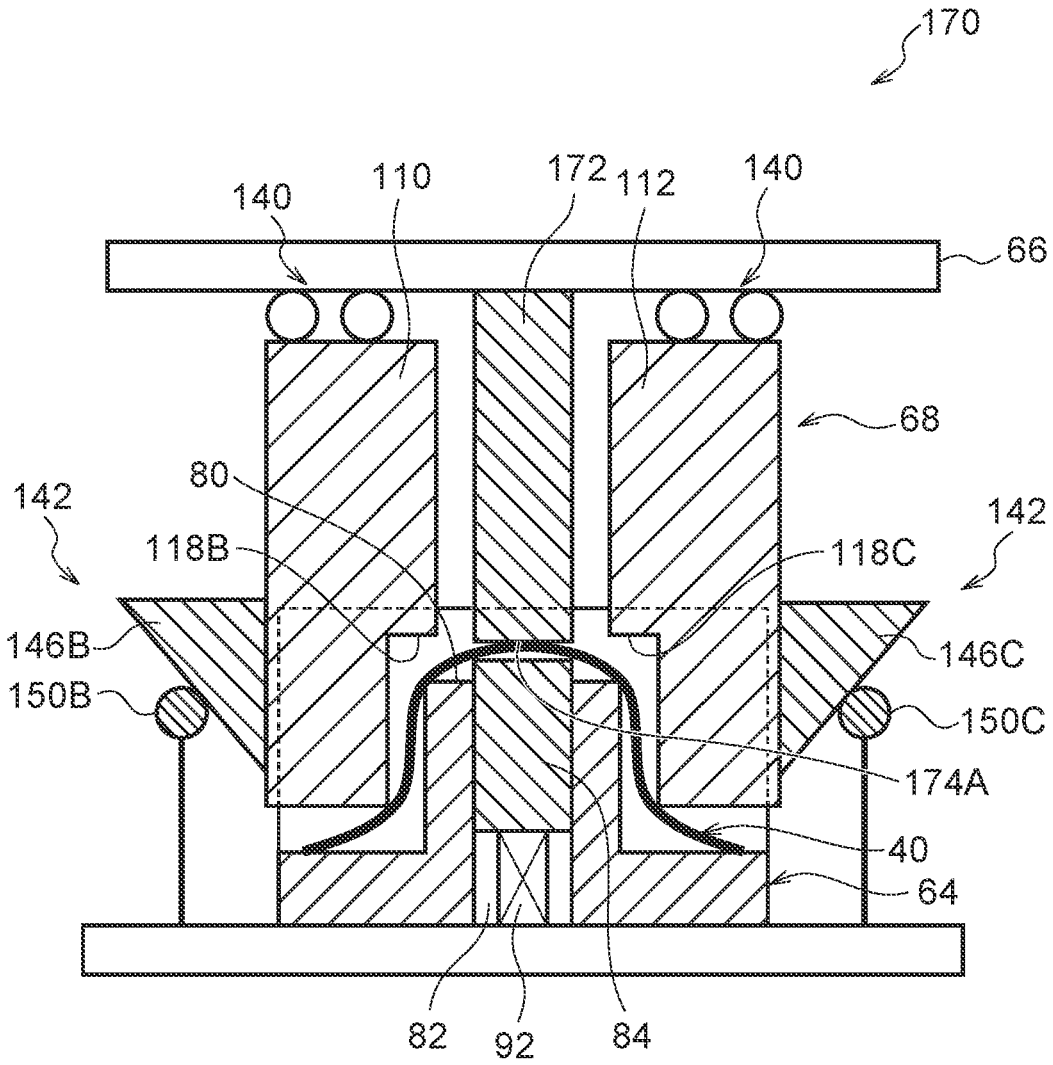
FIG. 31 is a cross-section sectioned along line E4-E4 in FIG. 30.

As illustrated in FIG. 29 to FIG. 31, the die 68 is then moved further toward the punch 64 by the non-illustrated press mechanism. The blank 40 is thereby pushed toward the punch apex face 80 by the die bottom faces 118B, 118C of the two die segments 110, 112 and by the die bottom face 174A of the die-side pad 174. The punch-side pad 84 is thereby housed inside the punch-side pad housing portion 82 while the blank 40 is gripped between the punch-side pad 84 and the die bottom faces 118B, 118C, 174A (housing process).

At the same time, the end portion flange configuration locations 54 of the blank 40 are raised up along the punch rising faces 74.

Clamping Process

As illustrated in FIG. 32 to FIG. 34, the die 68 is then moved further toward the punch 64 by the non-illustrated press mechanism, moving the die 68 such that the die 68 moves closer to the punch 64 until reaching bottom dead center. The blank 40 is thereby clamped by a combination of the punch apex face 80 and the die bottom faces 118B, 118C, 172A, the punch side-faces 96 and the die inner faces 126B, 126C, and the punch rising faces 74 and the die rising faces 132B, 132C, 172C (clamping process).

The blank 40 is transformed into the saddle-shaped press-molded article 10 in this manner.

Operation and Advantageous Effects

The present exemplary embodiment enables similar operation and advantageous effects to those in the first exemplary embodiment to be exhibited.

Moreover, the die-side pad 172 is provided above the punch-side pad 84. Thus, an apex of the curled portion of the blank 40 can be pushed from a direction normal thereto by the die bottom face 172A of the die-side pad 172 before the die bottom faces 118B, 118C of the first die segment 110 and the second die segment 112 make contact with the blank 40.

This enables positional misalignment of the blank 40 such as might occur when the die bottom faces 118B, 118C of the two die segments 110, 112 make contact with the curled portion of the blank 40 from oblique angles to be suppressed.

Third Exemplary Embodiment

FIG. 35 to FIG. 49 are diagrams illustrating a third exemplary embodiment. Configurations similar or equivalent to those in the second exemplary embodiment are allocated the same reference numerals, and explanation thereof is omitted. The following explanation concerns only portions that differ.

Pressing Apparatus

In a pressing apparatus 180 according to the present exemplary embodiment, the support structure of the die-side pad 172 configuring the die 68 differs from that of the second exemplary embodiment.

Die

Figure 35:
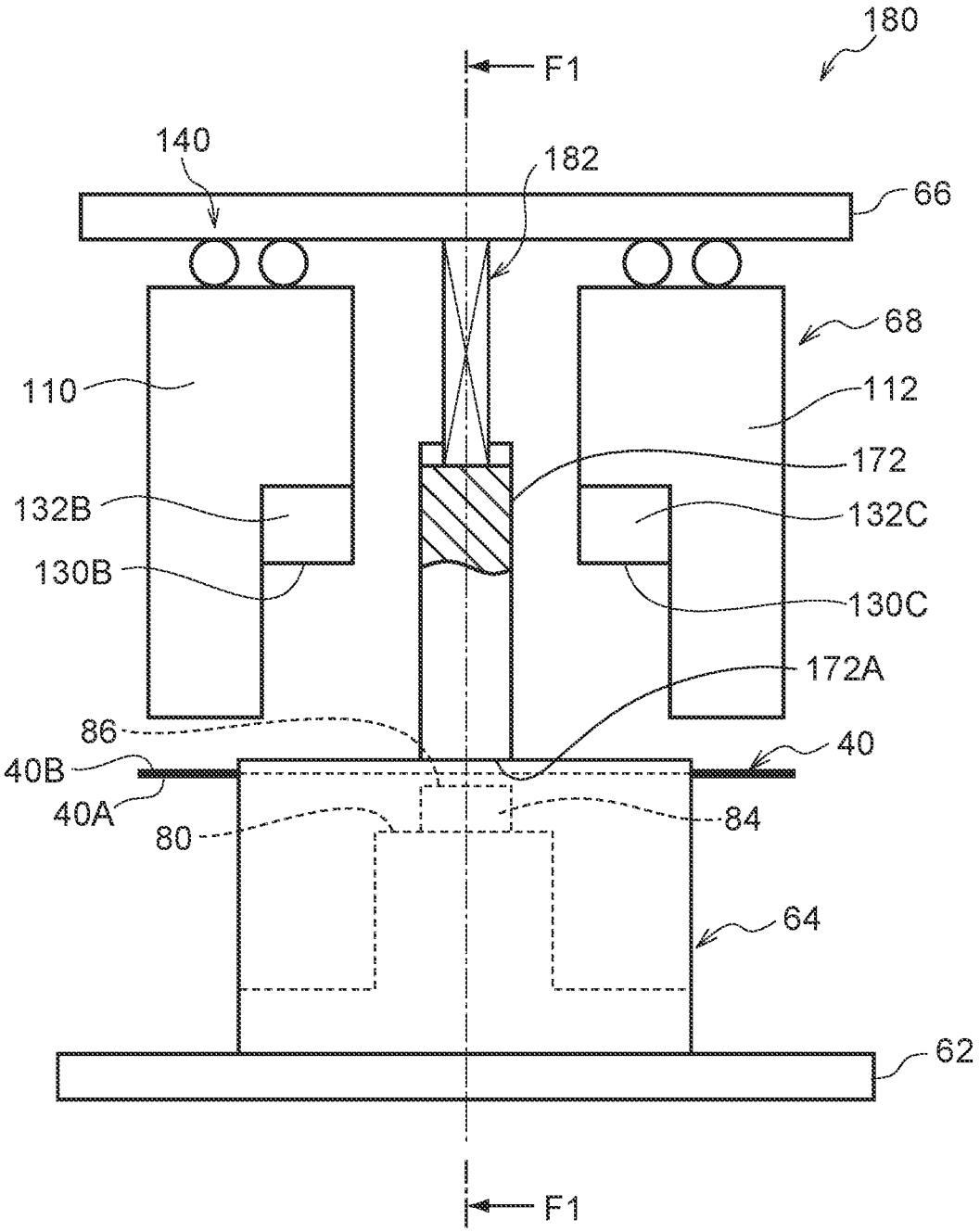
FIG. 35 is a front view illustrating a pressing apparatus according to a third exemplary embodiment.
Figure 36:
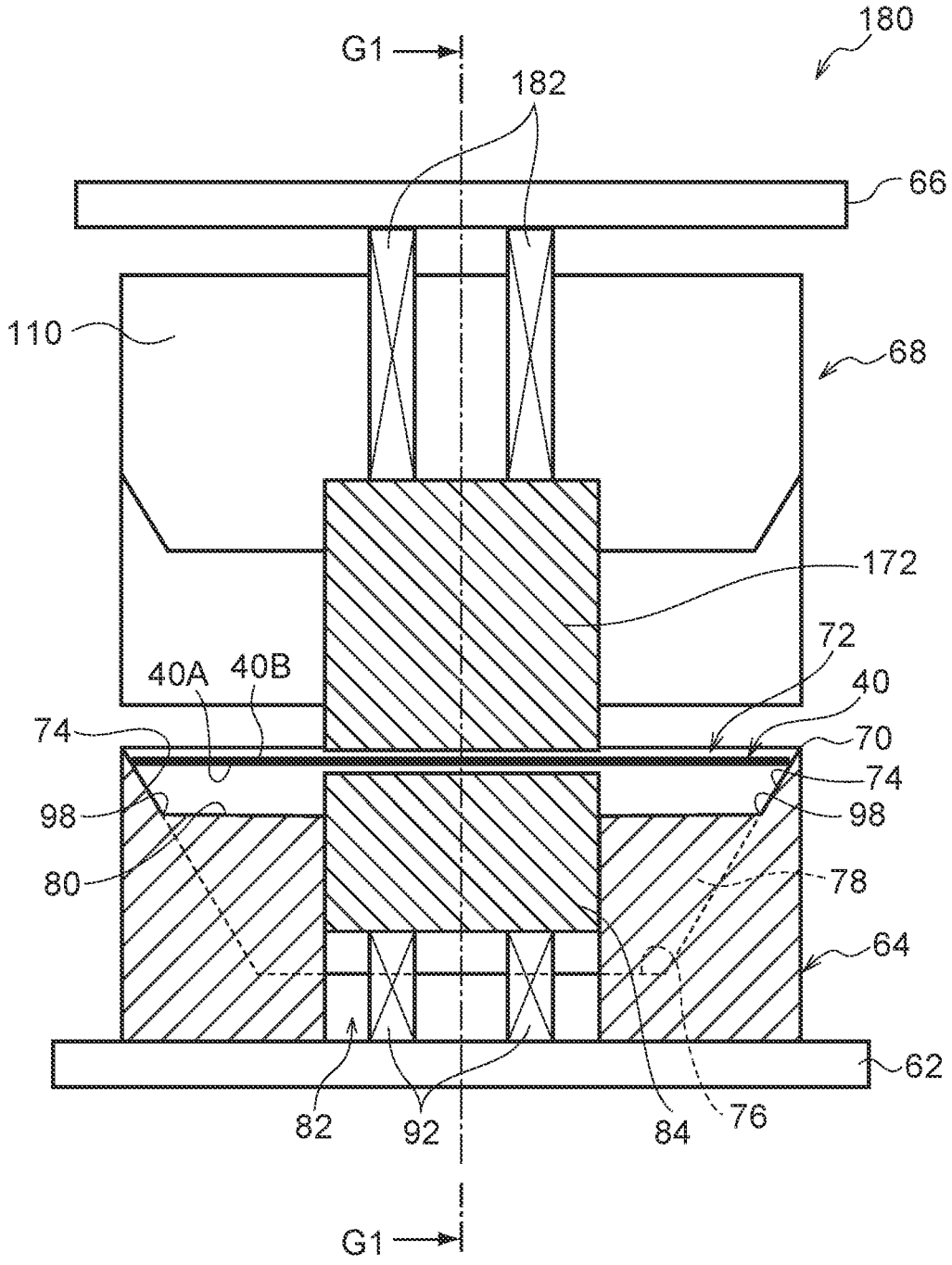
FIG. 36 is a cross-section sectioned along line F1-F1 in FIG. 35.
Figure 37:
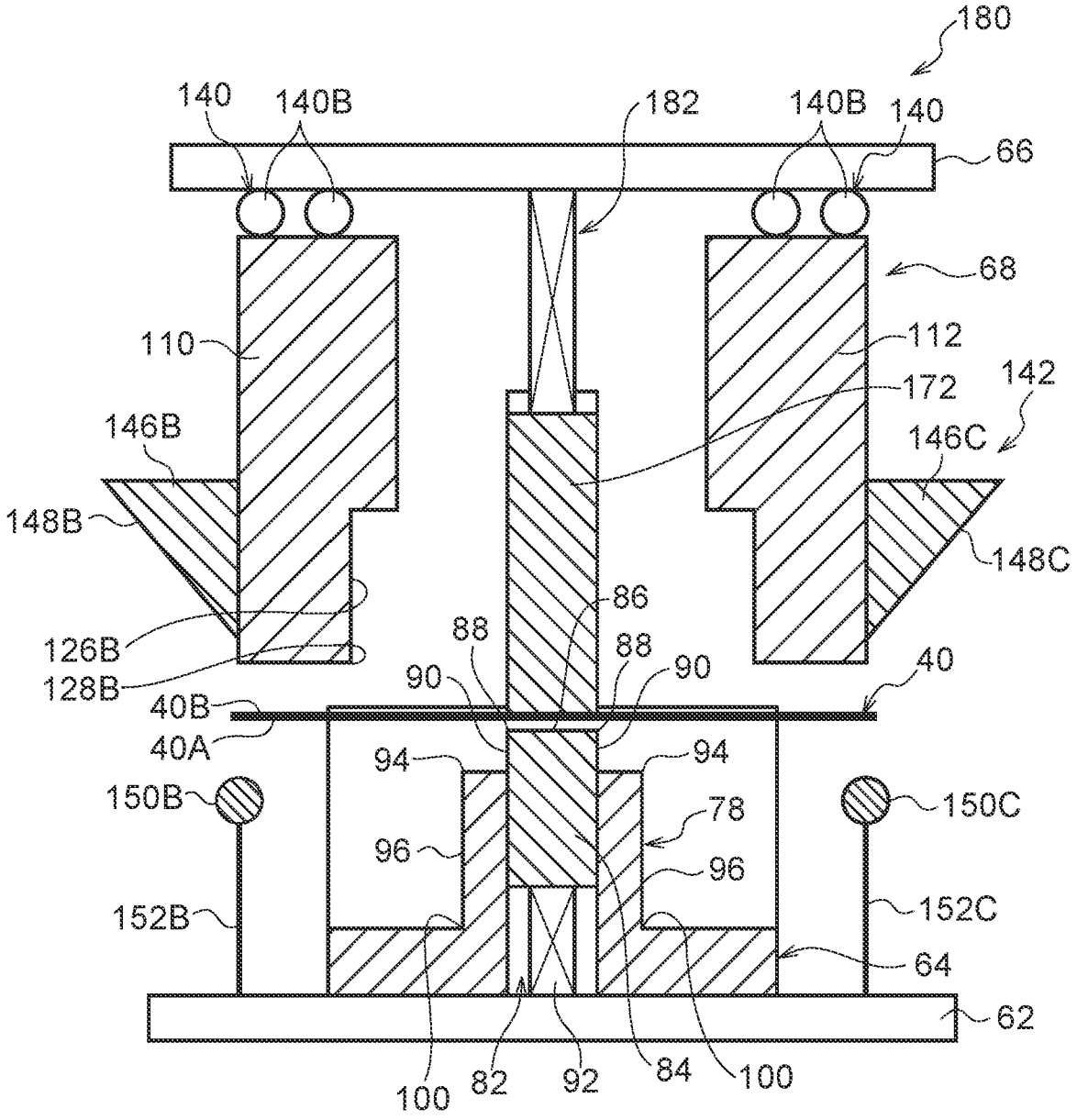
FIG. 37 is a cross-section sectioned along line G1-G1 in FIG. 36.

As illustrated in FIG. 35 to FIG. 37, the die 68 that is supported by the die bed 66 includes the first die segment 110 and the second die segment 112 forming a pair segmented in the width direction, and the die-side pad 172 disposed between the two die segments 110, 112.

The die-side pad 172 is supported by the die bed 66 above the punch-side pad 84. A die-side extension/retraction mechanism 182 is provided between the die bed 66 and the die-side pad 172. The die-side extension/retraction mechanism 182 biases the die-side pad 172 toward the punch-side pad 84 and is also capable of causing the die-side pad 172 to retreat toward the die bed 66.

The die-side extension/retraction mechanism 182 is extended when in an unloaded state, such that the die bottom face 172A of the die-side pad 172 opposes the pad apex face 86 of the punch-side pad 84 from close proximity.

The die-side extension/retraction mechanism 182 may be configured by a coil spring, a damper, a hydraulic cylinder, or the like.

The die-side pad 172 has a shorter length dimension than in the second exemplary embodiment. As illustrated in FIG. 36, the length of the die-side pad 172 is substantially the same as that of the punch-side pad 84.

Manufacturing Method

Explanation follows regarding a manufacturing method to manufacture the saddle-shaped press-molded article 10 using the pressing apparatus 180.

Supporting Process

As illustrated in FIG. 35 to FIG. 37, in order to manufacture the saddle-shaped press-molded article 10, the blank 40 is disposed on top of the punch 64 and the end portions of the blank 40 are supported by the punch rising faces 74 in a state in which the punch-side pad 84 of the punch 64 projects out beyond the punch apex face 80 (supporting process).

First Pressing Process

Figure 38:
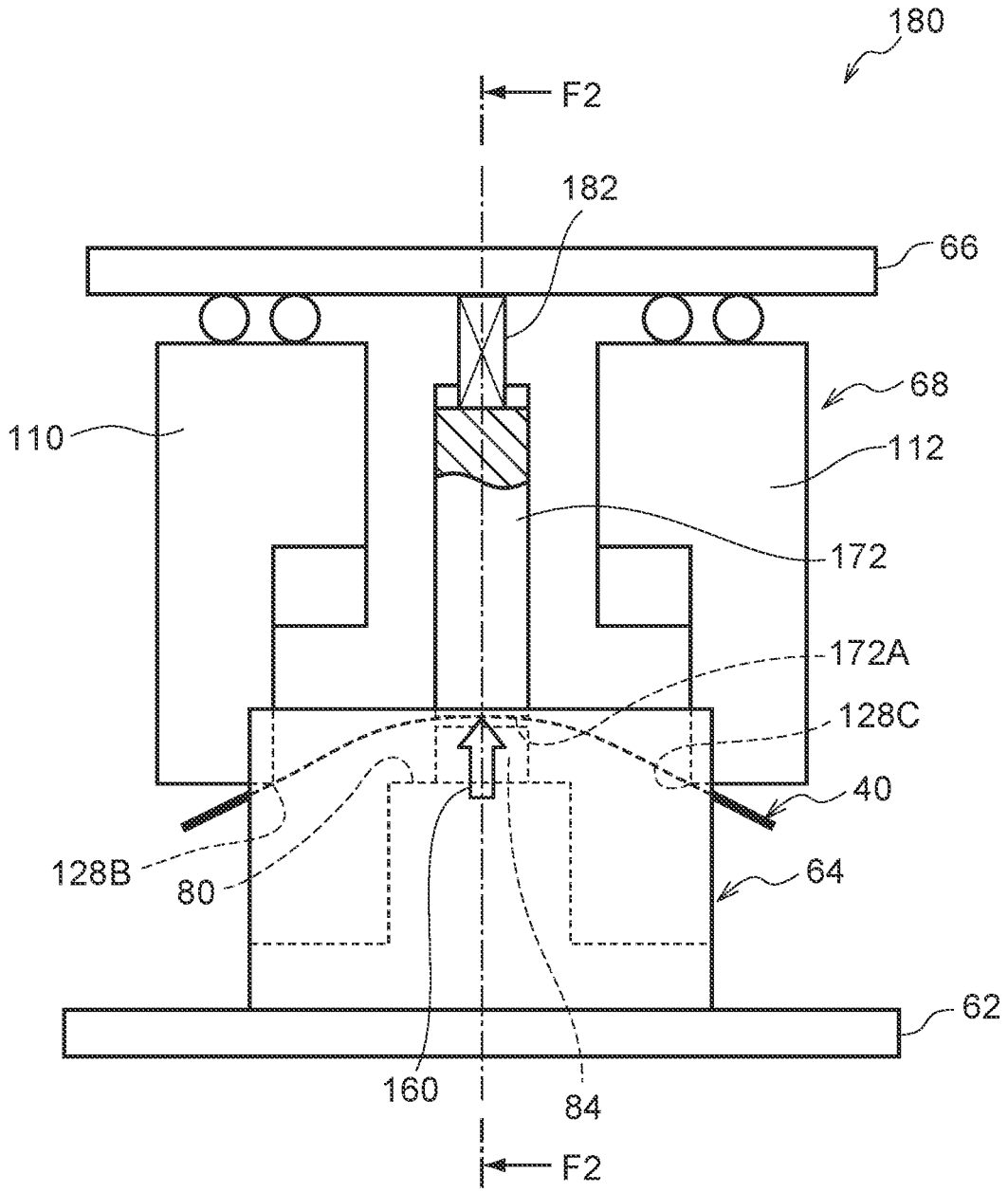
FIG. 38 is a front view of a pressing apparatus, illustrating a process following that illustrated in FIG. 35.
Figure 39:
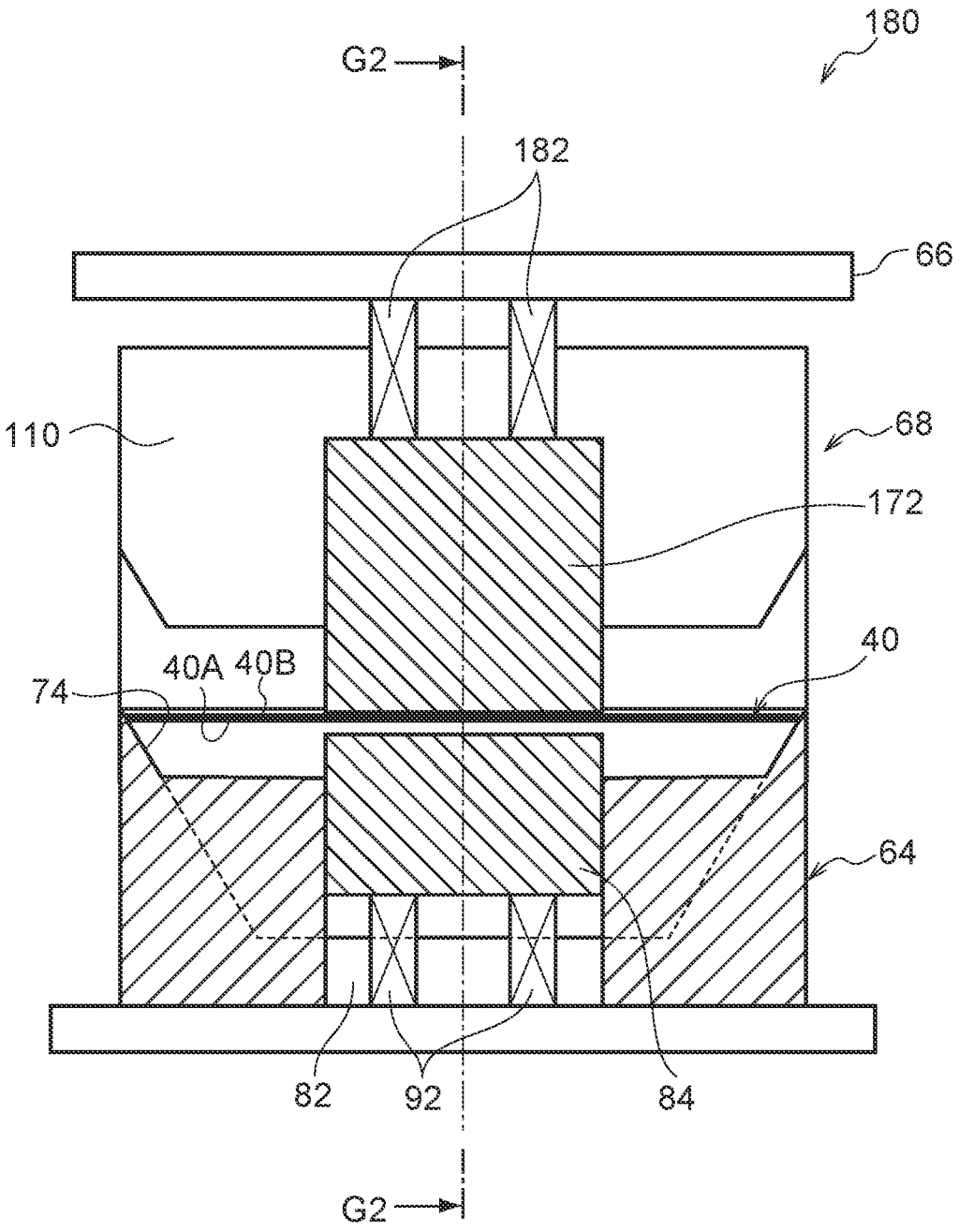
FIG. 39 is a cross-section sectioned along line F2-F2 in FIG. 38.
Figure 40:
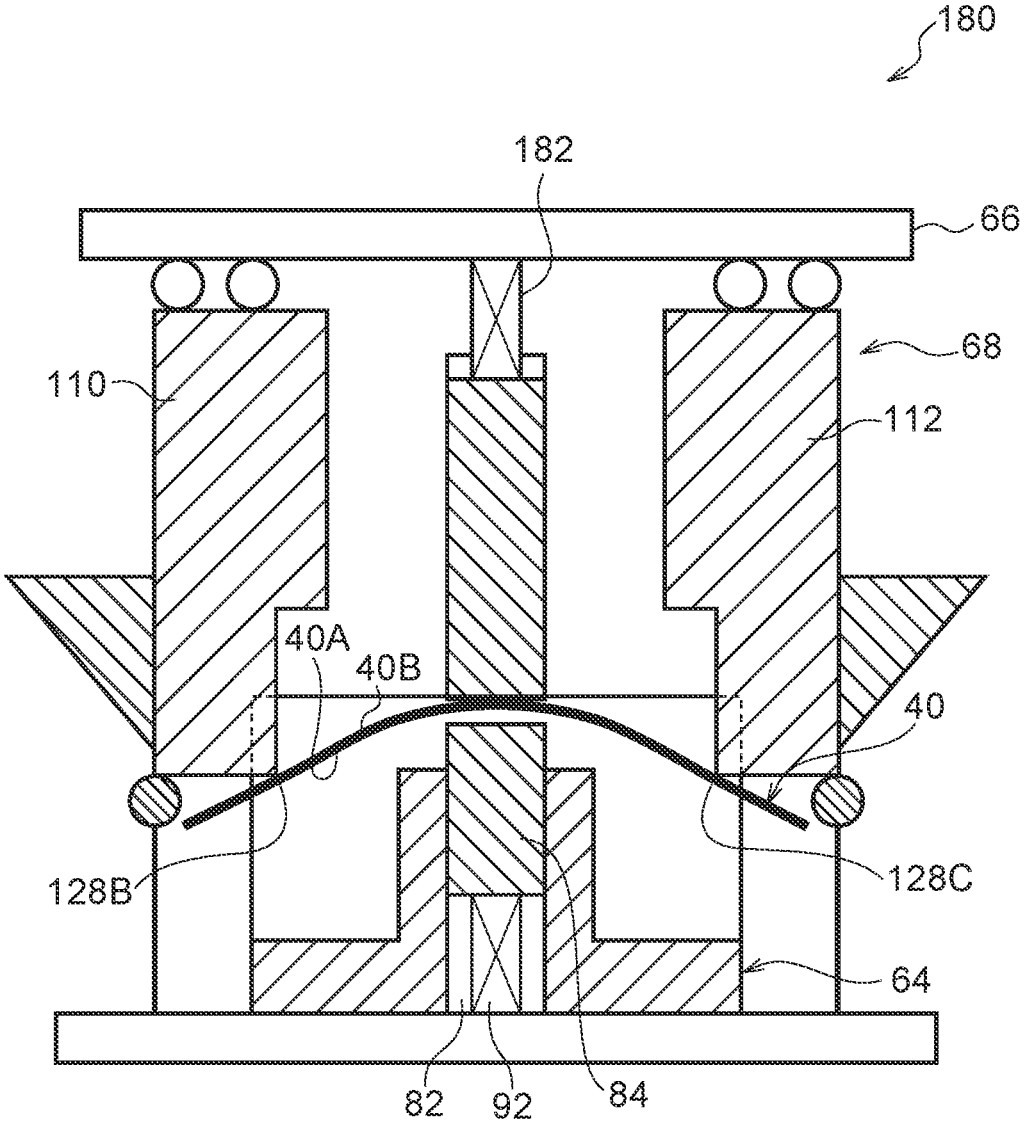
FIG. 40 is a cross-section sectioned along line G2-G2 in FIG. 39.

As illustrated in FIG. 38 to FIG. 40, the die 68 supported by the die bed 66 is then moved toward the punch 64 by the non-illustrated press mechanism. Locations of the blank 40 beyond the two outer sides of the punch apex face 80 are thereby pushed toward the punch 64 by the die shoulders 128B, 128C.

When this is performed, the die bottom face 172A of the die-side pad 172 hits the apex of the curled portion of the blank 40. The die-side extension/retraction mechanism 182 is compressed as a result.

The blank 40 is then gripped between the die bottom face 172A of the die-side pad 172 and the punch rising faces 74.

Second Pressing Process

Figure 41:
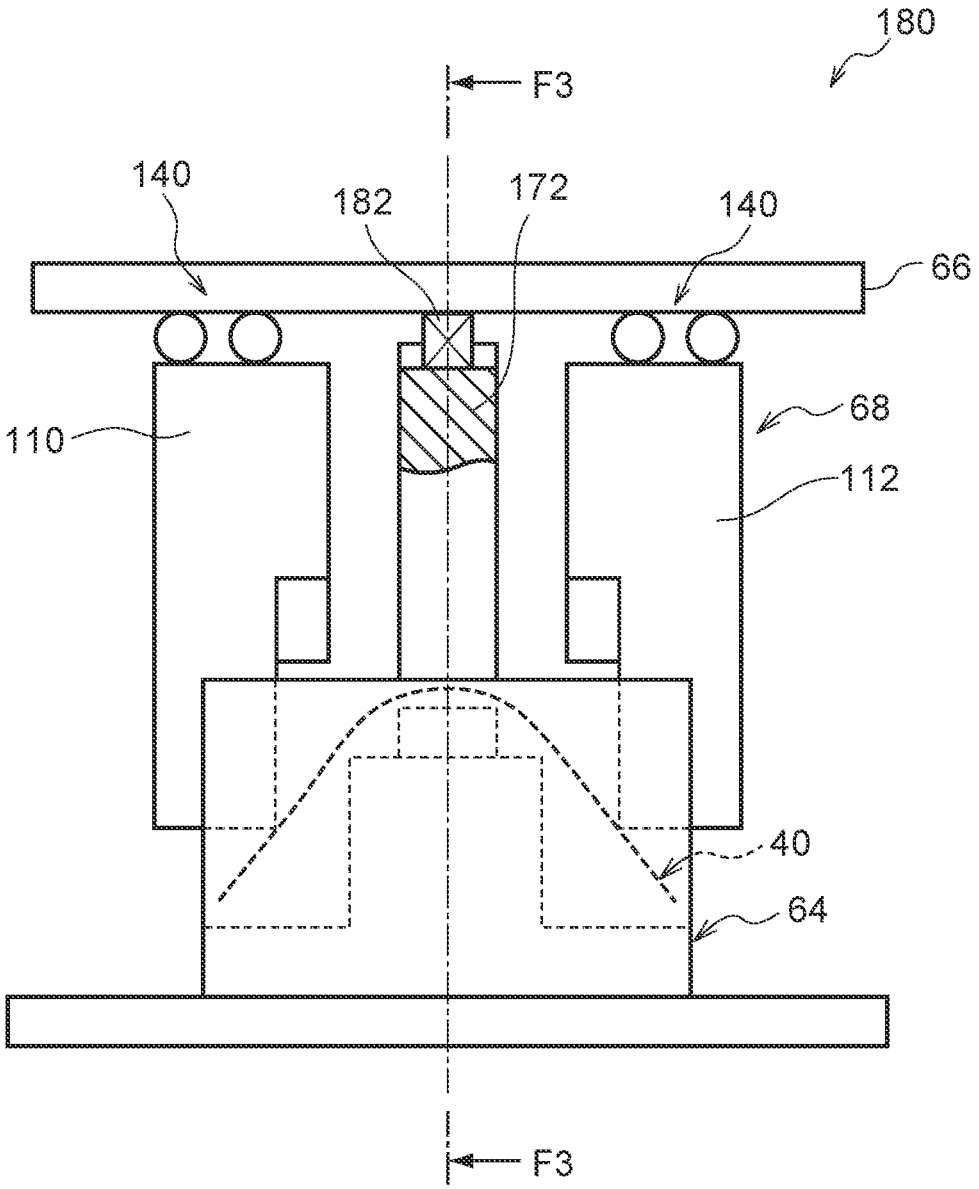
FIG. 41 is a front view of a pressing apparatus, illustrating a process following that illustrated in FIG. 38.
Figure 42:
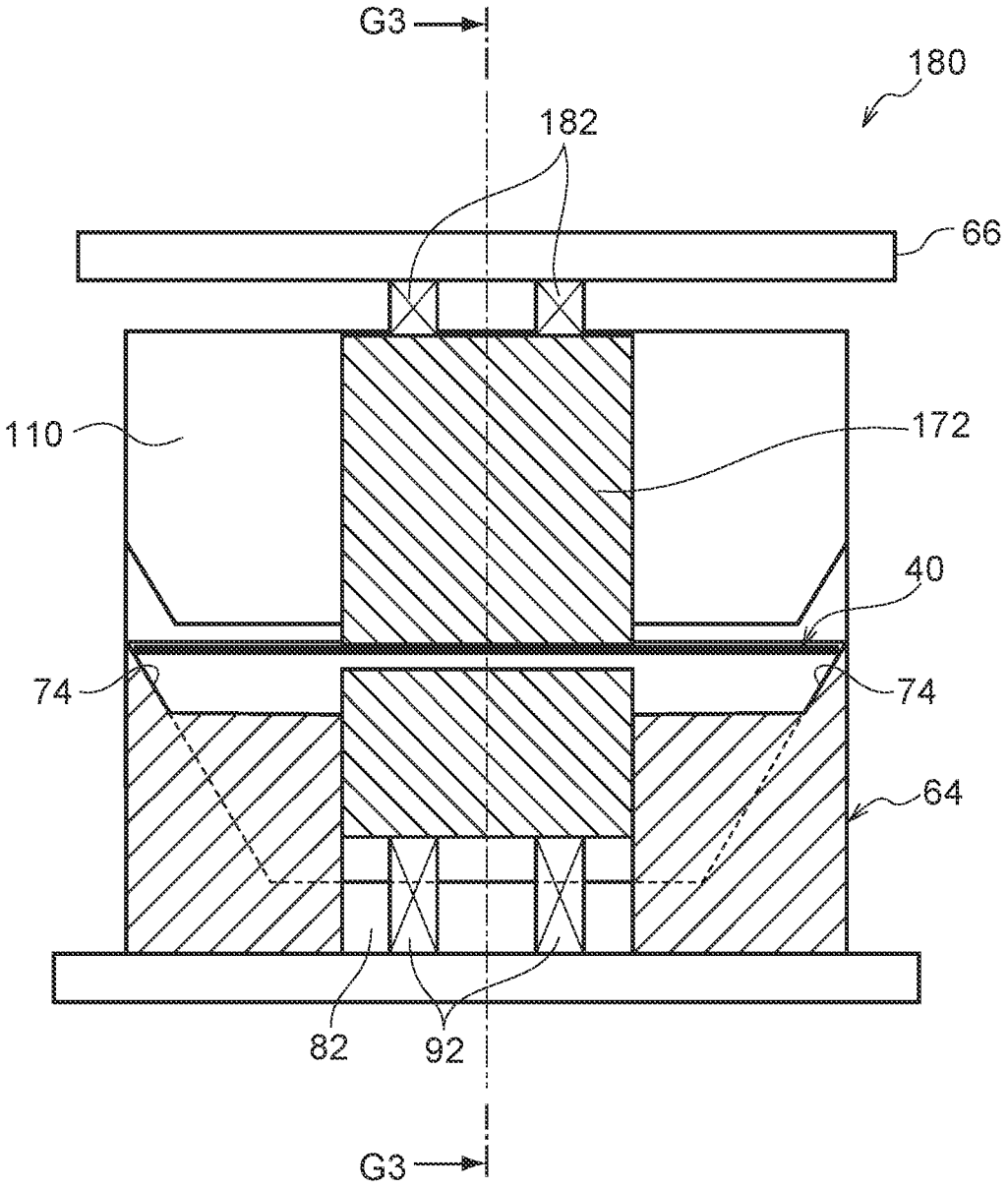
FIG. 42 is a cross-section sectioned along line F3-F3 in FIG. 41.
Figure 43:
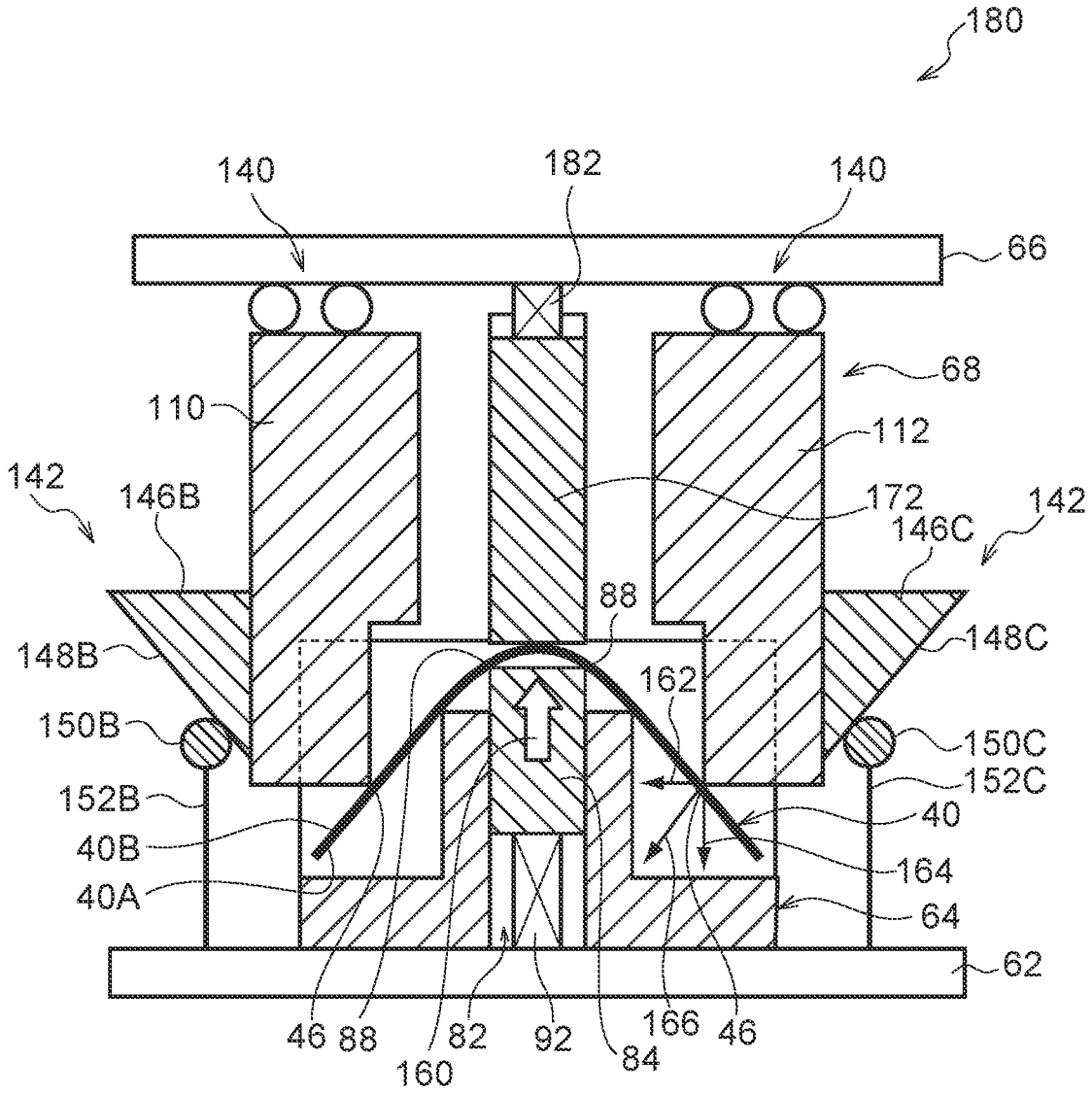
FIG. 43 is a cross-section sectioned along line G3-G3 in FIG. 42.

Next, as illustrated in FIG. 41 to FIG. 43, the die 68 is moved further toward the punch 64 by the non-illustrated press mechanism. The first die segment 110 and the second die segment 112 are thereby moved toward the punch 64, and also moved toward the die-side pad 172, by the drive source (thereby configuring a pushing process including the first pressing process and the second pressing process).

When this is performed, the die-side extension/retraction mechanism 182 is compressed further such that the die-side pad 172 reaches top dead center closest to the die bed 66.

The curled portion of the blank 40 hits the pad protruding ridges 88 of the punch-side pad 84. This enables the blank 40 to be gripped between the die bottom face 172A of the die-side pad 172 and the punch-side pad 84.

Housing Process

Figure 44:
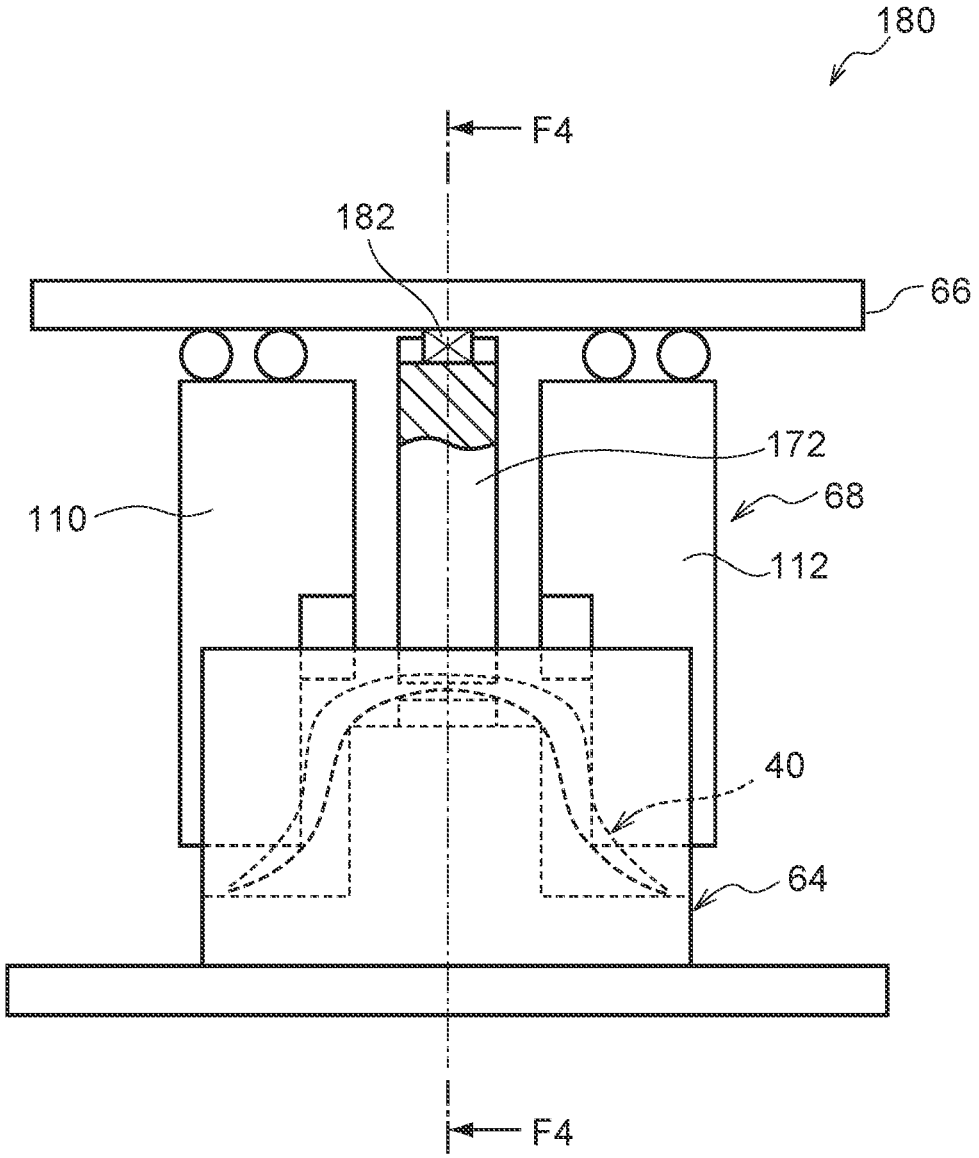
FIG. 44 is a front view of a pressing apparatus, illustrating a process following that illustrated in FIG. 41.
Figure 45:
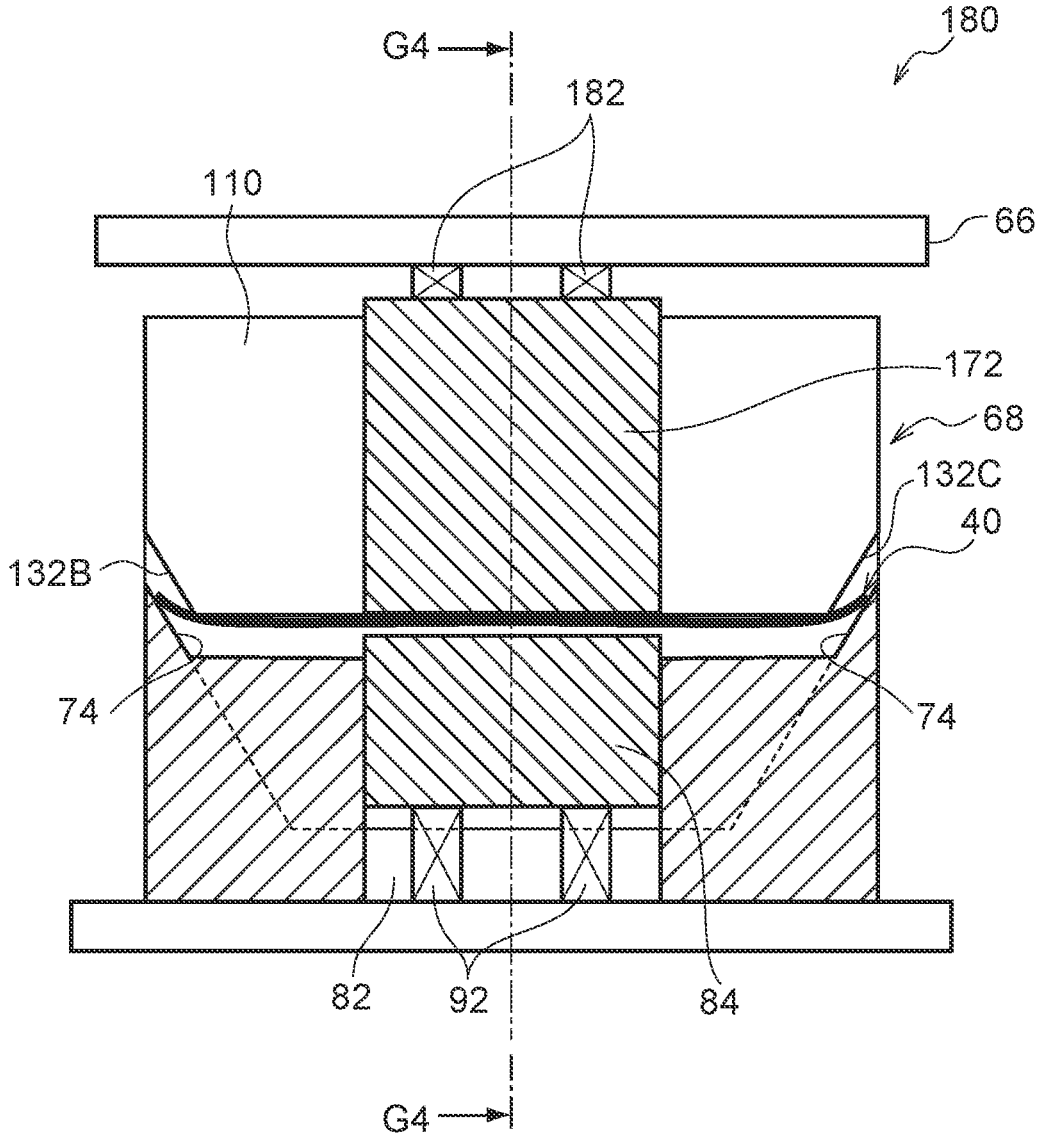
FIG. 45 is a cross-section sectioned along line F4-F4 in FIG. 44.
Figure 46:
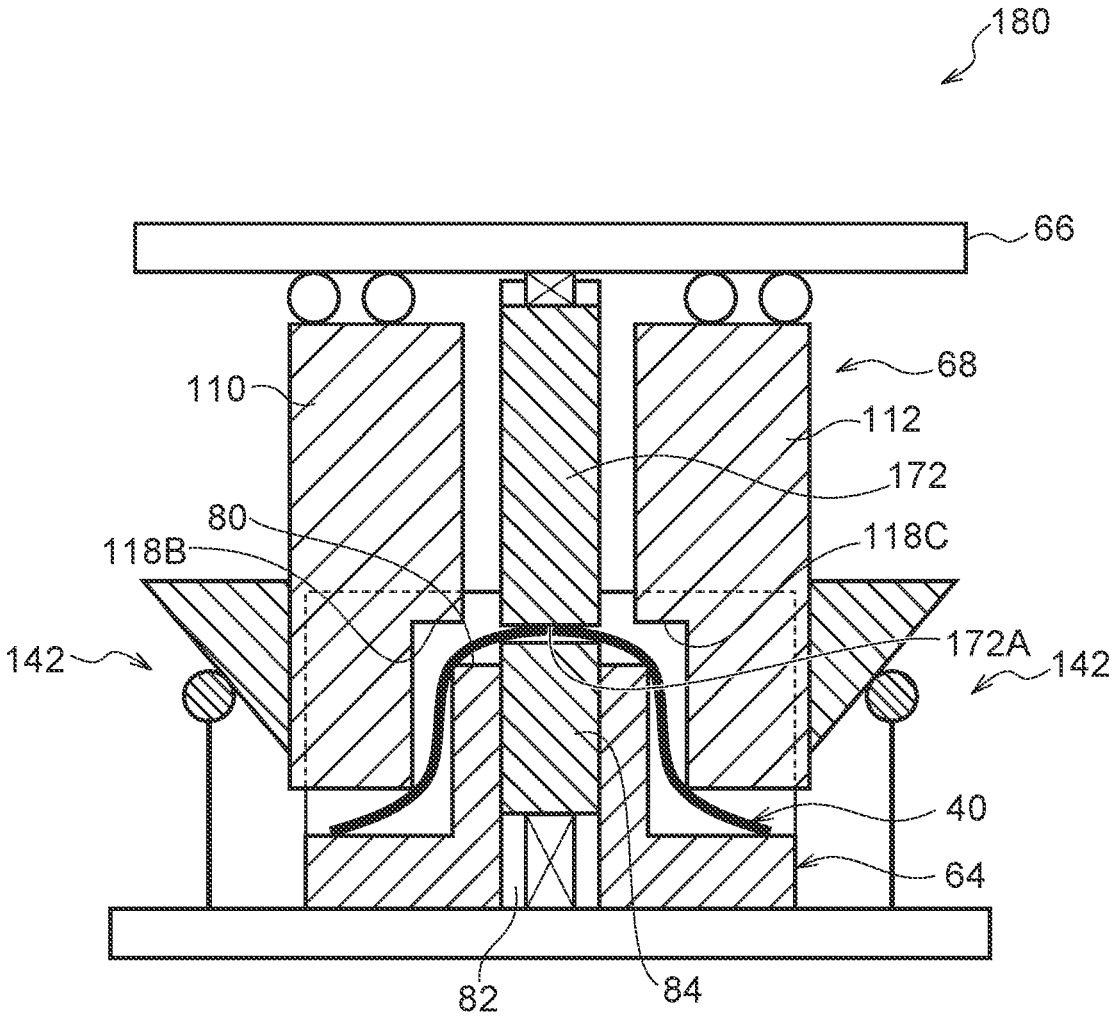
FIG. 46 is a cross-section sectioned along line G4-G4 in FIG. 45.

As illustrated in FIG. 44 to FIG. 46, the die 68 is then moved further toward the punch 64 by the non-illustrated press mechanism. The blank 40 is thereby pushed toward the punch apex face 80 by the die bottom faces 118B, 118C of the two die segments 110, 112 and the die bottom face 172A of the die-side pad 172 that has reached top dead center.

The punch-side pad 84 is thereby housed inside the punch-side pad housing portion 82 while the blank 40 is gripped between the punch-side pad 84 and the die bottom faces 118B, 118C, 172A (housing process, an example of a process of housing).

At the same time, the end portion flange configuration locations 54 of the blank 40 are raised up along the punch rising faces 74.

Clamping Process

Figure 47:
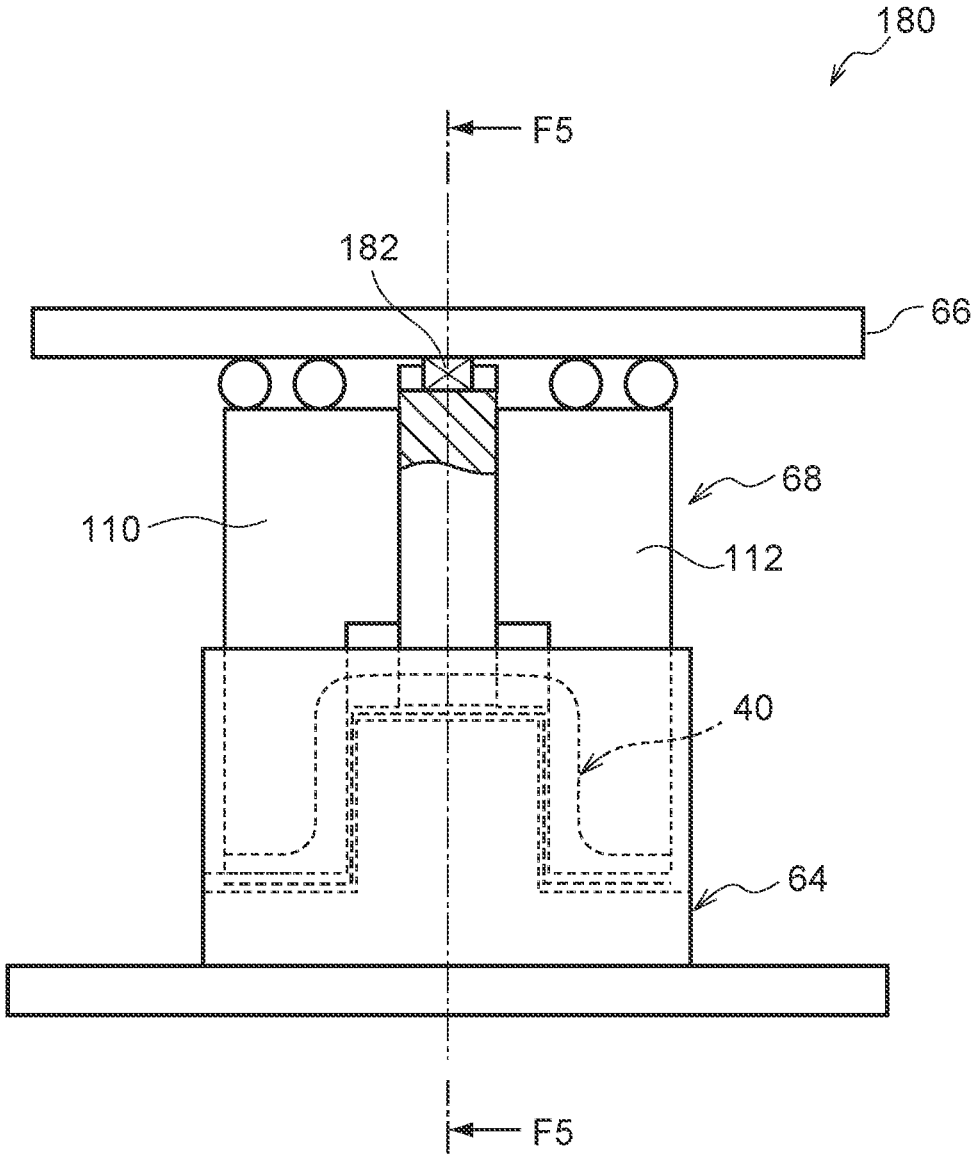
FIG. 47 is a front view of a pressing apparatus, illustrating a process following that illustrated in FIG. 44.
Figure 48:
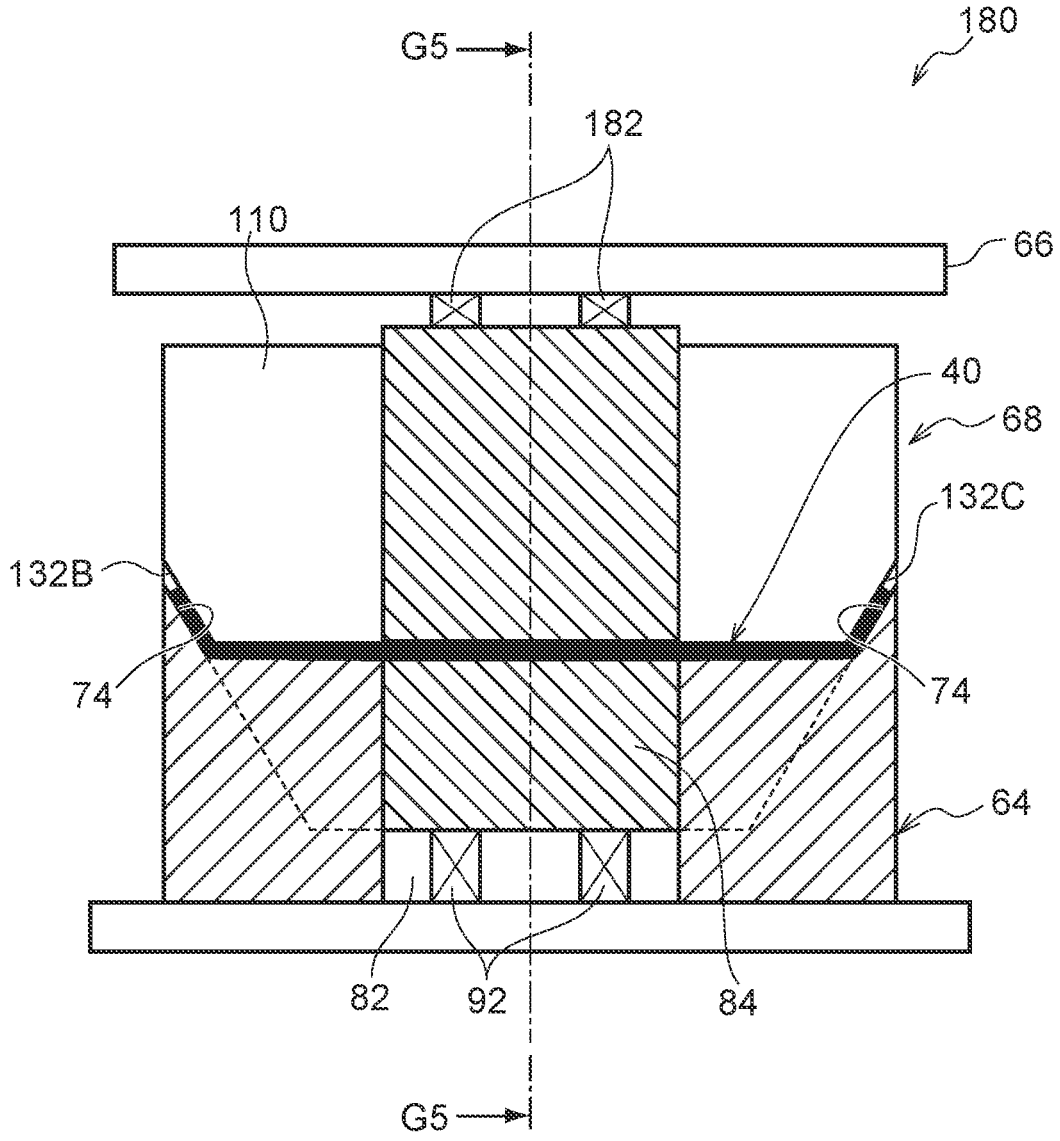
FIG. 48 is a cross-section sectioned along line F5-F5 in FIG. 47.
Figure 49:
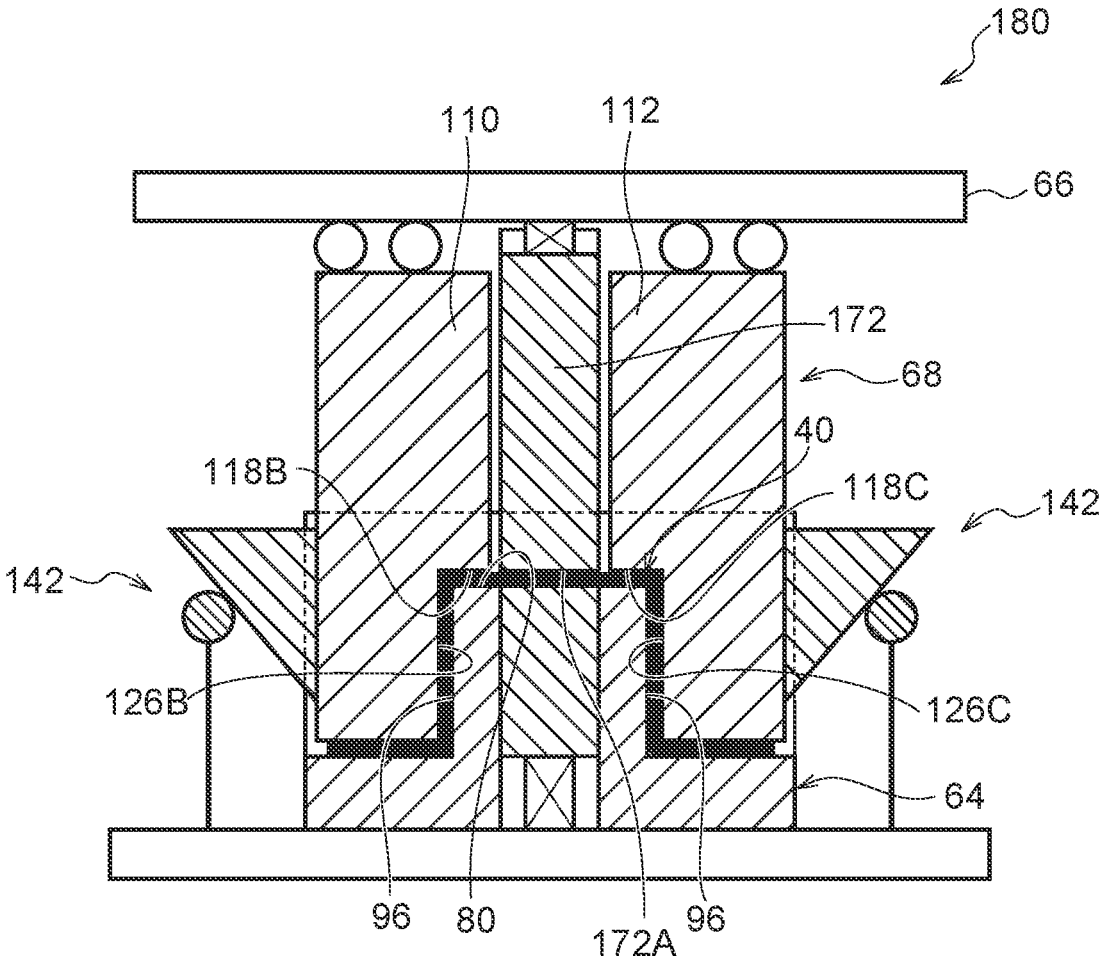
FIG. 49 is a cross-section sectioned along line G5-G5 in FIG. 48.

As illustrated in FIG. 47 to FIG. 49, the die 68 is then moved further toward the punch 64 by the non-illustrated press mechanism, moving the die 68 such that the die 68 moves closer to the punch 64 until reaching bottom dead center. The blank 40 is thereby clamped by a combination of the punch apex face 80 and the die bottom faces 118B, 118C, 172A, the punch side-faces 96 and the die inner faces 126B, 126C, and the punch rising faces 74 and the die rising faces 132B, 132C, 172C (clamping process, an example of a process of clamping).

The blank 40 is transformed into the saddle-shaped press-molded article 10 in this manner.

Operation and Advantageous Effects

The present exemplary embodiment enables similar operation and advantageous effects to those in the first exemplary embodiment and the second exemplary embodiment to be exhibited.

Moreover, the blank 40 can be gripped between the die bottom face 172A of the die-side pad 172 and the punch rising faces 74 or the punch-side pad 84 from the point in time at which the die bottom face 172A of the die-side pad 172 hits the apex of the curled portion of the blank 40.

This enables positional misalignment of the blank 40 that might occur during press molding to be suppressed.

Comparative Testing

Figure 50:
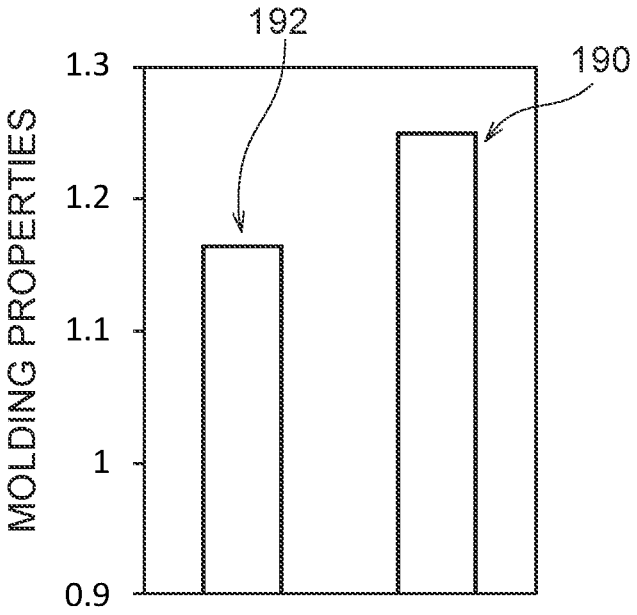
FIG. 50 is a bar chart illustrating advantageous effects of an exemplary embodiment.

FIG. 50 is a graph to illustrate the advantageous effects of an exemplary embodiment. A test to compare molding properties was performed with a saddle-shaped press-molded article 10 molded using the pressing apparatus 60, 170, or 180 of an exemplary embodiment 190, and a saddle-shaped press-molded article 10 molded using a pressing apparatus of a comparative example 192. The dimensions of each location of the respective molded saddle-shaped press-molded articles 10 are the same dimension.

In the comparative example 192, a pressing apparatus employing a die 68 in which the first die segment 110 and the second die segment 112 of the above exemplary embodiments are integrated into a single unit was used to mold the saddle-shaped press-molded article 10. In the exemplary embodiment 190, as an example the pressing apparatus 60 of the first exemplary embodiment was used to mold the saddle-shaped press-molded article 10.

The molding properties of the comparative example 192 and the exemplary embodiment 190 were computed as a ratio based on a maximum rate of sheet thickness reduction at the end portion flanges 30 of the respective saddle-shaped press-molded articles 10.

The graph confirms that the exemplary embodiment 190 achieves better molding properties than the comparative example 192, and that cracking is less liable to occur.

This enables the extension length of the end portion flanges 30 to be increased, and enables component rigidity to be improved. Moreover, the saddle-shaped press-molded article 10 of the exemplary embodiment 190 enables efficiently load transmission on input of an impact, enabling collision safety to be improved. Furthermore, the saddle-shaped press-molded article 10 of the exemplary embodiment 190 can be made thinner, enabling a reduction in weight to be achieved.

EXPLANATION OF THE REFERENCE NUMERALS

10 saddle-shaped press-molded article
14 top plate portion
16 inner face
18 protruding ridge portion
20 vertical wall portion
22 lower inverted ridge portion
24 lower flange
26 end portion inverted ridge portion
30 end portion flange
30B corner portion
40 blank
40A inner face
40B outer face
42 top plate configuration location
44 protruding ridge configuration location
46 vertical wall configuration location
48 lower inverted ridge configuration location
50 lower flange configuration location
52 end portion inverted ridge configuration location
54 end portion flange configuration location
56 curve configuration location
56A indentation configuration location
60 pressing apparatus
62 punch bed
64 punch
66 die bed
68 die
74 punch rising face
80 punch apex face
82 punch-side pad housing portion
84 punch-side pad
86 pad apex face
88 pad protruding ridge
90 pad side-face
92 punch-side extension/retraction mechanism
94 punch shoulder
96 punch side-face
98 punch end portion inverted ridge
100 punch inverted ridges
110 first die segment
112 second die segment
118B die bottom face
118C die bottom face
123B die rising face
123C die rising face
124 drive source
124B die inverted ridge
124C die inverted ridge
126B die inner face
126C die inner face
128B die shoulder
128C die shoulder
130B die end portion protruding ridge
130C die end portion protruding ridge
132B die rising face
132C die rising face
140 slide mechanism
142 drive source
146B cam
146C cam
148B cam face
148C cam face
150B cam follower
150C cam follower
160 first force
162 second force
164 third force
166 net force
170 pressing apparatus
172 die-side pad
172A die bottom face
172B die pad end portion protruding ridge
172C die pad rising face
174 die-side pad
174A die bottom face
180 pressing apparatus
182 die-side extension/retraction mechanism Supplement The present specification conceptualizes the following aspects.

Aspect 1 is a method to manufacture a saddle-shaped press-molded article by manufacturing from a blank made of sheet metal, the saddle-shaped press-molded article including:

a top plate portion;

protruding ridge portions respectively adjoining two side portions of the top plate portion;

vertical wall portions respectively adjoining the protruding ridge portions so as to face each other;

an end portion inverted ridge portion adjoining an end portion of the top plate portion, end portion of the protruding ridge portions, and end portion of the vertical wall portions; and an end portion flange adjoining the end portion inverted ridge portion, the saddle-shaped press-molded article manufacturing method including:

curling the blank at a top plate configuration location of the blank that will form the top plate portion;

applying the curl with a first force acting from an inner face side toward an outer face side of the blank at the top plate configuration location;

applying the curl with a net force configured by second forces acting in mutually facing directions and a third force acting in an opposing direction to the first force at the outer face side of respective vertical wall configuration locations of the blank that will be molded into the vertical wall portions; and in a state in which the top plate configuration location is curled, restraining an end portion inverted ridge configuration location that will be molded into the end portion inverted ridge portion, the top plate configuration location, the vertical wall configuration locations, and an end portion flange configuration location that will be molded into the end portion flange.

Aspect 2 is the saddle-shaped press-molded article manufacturing method of aspect 1, wherein:

the saddle-shaped press-molded article further includes lower inverted ridge portions adjoining the vertical wall portions and adjoining the end portion inverted ridge portion, and lower flanges adjoining the lower inverted ridge portions; and wherein in the press-molded article manufacturing method, molding of the lower inverted ridge portions from lower inverted ridge configuration locations for molding into the lower inverted ridge portions is completed at the same time as molding of the end portion inverted ridge portion.

Aspect 3 is the saddle-shaped press-molded article manufacturing method of aspect 1 or aspect 2, wherein an application direction of the third force is the same direction as a direction normal to the top plate configuration location.

Aspect 4 is pressing apparatus including:

a punch including a punch apex face including a punch-side pad housing portion, punch shoulders adjoining two side portions of the punch apex face, punch side-faces adjoining the respective punch shoulders, a punch end portion inverted ridge adjoining an end portion of the punch apex face, end portion of the punch shoulders, and end portion of the punch side-faces, and a punch rising face adjoining the punch end portion inverted ridge;

a punch-side pad that is disposed so as to be capable of being housed inside the punch-side pad housing portion and that includes a pad apex face facing an outer side of the punch;

a punch-side extension/retraction mechanism that is disposed inside the punch-side pad housing portion and that creates a state in which the pad apex face projects outward from the punch-side pad housing portion;

a die including a die bottom face opposing the punch apex face, die inverted ridges adjoining the die bottom face and opposing the punch shoulders, die inner faces adjoining the die inverted ridges and opposing the punch side-faces, die shoulders adjoining the die inner faces, a die end portion protruding ridge adjoining the die bottom face, the die inverted ridges, the die inner faces, and the die shoulders, and opposing the punch end portion inverted ridge, and a die rising face adjoining the die end portion protruding ridge and opposing the punch rising face, the die being configured with a first die segment configuring one of the mutually opposing die inner faces on one side and a second die segment configuring one of the mutually opposing die inner faces on another side;

a die bed that supports the die;

a slide mechanism through which the first die segment and the second die segment are supported by the die bed such that the first die segment and the second die segment are capable of sliding in mutually approaching directions; and a drive source configured to slide the first die segment and the second die segment in mutually approaching directions.

Aspect 5 is the pressing apparatus of aspect 4, further including:

a die-side pad that configures at least part of the die bottom face and that is provided to the die bed so as to be disposed between the first die segment and the second die segment.

Aspect 6 is the pressing apparatus of aspect 5, further including:

a die-side extension/retraction mechanism that is provided between the die bed and the die-side pad so as to bias the die-side pad toward the punch-side pad and to enable the die-side pad to retreat in a direction toward the die bed.

Aspect 7 is a manufacturing method to manufacture a saddle-shaped press-molded article employing the pressing apparatus of any one of aspect 4 to aspect 6, the saddle-shaped press-molded manufacturing method including:

supporting a blank using at least one out of the pad apex face or the punch rising face in a state in which the punch-side pad is projecting out beyond the punch apex face;

pushing locations of the blank at both outer sides of the punch apex face toward the punch side-faces using the die shoulders;

housing the punch-side pad in the punch-side pad housing portion while gripping the blank between the punch-side pad and the die bottom face; and clamping the blank using a combination of the punch apex face and the die bottom face, the punch side-faces and the die inner faces, and the punch rising face and the die rising face.

Alternative Aspects

An alternative aspect 1 is a method to manufacture a saddle-shaped press-molded article by manufacturing from a blank made of sheet metal, the saddle-shaped press-molded article including:

a top plate portion;

protruding ridge portions respectively adjoining two side portions of the top plate portion;

vertical wall portions respectively adjoining the protruding ridge portions so as to face each other;

an end portion inverted ridge portion adjoining an end portion of the top plate portion, end portion of the protruding ridge portions, and end portion of the vertical wall portions; and an end portion flange adjoining the end portion inverted ridge portion.

The alternative aspect 1 saddle-shaped press-molded article manufacturing method includes applying a top plate configuration location of the blank that will be molded into the top plate portion with a first force acting from an inner face side toward an outer face side of the blank, applying outer face sides of respective vertical wall configuration locations of the blank that will be molded into the vertical wall portions with a net force configured by second forces acting in mutually facing directions and a third force acting in an opposing direction to the first force, and in a state in which the top plate configuration location is curled, restraining an end portion inverted ridge configuration location that will be molded into the end portion inverted ridge portion, the top plate configuration location, the vertical wall configuration locations, and an end portion flange configuration location that will be molded into the end portion flange.

An alternative aspect 2 is the saddle-shaped press-molded article manufacturing method of alternative aspect 1, wherein the saddle-shaped press-molded article further includes lower inverted ridge portions adjoining the vertical wall portions and adjoining the end portion inverted ridge portion, and lower flanges adjoining the lower inverted ridge portions; and wherein in the press-molded article manufacturing method, molding of the lower inverted ridge portions from lower inverted ridge configuration locations for molding into the lower inverted ridge portions is completed at the same time as molding of the end portion inverted ridge portion.

An alternative aspect 3 is the saddle-shaped press-molded article manufacturing method of alternative aspect 1 or alternative aspect 2, wherein an application direction of the third force is the same direction as a direction normal to the top plate configuration location.

An alternative aspect 4 is a pressing apparatus including a punch including a punch apex face including a punch-side pad housing portion, punch shoulders adjoining two side portions of the punch apex face, punch side-faces adjoining the respective punch shoulders, a punch end portion inverted ridge adjoining an end portion of the punch apex face, end portion of the punch shoulders, and end portion of the punch side-faces, and a punch rising face adjoining the punch end portion inverted ridge;

a punch-side pad that is disposed so as to be capable of being housed inside the punch-side pad housing portion and that includes a pad apex face facing an outer side of the punch;

a punch-side extension/retraction mechanism that is disposed inside the punch-side pad housing portion and that creates a state in which the pad apex face projects outward from the punch-side pad housing portion;

a die including a die bottom face opposing the punch apex face, die inverted ridges adjoining the die bottom face and opposing the punch shoulders, die inner faces adjoining the die inverted ridges and opposing the punch side-faces, die shoulders adjoining the die inner faces, a die end portion protruding ridge adjoining the die bottom face, the die inverted ridges, the die inner faces, and the die shoulders, and opposing the punch end portion inverted ridge, and a die rising face adjoining the die end portion protruding ridge and opposing the punch rising face, the die being configured with a first die segment configuring one of the mutually opposing die inner faces on one side and a second die segment configuring one of the mutually opposing die inner faces on another side;

a die bed that supports the die;

a slide mechanism through which the first die segment and the second die segment are supported by the die bed such that the first die segment and the second die segment are capable of sliding in mutually approaching directions; and a drive source configured to slide the first die segment and the second die segment in mutually approaching directions.

An alternative aspect 5 is the pressing apparatus of alternative aspect 4, further including a die-side pad that configures at least part of the die bottom face and that is provided to the die bed so as to be disposed between the first die segment and the second die segment.

An alternative aspect 6 is the pressing apparatus of alternative aspect 5, further including a die-side extension/retraction mechanism that is provided between the die bed and the die-side pad so as to bias the die-side pad toward the punch-side pad and to enable the die-side pad to retreat in a direction toward the die bed.

An alternative aspect 7 is a manufacturing method to manufacture a saddle-shaped press-molded article employing the pressing apparatus of any one aspect of alternative aspect 4 to alternative aspect 6, the manufacturing method including:

a process of supporting a blank using at least one out of the pad apex face or the punch rising face in a state in which the punch-side pad is projecting out beyond the punch apex face;

a process of pushing locations of the blank at both outer sides of the punch apex face toward the punch side-faces using the die shoulders;

a process of housing the punch-side pad in the punch-side pad housing portion while gripping the blank between the punch-side pad and the die bottom face; and a process of clamping the blank using a combination of the punch apex face and the die bottom face, the punch side-faces and the die inner faces, and the punch rising face and the die rising face.

The entire content of the disclosure of Japanese Patent Application No. 2018-091844 filed on May 11, 2018 is incorporated by reference in the present specification.

All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. A pressing apparatus comprising:

a punch including a punch apex face including a punch-side pad housing portion, punch shoulders adjoining two side portions of the punch apex face, punch side-faces adjoining the respective punch shoulders, a punch end portion inverted ridge adjoining an end portion of the punch apex face, end portions of the punch shoulders, and end portions of the punch side-faces, and a punch rising face adjoining the punch end portion inverted ridge;

a punch-side pad that is disposed so as to be capable of being housed inside the punch-side pad housing portion and that includes a pad apex face facing an outer side of the punch;

a punch-side extension/retraction mechanism that is disposed inside the punch-side pad housing portion and that creates a state in which the pad apex face projects outward from the punch-side pad housing portion;

a die including a die bottom face opposing the punch apex face, die inverted ridges adjoining the die bottom face and opposing the punch shoulders, die inner faces adjoining the die inverted ridges and opposing the punch side-faces, die shoulders adjoining the die inner faces, a die end portion protruding ridge adjoining the die bottom face, the die inverted ridges, the die inner faces, and the die shoulders, and opposing the punch end portion inverted ridge, and a die rising face adjoining the die end portion protruding ridge and opposing the punch rising face, the die being configured with a first die segment configuring one of the die inner faces on one side and a second die segment configuring another of the die inner faces on another side, wherein the one of the die inner faces and the other of the die inner faces are mutually opposing;

a die bed that supports the die;

a slide mechanism through which the first die segment and the second die segment are supported by the die bed such that the first die segment and the second die segment are capable of sliding in mutually approaching directions; and a drive source configured to slide the first die segment and the second die segment in mutually approaching directions.

2. The pressing apparatus of claim 1, further comprising:

a die-side pad that defines at least part of the die bottom face and that is provided at the die bed so as to be disposed between the first die segment and the second die segment.

3. The pressing apparatus of claim 2, further comprising:

a die-side extension/retraction mechanism that is provided between the die bed and the die-side pad so as to bias the die-side pad toward the punch-side pad and to enable the die-side pad to retreat in a direction toward the die bed.

4. A method of manufacturing a press-molded article employing the pressing apparatus of claim 1, the method comprising:

supporting a blank using at least one of the pad apex face or the punch rising face in a state in which the punch-side pad is projecting out beyond the punch apex face;

pushing locations of the blank at both outer sides of the punch apex face toward the punch side-faces using the die shoulders;

housing the punch-side pad in the punch-side pad housing portion while gripping the blank between the punch-side pad and the die bottom face;

clamping the blank using a combination of the punch apex face and the die bottom face, the punch side-faces and the die inner faces, and the punch rising face and the die rising face; and while the blank is clamped, pressing the blank into the press-molded article via the punch and the die.

5. A method of manufacturing a saddle-shaped press-molded article from a blank made of sheet metal, the saddle-shaped press-molded article including:

a top plate portion which is flat and has a pair of edges and a pair of ends, a length of the top plate portion extending between the pair of ends and a width of the top plate portion extending between the pair of edges;

two protruding ridge portions extending along the length of the top plate portion at respective edges of the top plate portion, each protruding ridge portion having two ends that extend along a length of the protruding ridge portion;

vertical wall portions respectively extending from the protruding ridge portions so as to face each other, each vertical wall portion having two sides and a bottom portion, the two sides of the vertical wall portion extending between the bottom portion of the vertical wall portion and the ends of one of the protruding ridge portions, such that the top plate portion, the protruding ridge portions and the vertical wall portions together form a saddle shape;

an inverted ridge portion continuously adjoining the ends of the top plate portion, the ends of both of the protruding ridge portions, and the sides of both of the vertical wall portions; and two end portion flanges, each end portion flange integrally adjoined, via the inverted ridge portion, to one end of the top plate and to ends of the protruding ridge portions and sides of the vertical wall portions that are adjacent to the one end of the top plate portion, the method comprising:

applying a first force to one surface of the blank, via a punch side pad, at a first area of the blank that extends within a predetermined width on either side of a chosen centerline of the blank, such that the blank curves toward an opposite surface of the blank, wherein the first area of the blank will be formed into the top plate portion of the article;

while applying the first force, applying a net force, via die shoulders, to respective positions on the opposite surface of the blank which are an equal distance between the first area and edges of the blank parallel to the chosen centerline, each net force resulting from a second force acting in a direction orthogonal to a direction of the first force and a third force acting in an opposite direction to the first force, such that respective second areas on either side of the first area, which will be formed into the vertical wall portions of the article, bend to face each other;

in a state in which the blank is curved, restraining the blank along lines at a predetermined distance from edges of the blank that are orthogonal to the chosen centerline and press-molding the blank into the saddle-shaped article, via a punch and a die, by flattening the curved first area into the top plate portion, forming the second areas into the vertical wall portions, with the protruding ridge portions between the top plate portion and the vertical wall portions, forming the inverted ridge portions along the lines at which the blank is restrained, and forming the end flange portions from surplus material between the lines and the edges of the blank that are orthogonal to the chosen centerline.

6. The method of claim 5, further comprising:

at the same time as forming the inverted ridge portions, molding portions of the blank at a predetermined distance from edges of the blank parallel to the chosen centerline to form lower inverted ridges of the article.

7. The method of claim 5, wherein an application direction of the third force is normal to the top plate configuration location.

* * * * *